US009353923B2

(12) United States Patent
Scribante et al.

(10) Patent No.: US 9,353,923 B2
(45) Date of Patent: May 31, 2016

(54) COMBINATION RETROFIT AND NEW CONSTRUCTION TROFFER LIGHT FIXTURE SYSTEMS AND METHODS

(71) Applicant: Orion Energy Systems, Inc., Manitowoc, WI (US)

(72) Inventors: John Scribante, Manitowoc, WI (US); Scott A. Green, Ponte Vedra Beach, FL (US); Marc Meade, Manitowoc, WI (US); Therese Bartz, Manitowoc, WI (US); Matthew S. Tlachac, Manitowoc, WI (US); Ronald E. Ernst, Waldo, WI (US)

(73) Assignee: Orion Energy Systems, Inc., Manitowoc, WI (US)

( * ) Notice: Subject to any disclaimer, the term of this patent is extended or adjusted under 35 U.S.C. 154(b) by 0 days.

(21) Appl. No.: 14/509,934

(22) Filed: Oct. 8, 2014

(65) Prior Publication Data

US 2016/0102825 A1 Apr. 14, 2016

(51) Int. Cl.

| | |
|---|---|
| ***F21S 8/00*** | (2006.01) |
| ***F21S 8/04*** | (2006.01) |
| ***F21K 99/00*** | (2016.01) |

(52) U.S. Cl.
CPC *F21S 8/043* (2013.01); *F21K 9/175* (2013.01)

(58) Field of Classification Search
CPC ..... F21K 9/175
USPC ..... 362/362, 217.05
See application file for complete search history.

(56) References Cited

U.S. PATENT DOCUMENTS

| | | | | |
|---|---|---|---|---|
| 4,367,417 | A * | 1/1983 | Casasanta | 307/147 |
| 4,490,957 | A * | 1/1985 | Bumpus et al. | 52/506.07 |
| 4,969,282 | A * | 11/1990 | Eberhart | 40/545 |
| 5,727,871 | A * | 3/1998 | Kotloff | 362/225 |
| 8,038,318 | B2 * | 10/2011 | Plunk | 362/235 |
| 8,220,957 | B2 | 7/2012 | Lydecker et al. | |
| 8,523,383 | B1 | 9/2013 | Grigore et al. | |
| 2010/0309658 | A1 * | 12/2010 | Rouse | F21S 4/003 362/217.12 |

OTHER PUBLICATIONS

A.L.P. Lighting Components, Inc., "Advanced Retrofit Solutions Handbook", 2013, 76 pages.
FSC, "RDI-BSK-RFK Series: RDI Perforated Center Basket Retrofit Kit", Santa Fe Springs, California, revised Apr. 27, 2012, 1 page.
Precision-Paragon [P2], "TKD LED Troffer Door Kit Installation Instructions", revised Aug. 12, 2014, 2 pages.

* cited by examiner

*Primary Examiner* — Sharon Payne
(74) *Attorney, Agent, or Firm* — Foley & Lardner LLP

(57) ABSTRACT

A light fixture is configured for use in either retrofitting an existing troffer light fixture or for use in new construction. The light fixture includes a self-supporting adaptor bracket configured to rest on a T-bar of a ceiling system and further configured to optionally receive a housing of the existing troffer light fixture. The light fixture further includes a door assembly including a latch configured to engage a latch surface of the adaptor bracket, a hinge configured to interface with a slot of the adaptor bracket, a housing including the latch and the hinge, and a light source within the housing.

15 Claims, 23 Drawing Sheets

COMBINATION RETROFIT AND NEW CONSTRUCTION TROFFER LIGHT FIXTURE SYSTEMS AND METHODS

BACKGROUND

The invention relates generally to a system and method for providing a troffer light fixture for use in either retrofitting an existing troffer style light fixture or in new construction applications. Existing troffer light fixtures can be retrofitted to include a more efficient light source, replace components of a damaged troffer style light fixture, and/or otherwise upgrade or replace an existing troffer light fixture. In new construction, a troffer light fixture can be installed using an engineered ceiling system. It is challenging and difficult to develop a lighting system and methods of using the system which allow for a troffer light fixture to be used in both retrofitting existing light fixture and in new construction applications.

A troffer light fixture is a generally square or rectangular tray like housing and light source which is installed in a ceiling system (e.g., engineered ceiling). The ceiling system may be a dropped ceiling, ceiling grid and tile system, or other engineered ceiling system. The troffer light fixture includes a housing which includes a top body wall and four side body walls. Mounted to the troffer housing are typically lamp sockets (e.g., for fluorescent lamps), lighting ballast which receives electrical power from wiring within the ceiling, and/or other components. The troffer light fixture may further include a door which attaches to the troffer housing. The door may be or include a lens and typically opens downward from the troffer housing. It is challenging and difficult to develop a system which allows for quick and easy retrofitting of an existing troffer light fixture. It is also challenging and difficult to develop a system which retrofits an existing troffer light fixture and reuses the existing troffer housing. Further, it is challenging and difficult to develop a system which is compatible with a variety of troffer light fixtures. Additionally, it is challenging and difficult to provide a light fixture which solves the above described retrofit problems and can further be installed in new construction applications. The troffer light fixture may need to be self-supporting (e.g., without relying on and existing troffer housing for support) in new construction applications. It is challenging and difficult to develop a self-supporting troffer light fixture which may also be used in retrofitting existing troffer light fixtures.

SUMMARY

One embodiment relates to a light fixture configured for use in either retrofitting an existing troffer light fixture or for use in new construction. The light fixture includes a self-supporting adaptor bracket configured to rest on a T-bar of a ceiling system and further configured to optionally receive a housing of the existing troffer light fixture. The light fixture further includes a door assembly including a latch configured to engage a latch surface of the adaptor bracket, a hinge configured to interface with a slot of the adaptor bracket, a housing including the latch and the hinge, and a light source within the housing.

Another embodiment relates to a light fixture for use in either retrofitting an existing troffer light fixture or for use in new construction. The light fixture includes a self-supporting adaptor bracket configured to rest on a T-bar of a ceiling system and further configured to optionally receive a housing of the existing troffer light fixture. The light fixture further includes a door assembly having a latch configured to engage a latch surface of the adaptor bracket, a hinge configured to interface with a slot of the adaptor bracket, a housing including the latch and the hinge, a light source within the housing, and a connection system configured to be used to wire the door assembly to one or more external components.

Another embodiment relates to an adaptor bracket for installing a light fixture. The adaptor bracket includes a support member configured to cause the adaptor bracket to be self-supporting, and an adaptor bracket portion configured to receive a door assembly of the light fixture having a light source, and further configured to rest on one or more T-bars of a ceiling system. The support member and the adaptor bracket are configured to be separate components which are coupled together.

DETAILED DESCRIPTION

Figure 1:
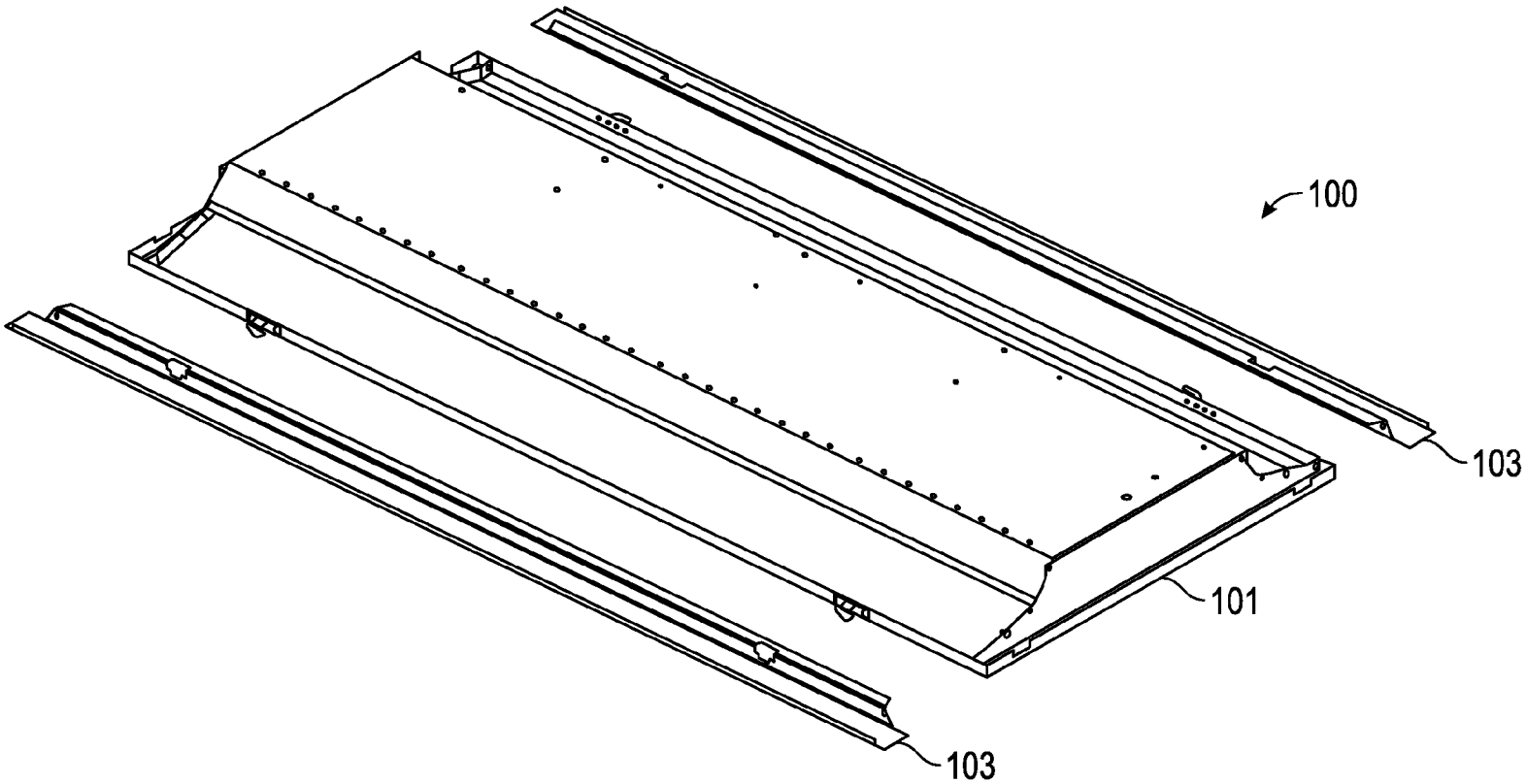
FIG. 1 is an illustration of a troffer retrofit system including a troffer door assembly and two adaptor brackets according to an exemplary embodiment.

In the following detailed description, reference is made to the accompanying drawings. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

A light fixture kit according to the invention may be used for either retrofitting an existing troffer light fixture or for use in new construction. The light fixture kit includes a self-supporting adaptor bracket set which, due to its self-supporting configuration, is usable in retrofitting existing fixtures and in new construction. The self-supporting adaptor bracket set is discussed in more detail with reference to FIGS. 7A-8. The light fixture kit also includes a light assembly which interfaces with the self-supporting adaptor bracket set and includes components such as a light source. The light assembly is discussed in greater detail with reference to FIGS. 1-3D. The self-supporting adaptor bracket set rests on a T-bar of a ceiling system and may receive a housing of an existing troffer light fixture. The light assembly includes a light source and is configured to engage with and be secured to the self-supporting adaptor bracket set. The self-supporting adaptor bracket set includes support members and adaptor bracket portions, wherein the adaptor bracket portions receive and secure the light assembly, and wherein the support members provide lateral support to the adaptor bracket portions such that the adaptor bracket portions remain supported by the T-bars with or without being in contact with the housing of the existing troffer light fixture.

The light assembly (e.g., door assembly) of the light fixture kit is discussed in greater detail with reference to FIGS. 1-3D including a description of mechanisms for securing the light assembly to the self-supporting adaptor bracket set (e.g., using hinges and latches). The adaptor bracket portions of the self-supporting adaptor bracket set are discussed in greater detail with reference to FIGS. 4A-6G including descriptions of how the adaptor bracket portions secure the light assembly and how the adaptor bracket portions are installed in a ceiling system. The self-supporting configuration of the adaptor bracket set is discussed with reference to FIGS. 7A-8. The electronic components of the light assembly and wiring options for use in retrofitting applications and new construction applications are discussed with reference to FIGS. 9A-9C and 11. The installation of the light fixture kit in retrofit applications and new construction applications is discussed with reference to FIGS. 10A and 10B respectively.

Referring to the FIGURES generally, a troffer light fixture is described for use in retrofitting and new construction applications. The troffer light fixture is a troffer retrofit system 100 that may be used either in retrofitting existing troffer light fixtures 209 or in new construction applications. Generally, the troffer light fixture (e.g., troffer retrofit system 100) includes two components (or sets of components). The troffer light fixture includes door assembly 101 and adaptor brackets 103. Door assembly 101 includes features of the light fixture such as a light source, lens, sensors, control circuits, and/or other components. Door assembly 101 provides light and otherwise functions as a light fixture. Adaptor brackets 103 are used in installing the light fixture and door assembly 101 in either retrofitting applications or new construction applications. Adaptor brackets 103 are secured in an engineered ceiling using, in whole or in part, troffer housing 209 of an existing troffer light fixture 207. This is described in greater detail with reference to FIGS. 4A-6C. Door assembly 101 is then attached, permanently or removably, to adaptor brackets 103. Adaptor brackets 103 support door assembly 101. This is described in greater detail with reference to FIGS. 3A and 6D-6G.

Adaptor brackets 103 are first described as including two adaptor brackets 103. See FIGS. 1-6G. This description provides details regarding the relationship between door assembly 101 and adaptor brackets 103 as well as the relationship between adaptor brackets 103 and troffer housing 207 of existing troffer light fixture 209 in retrofit applications. In the described embodiments, adaptor brackets 103 may not be self-supporting (e.g., they may rely on troffer housing 207 of existing troffer light fixture 209 to support themselves and/or door assembly 101). Adaptor bracket 103 is further described, with reference to FIGS. 7A-7B, in embodiments for use in either retrofit or new construction applications. Specifically, adaptor bracket 103 is described in embodiments which may support door assembly 101 without the use of troffer housing 207 of an existing troffer light fixture 209. Adaptor bracket 103 can be self-supporting. An alternative embodiment is discussed with reference to FIG. 8.

Door assembly 101 may include one or more features which facilitate the use of door assembly 101 in either retrofit or new construction applications. Door assembly 101 may have a variety or wiring options which facilitate connection to existing wiring for existing troffer light fixture 209 in retrofit applications or to new wiring in new construction applications. These options are discussed in greater detail with reference to FIGS. 9A-9C.

The combination of adaptor bracket 103 and door assembly 101 provides a troffer light fixture which can be used selectively in retrofit or new construction applications. Advantageously, this provides greater flexibility in the use of the troffer light fixture. Furthermore, the troffer light fixture may have the benefit of being classified as both or either a luminaire or retrofit light fixture by underwriting organizations, testing organizations, standards organization, government organizations (e.g., as related to building codes, tax credits, or other government functions), and/or other entities. The troffer light fixture can include additional components or features (e.g., wiring options) which further facilitate the use of the troffer light fixture in retrofit or new construction applications.

The troffer light fixture (e.g., troffer retrofit system 100) is a dual use light fixture capable of retrofitting an existing troffer light fixture 209 and capable of being used to install a new troffer light fixture (e.g., in new construction applications). When used to retrofit an existing troffer light fixture, troffer retrofit system 100 is used in conjunction with components of the existing troffer light fixture 209 and the ceiling system. Adaptor brackets 103 are placed in between the troffer housing 207 of the existing troffer light fixture 209 and T-bars 201 of the ceiling system. Door assembly 100 is hung from adaptor brackets 103 and wired to one or more components of the existing troffer light fixture 209. The adaptor brackets may be self-supporting such as those described with reference to FIGS. 7A-8. In new construction applications, the troffer light fixture (e.g., troffer retrofit system 100) may be used independently of any existing troffer light fixture 209 or components thereof (e.g., troffer housing 207). Door assembly 100 and adaptor brackets 103 (e.g., a self-supporting embodiment such as those discussed with reference to FIGS. 7A-8) are used with a ceiling system to install the light fixture. Adaptor brackets 103 may be placed on and/or otherwise secured to T-bars 201 of a ceiling system and may support themselves and/or door assembly 101. Door assembly 101 may be wired to a power supply, control system, sensors, and/or other components. In new construction applications, door assembly 101 and adaptor brackets 103 allow for the installation of a light fixture without requiring an existing troffer light fixture 209.

Self-supporting adaptor brackets 103 may be used in either retrofit applications or new construction applications. Advantageously, the combination of door assembly 101 and self-supporting adaptor brackets (e.g., those described with reference to FIGS. 7A-8) can be provided (e.g., sold) to allow for use in either retrofit applications or new construction applications. The purchaser or other recipient of troffer retrofit system 100 may use troffer retrofit system either for retrofitting an existing troffer light fixture 209 or for providing a troffer light fixture in new construction applications. The purchaser or other recipient of troffer retrofit system 100 need not purchase or otherwise acquire additional components in order to use troffer retrofit system 100 in retrofit and construction applications (e.g., the same troffer retrofit system 100 can be used in either application). Advantageously, this allows a seller of troffer retrofit system 100 to market and sell the same product for two uses. Additionally, this provides an advantage in that a purchaser of troffer retrofit system 100 can purchase a plurality of troffer retrofit systems 100 and use them for either retrofit applications or new construction applications as demand changes.

Referring now to FIG. 1, troffer door retrofit system 100 is shown according to one embodiment. Troffer door retrofit system 100 includes door assembly 101 and two adaptor brackets 103. Troffer door retrofit system 100 can be used to upgrade, retrofit, replace, and/or install a lighting fixture in an existing troffer housing. Adaptor brackets 103 may held into place in a ceiling system (e.g., a dropped ceiling) using a T-bar of the ceiling system and an existing troffer housing (e.g., the housing of an existing troffer light fixture which is being retrofit). Door assembly 101 can then be hung using hinges and/or latches from slots included in adaptor brackets 103 and wired to an existing wiring system (e.g., the wiring system which was supplying the existing troffer light fixture).

In alternative embodiments, troffer door retrofit system 100 includes only door assembly 101. Door assembly 101 can include hinges and/or latches which are positioned such that door assembly 101 can be hung from an existing troffer housing. For example, an existing troffer light fixture may include a door hung from slots included in the housing of the existing troffer light fixture. The door may be removed, and door assembly 101 of troffer door retrofit assembly 101 may be hung from the slots in the housing of the existing troffer light fixture. Internal components (e.g., lamps and ballast) of the existing troffer light fixture may be removed first to make room for door assembly 101 when in the closed position.

In further embodiments, troffer door retrofit system includes door assembly 101 and adaptor brackets 103, but adaptor brackets 103 may be optionally used when retrofitting an existing troffer light fixture. For example, the hinges and latches of door assembly 101 may be positioned such that door assembly 101 is compatible with a wide range of and/or a common existing troffer light fixture and its housing. The door of the existing troffer light fixture may be removed and replaced with door assembly 101 (e.g., without the use of adaptor brackets 103). If door assembly 101 is not compatible with an existing troffer housing (e.g., the hinges and or latches do not align with slots in the existing troffer housing), adaptor brackets 103 may be used. This adaptability may advantageously increase the number of existing troffer light fixture types (e.g., different configurations and/or different manufacturers) with which troffer door retrofit system 100 is compatible. Thus, troffer door retrofit system 100 may be packaged or sold with both door assembly 101 and adaptor brackets 103 to increase the number of existing troffer light fixtures which can be retrofit as described herein. In alternative embodiments, door assembly 101 and/or adaptor brackets 103 may be packaged or sold individually. In some further embodiments, door assembly 101 includes hinges and/or latches which may be repositioned on door assembly 101. For example, the hinges and/or latches may be secured in a slot which allows longitudinal movement, and the hinges and/or latches may be secured in the desirable position by engaging a fastener (e.g., tightening a nut and bolt combination). Advantageously, this may increase the number of existing troffer light fixtures with which troffer door retrofit system 100 is compatible (e.g., door assembly 101 may be compatible with a larger range of slot configurations in existing troffer housings).

Still referring to FIG. 1, door assembly 101 can include one or more lamps which may be more efficient than the lamps in an existing troffer light fixture. For example, door assembly 101 may include light emitting diodes (LEDs) which are more efficient than the lamps of the existing troffer light fixture. The existing troffer light fixture may include lamps of other types such as florescent lamps, incandescent lamps, halogen lamps, and/or less efficient LEDs. Advantageously, troffer door retrofit system 100 may be used to replace the existing troffer light fixture (e.g., in part while retaining the existing housing, wiring, and/or other components) and its less efficient lamps with the more efficient lamps included in door assembly 101. Door assembly 101 may be wired to existing supplies, ballasts, and/or other power systems or electronics (e.g., controllers, automation systems, sensors, etc.) of the existing troffer light fixture. Thus, an existing troffer light fixture may be retrofit using troffer door retrofit system 100 such that the resulting troffer light fixture is more efficient, uses less electricity, gives of less heat, and/or includes other benefits. This may reduce the operating costs of a lighting system including one or more troffer light fixtures (e.g., a lighting system in an office building, warehouse, or home, an outdoor lighting system, and/or any lighting system including troffer light fixtures). While LED is specifically used in many of the examples described, other types of lamps or light sources (e.g., fluorescent lamps, halogen lamps, incandescent lamps, organic LEDs, incandescent lamps, discharge lamps, liquid crystal displays, plasma displays, and/or other light sources) may be used in varying embodiments.

Troffer door retrofit system 100 and door assembly 101 may include the same style lamps as an existing troffer light fixture or otherwise be approximately equivalent in parameters such as efficiency, cost to operate, lifespan, operating costs including maintenance, and/or other parameters. However, troffer door assembly 101 may include ballast, a controller, sensors, communication equipment, and/or other electronic components which are superior to those of an existing troffer light fixture or not included in an existing troffer light fixture. Retrofitting an existing troffer light fixture using troffer door retrofit system 100 may therefore provide an upgrade in electronics associated with a lighting system, sensors associated with a lighting system, control of a lighting system, automation of a lighting system, and/or otherwise upgrade a lighting system other than increasing the efficiency of the system by replacing the type of lamp used.

As an additional example, troffer door retrofit system 100 may provide a further advantage by allowing for easy replacement or repair of existing troffer light fixtures. For example, an existing troffer light fixture may break or otherwise need maintenance or repair (e.g., one or more lamps have burnt out or need replacing, ballast has been damaged or stops functioning properly, and/or other components require maintenance or repair). Troffer door retrofit system 100 may be used to replace components rather than repair them. Advantageously, this may be more cost effective than repairing the component (e.g., including or not including the long term energy savings of switching to a more efficient lamp) and may be more cost effective than replacing the entire existing troffer light fixture with one of the same type (e.g., troffer door retrofit system 100 may be comparable on cost and it may be quicker to install troffer door retrofit system 100 thereby reducing labor costs). In alternative embodiments, components of an existing troffer light fixture are not replaced, but rather troffer door retrofit system 100 is installed without the removal of the components. This allows for functionality of a troffer light fixture to be restored (e.g., in the event of damaged components, burnt out lamps, etc.) without the need to remove damaged or otherwise inoperable components from the existing troffer light fixture. This may expedite the retrofitting of an existing troffer light fixture.

Figure 2A:
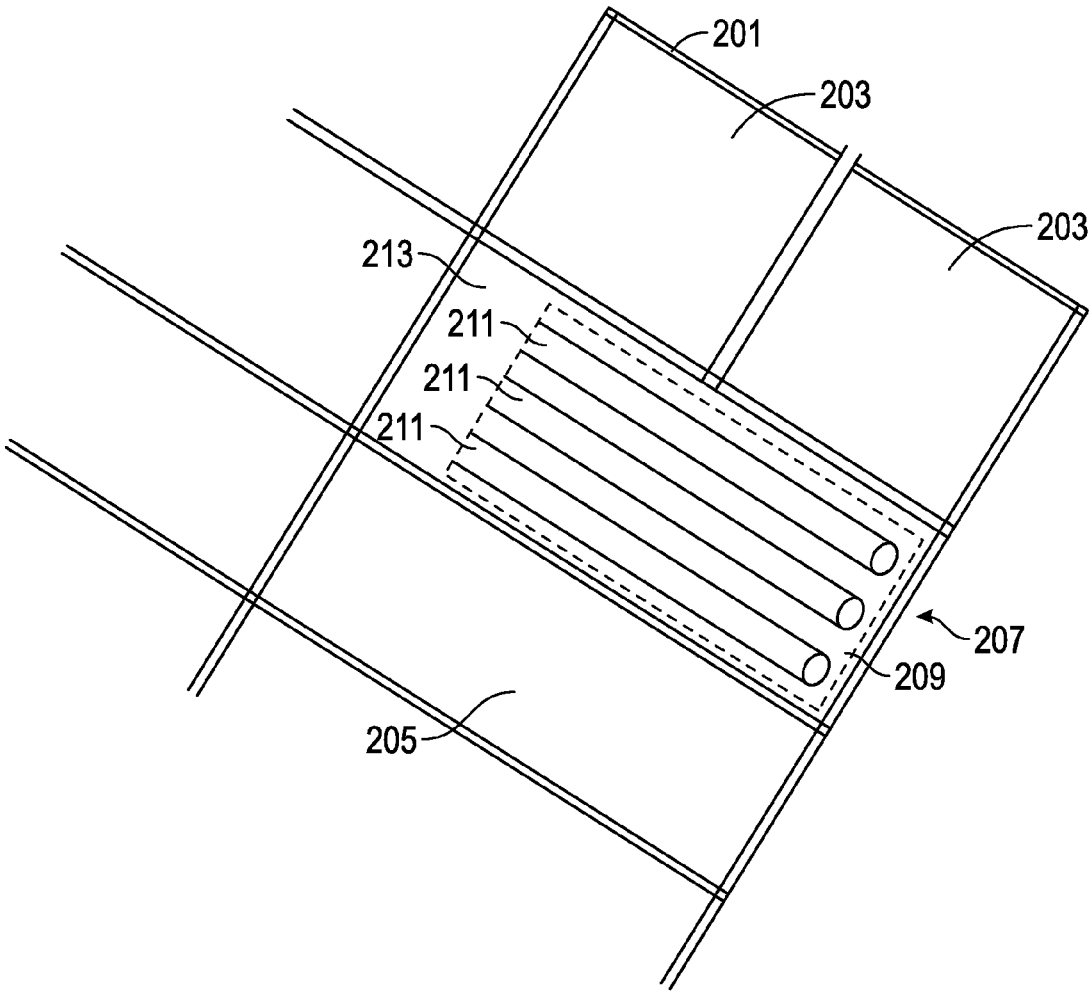
FIG. 2A is an illustration of an existing troffer light fixture in a dropped ceiling according to an exemplary embodiment.

Referring now to FIG. 2A an existing ceiling system and existing troffer light fixture are illustrated according to one embodiment. The ceiling system may be a dropped ceiling including one or more T-bars 201, 2×2 ceiling tiles 203, 2×4 ceiling tiles 205, and/or other components. The ceiling system may include one or more existing troffer light fixtures 207. As described herein, existing troffer light fixture 207 can be retrofit using troffer door retrofit system 100. Existing troffer light fixture 207 can include components such as lens 213, troffer housing 209, lamps 211, ballast, supply wires, and/or other components.

As described in greater detail with reference to FIG. 2B, troffer housing 209 can contain, secure, and/or support the other components of existing troffer light fixture 207. Troffer housing 209 can be secured by T-bar 201 of the ceiling system. For example, troffer housing 209 may rest on T-bar 201. Troffer housing 209 may also be or include a reflector for directing light emitted from one or more lamps down from the ceiling system.

The ceiling system may include a plurality of T-bars 201 which form a ceiling grid. The ceiling grid typically has dimensions such that ceiling tiles 2' by 2' (e.g., 2×2 ceiling tile 203) and/or ceiling tiles 2' by 4' (2×4 ceiling tile 205) are supported by the T-bars 201. Existing troffer light fixture 207 is sized to be supported in one of a 2×2 grid location or 2×4 grid location. In further embodiments, the ceiling system may have other dimensions. The dimensions of other devices, systems, and components described herein may be adjusted to be compatible with the other dimensions.

Typically, troffer housing 209 of existing troffer light fixture 207 includes a plurality of slots which allow a panel or door to attach to troffer housing 209. The panel or door may open and close (e.g., using latches and hinges) to allow access to other components of existing troffer light fixture 207. For example, the panel or door may be opened to change one or more lamps 211 of existing troffer light fixture 207. The panel or door may be or include a lens 213 or louver. The panel or door may also be removable from troffer housing 209 (e.g., unlatched and the hinges removed from the slots included in troffer housing 209). As described herein, the panel or door of existing troffer light fixture 207 may be removed and door assembly 101 of troffer door retrofit system 100 may be installed using the slots included in the troffer housing 209 of the existing troffer light fixture 207. In some embodiments, existing troffer light fixture 207 may not include slots for a panel or door or may include slots which are not compatible with door assembly 101 of troffer door retrofit system 100. Adaptor brackets 103 may be used in conjunction with troffer housing 209 in such cases.

Existing troffer light fixture 207 may be sized to be compatible with differently sized ceiling systems. For example, troffer housing 209 may be sized the same or approximately the same as 2×2 ceiling tile 203 or 2×4 ceiling tile 205. Existing troffer light fixture 207 may therefore be secured by T-bar 201 of the ceiling system in any location sized for a corresponding ceiling tile. Advantageously, door assembly 101 and/or adaptor brackets 103 of troffer door retrofit system 100 may be sized either for a 2×2 ceiling system location, a 2×4 ceiling system location, or other sized systems.

With continued reference to FIG. 2A, in some cases, lamps 211 may be florescent lamps. Florescent lamps are commonly used in troffer light fixtures (e.g., existing troffer light fixture 207). For example, existing troffer light fixtures 207 often include florescent lamps when used in such applications as industrial lighting, office space lighting, and/or other commercial or residential use with engineered ceilings (e.g., dropped ceilings). Door assembly 101 of troffer door retrofit system 100 includes LEDs in some embodiments. In such embodiments, door assembly 101 as installed as part of troffer door retrofit system 100 has several advantages over existing troffer light fixture 207 having florescent lamps 211. For example, door assembly 101 may reduce energy consumption by up to 70% or more in comparison to existing troffer light fixtures 207 having florescent lamps. Door assembly 101 and the LEDs included therein can have a longer life than florescent lamps. Therefore, maintenance related to the replacement of lamps is reduced thereby reducing maintenance costs and freeing up maintenance man hours for other tasks. LEDs of door assembly 101 also generate less heat than florescent lights thereby reducing the load on heating ventilation and air conditioning systems and reducing costs. Additionally, LEDs included in door assembly 101 include fewer hazardous waste materials than florescent lamps. As such, the LEDs of door assembly 101 are easier to recycle at the end of their life cycle than florescent lamps. Continuing the examples, the LEDs in door assembly 101 can provide a volumetric, even distribution of light with higher quality color rendering. The color temperature of LEDs may also be easily customizable and/or changed (e.g., controlled with a controller or selected during manufacture). Therefore, the light produced by door assembly 101 including LEDs may be of superior quality in comparison to light produced by florescent lamps included in existing troffer light fixture 207.

Figure 2B:
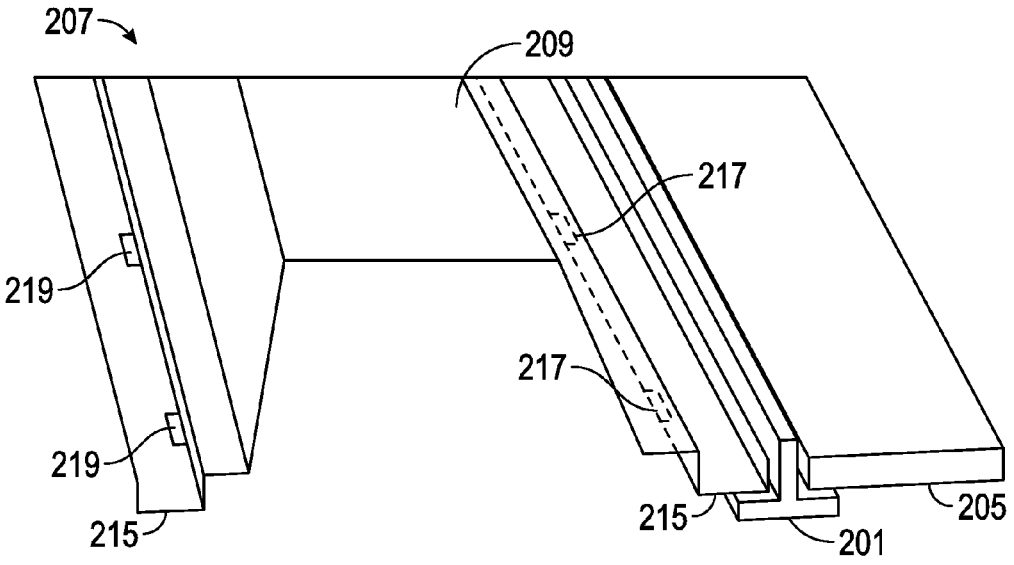
FIG. 2B is an illustration of an existing troffer housing of an existing troffer light fixture in dropped ceiling system according to an exemplary embodiment.

Referring now to FIG. 2B, a troffer housing 209 of existing troffer light fixture 207 is illustrated in relation to T-bar 201 of a ceiling system according to one embodiment. Troffer housing 209 rests on T-bar 201 of the ceiling. T-bar 201 includes a horizontal portion on which troffer housing 209 rests. Two or four sides of troffer housing 209 rest on T-bars 201; one T-bar 201 corresponding to each side of troffer housing 209. The horizontal portion of each T-bar 201 and the spacing of each T-bar 201 in the ceiling grid prevents troffer housing 209 from falling through the ceiling system. Troffer housing 209 may be prevented from shifting relative to the opening between T-bars 201 by the vertical portion of T-bar 201. This may prevent lateral movement of troffer housing 209. T-bars 201 are also configured to support ceiling tiles (e.g., 2×4 ceiling tile 205) using the same principles. T-bars 201 may be suspended or supported from a structural ceiling (e.g., as in a dropped ceiling).

Troffer housing 209 can be supported by T-bars 201 using flanges 215. Flanges 215 may have a variety of configurations. In one embodiment, flanges 215 include a first vertical portion extending downward from troffer housing 209, a horizontal portion which rests on T-bar 201, and an additional vertical portion (e.g., for preventing lateral movement of troffer housing 209 in conjunction with the vertical portion of T-bar 201). In further embodiments, flanges 215 may have other configurations. For example, flanges 215 may meet T-bar 201 at an angle (e.g., 45 degrees), flanges 215 may not include a second or additional vertical portion, etc.

As described later in more detail, adaptor brackets 103 of troffer door retrofit system 100 are configured to be held in place against T-bar 201 in some embodiments. Adaptor brackets 103 may be inserted between the horizontal portion of flange 215 and the horizontal portion of T-bar 201. Adaptor brackets 103 may be prevented from moving laterally by engaging a portion of flange 215 such as the additional vertical portion. As a result, a portion of adaptor bracket 103 may be located between the end of flange 215 (e.g., an end formed by the additional vertical portion) and the vertical portion of T-bar 201. Adaptor brackets 103 can be further configured to extend horizontally so as to avoid interference with the remainder portion of flange 215 and/or other portions of troffer housing 209.

In alternative embodiments, troffer housing 209 may be supported on T-bar 201 using the top of the vertical portion of T-bar 201 and a support mechanism attached to troffer housing 209. Troffer housing 209 may include a portion which extends at least to the horizontal portion of T-bar 201 and may overlap with T-bar 201. This may give the appearance that existing troffer light fixture 207 is flush or nearly flush with the ceiling system. In such embodiments, adaptor bracket 103 may be held in place using a combination of T-bar 201 and the above described portion of troffer housing 209 which extends near to or overlapping with the horizontal portion of T-bar 201.

From flange 215, troffer housing 209 may extend vertically and/or horizontally to a top portion. The top portion may continue until the flange and upward extension is mirrored to meet a second T-bar 201. For example and as illustrated in FIG. 2B, troffer housing 209 may have a generally trapezoidal profile with an internal space for the components of existing troffer light fixture 207 such as florescent lamps, lamp holders, and ballast. The side and/or top portions of troffer housing 209 may be or be coated with a reflective material. The reflective material may have been used to redirect light from lamps 211 downward from the ceiling and/or laterally from the fixture. In some embodiments, the light source included in door assembly 101 of troffer door retrofit system 100 is positioned so as to use the troffer housing 209 to reflect emitted light downward and/or laterally from the ceiling. In some embodiments, reflective paint and/or other materials can be applied to troffer housing 209 of existing troffer light fixture 207 prior to retrofitting with troffer door retrofit system 100. For example, a reflective paint can be applied to the internal surfaces of housing 209. As an additional example, a reflective material (e.g., a metallized film) can be secured to housing 209 (e.g., using adhesive).

The geometry of door assembly 101 of troffer door retrofit system 100 may be configured such that a portion of door assemble 101 is contained within troffer housing 209. For example, door assembly 101 may have the same or similar profile as compared to the panel or door of existing troffer light fixture 207 when the door assembly 101 is installed and viewed from below.

Troffer housing 209 may also include slots for use with a panel or door as previously described. Troffer housing can include one or more hinge slots 217. Hinge slots 217 are configured to accept a hinge portion (e.g., an extended flange) of the panel or door. For example, hinge slots 217 may include a first opening and a second smaller opening connected to the first opening. The hinge portion of the panel or door may be shaped so as to fit through the first opening, move down, and be prevented from exiting the hinge slot by the second smaller opening which is smaller than the hinge portion of panel or door. The panel or door can then be removed from troffer housing 209 by lifting the panel or door and removing the hinge portion from larger portion of hinge slot 217 (e.g., the first opening). Hinge slot 217 can be located on flange 215.

In some embodiments, two hinge slots 217 are included in troffer housing 209. Door assembly 101 of troffer door retrofit system 100 can include two hinges (e.g., extended flanges) such that door assembly 101 can be hung from hinge slots 217. In other embodiments, troffer housing 209 may include a different number of hinge slots 217. For example, one or three hinge slots 217 may be included. Continuing the example, troffer housing 209 may include no hinge slots 217. In such cases, door assembly 101 may include a corresponding number of hinges, or adaptor brackets 103 may be used to hang door assembly 101.

Troffer housing 209 can also include one or more latch slots 219. Latch slot 219 may be an opening in troffer housing 209 (e.g., an opening in flange 215). Latch slot 219 allows a hook portion of a latch on the panel or door to extend through troffer housing 209 and hook onto or otherwise interface with a portion of troffer housing 209. For example, a hook portion of a latch may extend through latch slot 219 from below and rotate vertically to rest on or engage a horizontal portion of troffer housing 209 (e.g., flanges 215).

In some embodiments, two latch slots 219 are included in troffer housing 209. Door assembly 101 of troffer door retrofit system 100 can include two latches (e.g., rotatable latches with a grip and hook portion) such that door assembly 101 can be latched to hinge slots 217. In other embodiments, troffer housing 209 may include a different number of latch slots 219. For example, one or three latch slots 219 may be included. Continuing the example, troffer housing 209 may include no latch slots 219. In such cases, door assembly 101 may include a corresponding number of latches, or adaptor brackets 103 may be used to hang door assembly 101.

Figure 3A:
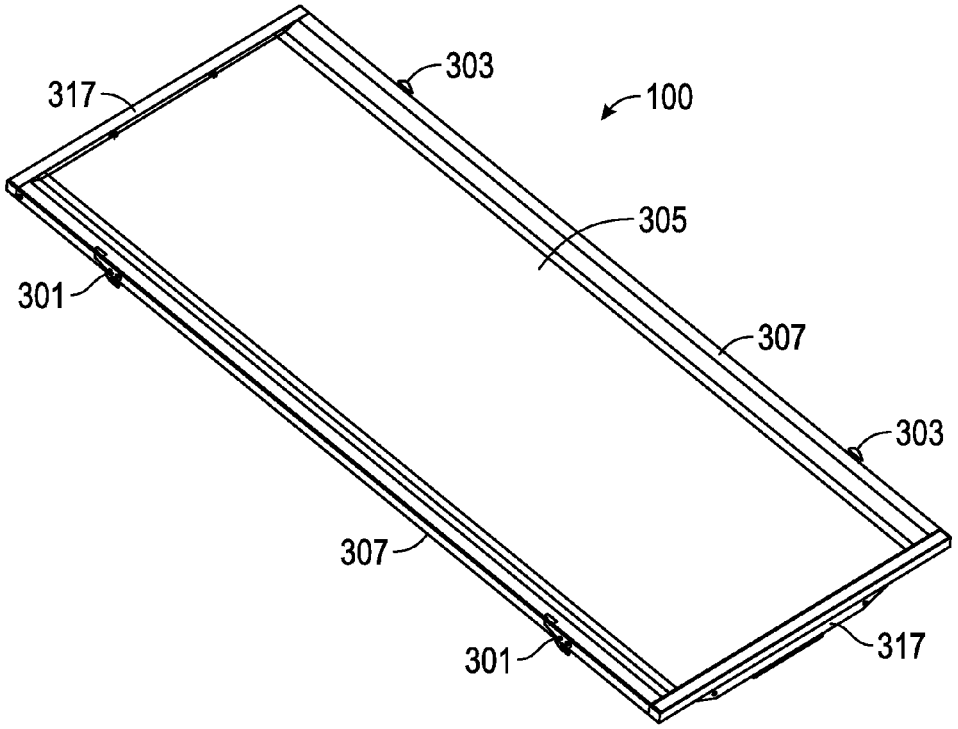
FIG. 3A is an illustration of a troffer door assembly according to an exemplary embodiment.
Figure 3B:
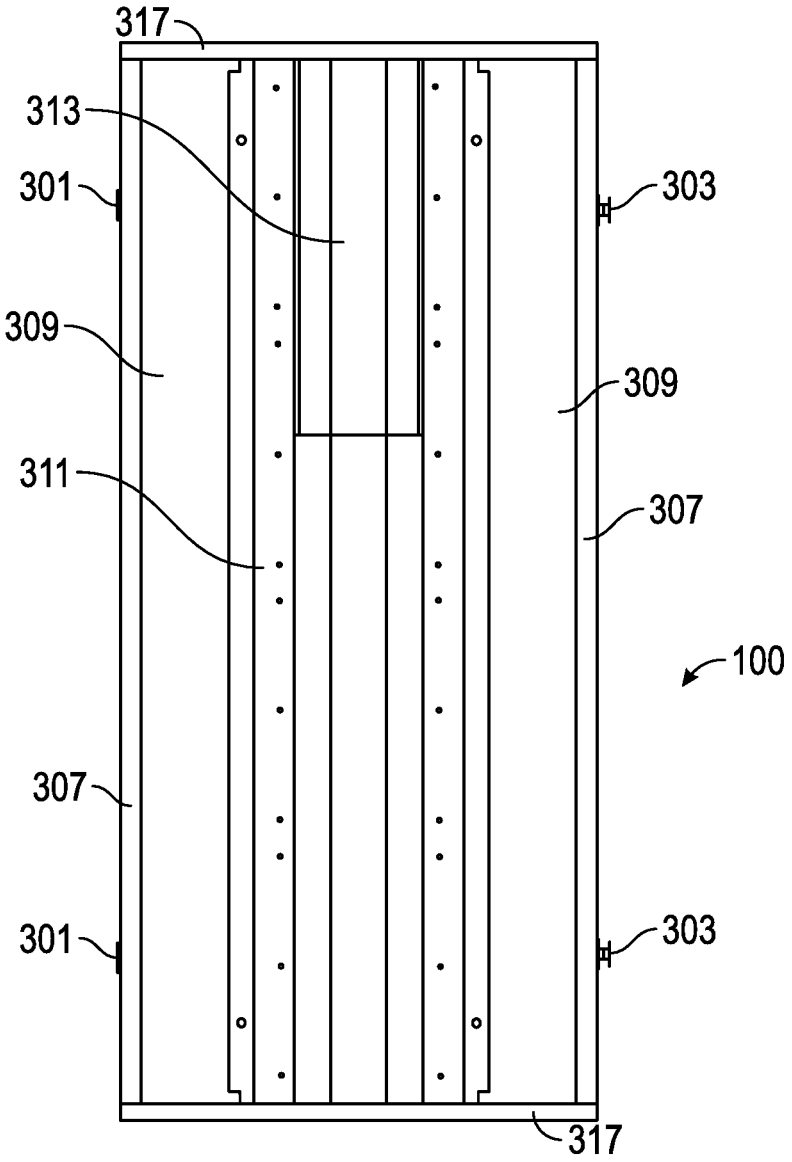
FIG. 3B is an illustration of a top view of a troffer door assembly according to an exemplary embodiment.
Figure 3C:
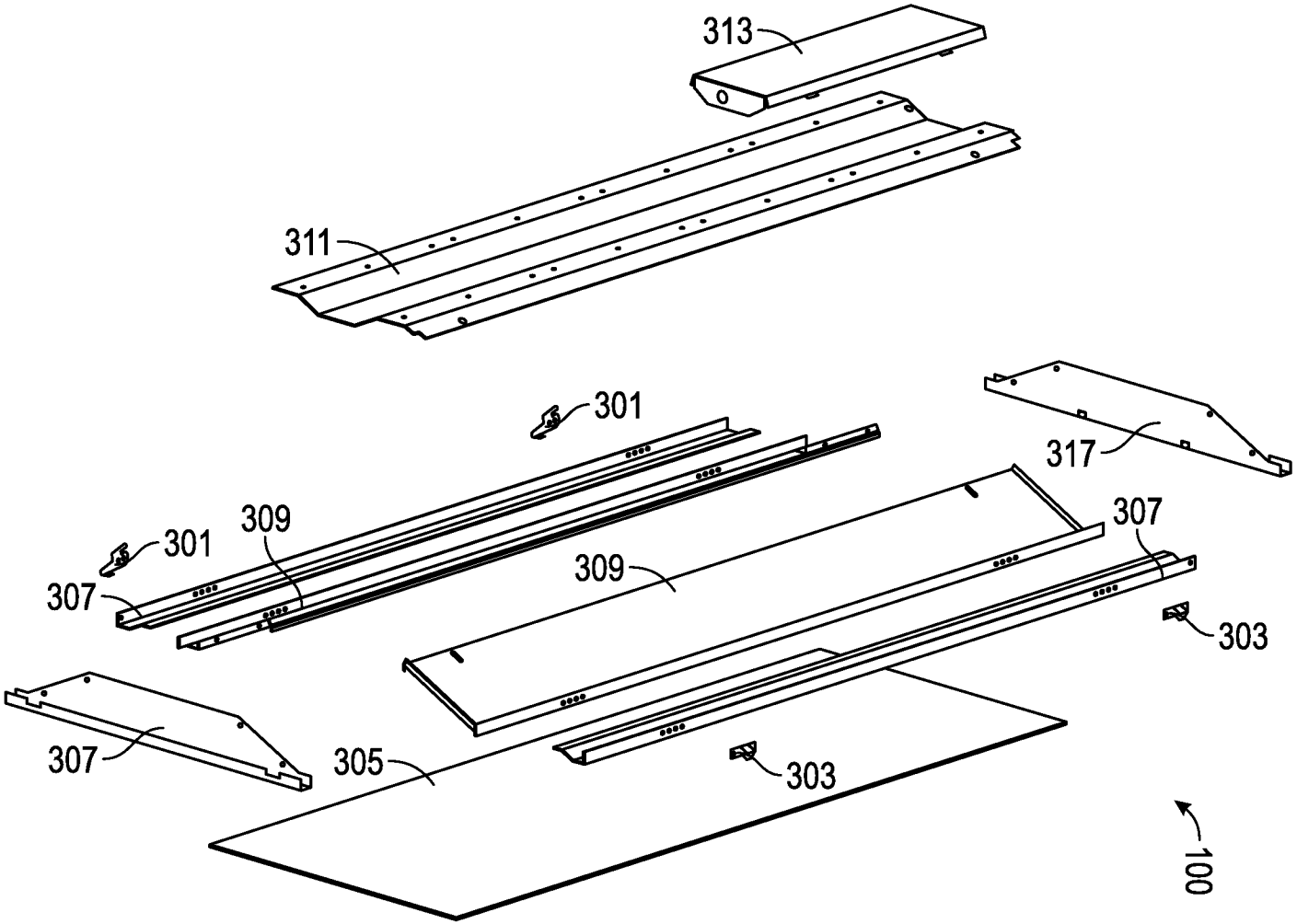
FIG. 3C is an exploded view illustration of a troffer door assembly according to an exemplary embodiment.

Referring now to FIGS. 3A-3C, door assembly 101 is illustrated according to one embodiment. As previously described, door assembly 101 of troffer door retrofit system 100 is hung using troffer housing 209 and/or adaptor brackets 103. The lamps within door assembly 101 can be wired to the supply for an existing troffer light fixture 207. One or more components of existing troffer light fixture 207 can be removed, and door assembly 101 can be closed and latched. As a result, existing troffer light fixture 207 is retrofitted (e.g., to include LED lamps rather than existing florescent lamps).

Referring now to FIG. 3A, door assembly 101 includes a housing which may include a plurality of components such as lower side frames 307, frame ends 317, hinges 303, latches 301, and a lens 305. Multiple components may be attached together such that door assembly 101 does not require assembly when purchased by a consumer. In other words, door assembly 101 may be manufactured using a plurality of components which are permanently or semi-permanently assembled to create door assembly 101.

The frame components may be assembled or joined such that the frame provides structural support to door assembly 101. The frame may further provide one or more mounting points or surfaces for additional components of door assembly 101. Lower side frame 307 can be joined or attached to frame ends 317. This may form a square or rectangular frame on which other components are attached or joined. Latches 301 are attached or joined to lower side frame 307. Hinges 303 are attached or joined to the opposite lower side frame 307.

In some embodiments, door assembly 101 includes lens 305. Lens 305 can be transparent or translucent such that light emitted from a light source in door assembly 101 exits lens 305 to an area below door assembly 101. Lens 305 may enhance the performance of the retrofitted troffer light fixture. For example, lens 305 may be used to diffuse light, focus light, form one or more beams, filter light, and/or otherwise alter or manipulate light emitted from a light source included in door assembly 101. Alternatively, lens 305 may not substantially alter the light exiting lens 305. In further embodiments, lens 305 protects one or more components within door assembly 101. For example, lens 305 may limit access to LEDs included in door assembly 101.

Lens 305 can be supported by and/or attached to lower side frames 307 of door assembly 101. In some embodiments, lens 305 is removable from door assembly 101. This may allow access to one or more other components of door assembly 101. For example, removing lens 305 may provide access to lamps, supply wiring, electronics, controllers, and/or other components. This allows for replacement or repair of components (e.g., replacing lamps). In some embodiments, lens 305 may rest on a portion of lower side frames 307 and/or frame ends 317. Lens 305 may be made of a deformable material (e.g., is plastically deformable) such that lens 305 may be deformed and removed from the frame of door assembly 101. Lower side frames 307 and/or frame ends 317 may include a track or channel which lens 305 is inserted into. This may secure lens 305. In alternative embodiments, lens 305 may be mounded on one or more hinges and/or include one or more latches or other features which non-permanently secure lens 305 in the frame of door assembly 101. This may allow lens 305 to be opened and provide access to internal components of door assembly 101.

Lens 305 may be made of a transparent or translucent material. In some embodiments, lens 305 is made of glass or another ceramic material. In other embodiments, lens 305 is made of acrylic or polycarbonate. Alternatively, lens 305 may be made of other polymers or plastics. In alternative embodiments, lens 305 may be a louver. In further alternative embodiments, door assembly 101 does not include a lens 305.

Referring now to FIG. 3B, a top view of door assembly 101 is illustrated according to one embodiment. Door assembly 101 may include additional components such as upper side frame 309, top portion 311, and cover 313. Upper side frames 309 may form the top of the housing of door assembly 101. As illustrated in FIG. 3C, door assembly 101 may have a trapezoidal shape. Frame ends 317 form the trapezoidal ends of door assembly 101, lower side frames 307 and lens 305 form the bottom, and upper side frames 309 form the angled top portion. Referring again to FIG. 3B, upper side frames 309 are attached or joined to lower side frames 307. Upper side frames 309 may also be attached to or joined to frame ends 317. Upper frame ends 309 are further attached to top portion 311. Top portion 311 forms the top of the trapezoidal housing of door assembly 101. Located on top of top portion 311 is cover 313. Cover 313 can cover electronic components (e.g., controllers, ballast, connections to supply wires, and/or other electronics) mounted on top portion 311 or otherwise contained within the space formed by cover 313 and top portion 311.

In some embodiments, upper side frame 309 and/or top portion 311 are configured to reflect light from within door assembly 101 out through lens 305. For example, one or more of upper side frame 309 and/or top portion 311 may be coated with a reflective material on side facing lens 305. Alternatively, one or more of upper side frame 309 and/or top portion 311 may be constructed of a reflective material (e.g., a metal). The internal surfaces of door assembly 101 can be or include a reflective material. The reflective material may be used to redirect light from a light source downward from the ceiling and/or laterally from the fixture. In some embodiments, the light source included in door assembly 101 of troffer door retrofit system 100 is positioned so as to reflect emitted light downward and/or laterally from the ceiling. In some embodiments, reflective paint and/or other materials can be applied to troffer door retrofit system 100. For example, a reflective paint can be applied to the internal surfaces. As an additional example, a reflective material (e.g., a metallized film) can be secured to internal surfaces (e.g., using adhesive). In still further embodiments, door assembly 101 uses troffer housing 209 of existing troffer light fixture 207 as a reflector. For example, door assembly 101 may not include upper side frames 309, may not include upper portion 311, or side frame 309 and/or top portion 311 may include an opening to troffer housing 209 of existing troffer light fixture 207.

Referring now to FIGS. 3A-3C, door assembly 101 also includes a light source (not illustrated). The light source may be any device or component configured to produce light, typically visible light, using electricity. In one embodiment, the light source is one or more LEDs. For example, the LEDs may be individual LEDs, LED ribbons including a plurality of LEDs, an LED string containing a plurality of LEDs, or another device or package including LEDs. The LEDs may be mounted anywhere in or on the housing of door assembly 101 such that light exits the housing through lens 305 or the area where lens 305 would normally be. For example, LEDs (e.g., two strips of LEDs) may be attached to the surface of top portion 311 facing lens 305. Electronics used to control or otherwise support the functions of the LEDs may be located in cover 313. A wiring harness, supply wires, and/or other electrical connections may be coupled to the LEDs to provide electrical power. The wiring harness, supply wires, and/or other electrical connections may exit cover 313. This may allow for easy retrofitting of an existing troffer light fixture 207 as the wiring harness or supply wires may be quickly connected to or wired to supply wires for the existing troffer light fixture 207. For example, the lens of the existing troffer light fixture 207 may be removed, and door assembly 101 hung from either troffer housing 209 or adaptor brackets 103. The lamps and ballast cover of the existing troffer light fixture 207 may be removed and the supply wires to the ballast disconnected. The wiring harness or supply wires of the door assembly may then be connected to the existing supply wires which were previously connected to the ballast of the existing troffer light fixture 207.

In alternative embodiments, the LEDs may be located elsewhere in or on the housing of door assembly 101. For example, the LEDs may be mounted on the side of top portion 311 facing troffer housing 209. The LEDs may extend through one or more openings in top portion 311 and into the interior of the housing of door assembly 101. As an additional example, the LEDs may be mounted on one or more of upper side frame 309. Alternatively, the LEDs may be mounted on a brace member (not illustrated) located within the housing of door assembly 101 and above lens 305. LEDs may be positioned to emit light towards lens 305 and/or towards top portion 311 and/or upper frame side 309 (e.g., these components may act as reflectors as previously described).

In other embodiments, the light source may be a lamp such as a florescent lamp or incandescent lamp. The light source may be attached to one or more components of door assembly 101 such that light is emitted within the housing and exits through lens 305. For example, the light source may be attached to the inside of top portion 311. The light source may be attached with hardware such as lamp holders. Ballast, controllers, and/or other electronics for use with the light source may be located between cover 313 and top portion 311.

Still referring to FIGS. 3A-3C, components may be attached to one another or joined together as described above. In various embodiments, various techniques may be used to assemble the components described herein. For example, screws, rivets, nuts and bolts, and/or other fasteners may be used to attach components to each other. Continuing the example, glues, drying adhesives, pressure-sensitive adhesives, contact adhesives, hot adhesives, reactive adhesives, adhesive tape, and/or other adhesives may be used to attach one component to another or otherwise join components. Components may also be attached or joined using welding or similar techniques (e.g., TIG welding, MIG welding, spot welding such as resistive spot welding, ultrasonic welding, and/or other techniques).

In some embodiments, door assembly 101 may include a single housing which is produced as one piece of material. For example, a housing (e.g., including lower side frame 307, upper side frame 309, frame ends 317, top portion 311, and/or other components) may be a single component made by stamping, machining, printing, extruding, casting, injection molding, and/or other manufacturing techniques.

Referring now to FIG. 3C, an exploded view of door assembly 101 is shown according to one embodiment. As illustrated, components of door assembly 101 may include mounting points (e.g., indentations, holes, etc.) for attaching or joining two or more components. For example, lower side frame 307 and upper side frame 309 may both include mounting points at corresponding locations on flanges for attaching lower side frame 307 to upper side frame 309. Fasteners may be used to attach or join the two components. Similarly, attachment points on lower side frame 307 and/or upper side frame 309 may be used in conjunction with fasteners to attach hinges 303 and/or latches 301.

Lower side frames 307 and/or frame ends 317 may include channels. The channels may give the appearance that door assembly 101 is flush with T-bar 201 when installed. Lower side frames 307 may also include a flange or other horizontal surface for receiving and/or supporting lens 305. Flanges may be included in other components and used for a variety of purposes. For example, flanges may provide additional strength to components (e.g., acting as a U beam). As an additional example, flanges may provide a surface on which to apply adhesives, spot weld two components, or otherwise facilitate the joining of two components or the attachment of one component to another.

Figure 3D:
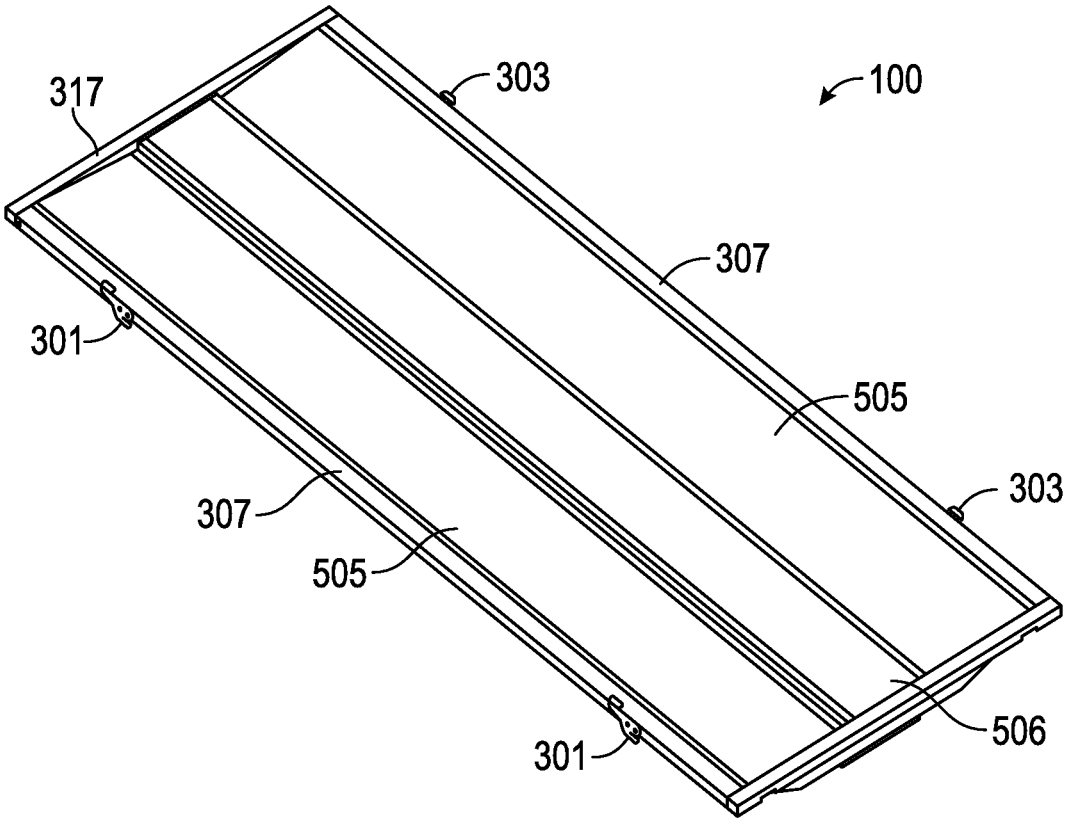
FIG. 3D is an illustration of a troffer door assembly having a three panel lens according to an exemplary embodiment.

Referring now to FIG. 3D, door assembly 101 can include a plurality of lenses. Two lenses 505 may be located on the sides on center lens 506. The three lens setup may provide several advantages. For example, the use of lenses 505 and center lens 506 may improve the aesthetic appearance of door assembly 101. Lenses 505 and center lens 506 may allow for a more complex beam pattern for the light emitted by door assembly 101. For example, lenses 505 may be used to direct light towards the sides of door assembly 101 and center lens 506 may be used to direct light below door assembly 101. Each lens (e.g., lenses 505 and center lens 506) may have different properties in some embodiments. For example, center lens 506 may be configured to produce a narrow beam while lenses 505 are configured to produce wide beams. Continuing the example, the three lenses may be configured to produce light of varying color temperatures or intensities.

In further embodiments, lens 506 may be a faux lens. For example, lens 506 may be opaque or less transparent than lenses 505. Lens 506 may provide a mounting surface for the light source within door assembly 101. Advantageously, this may allow the light source to be directed upward. Light emitted from the light source may be reflected from upper side frames 309 down through lenses 505 and center lens 506 if not completely opaque. The configuration of door assembly 101 described herein can provide a volumetric, even-distribution of light.

In alternative embodiments, lenses 505 and center lens 506 may be oriented other than with the long axes parallel with the long axis of door assembly 101. For example, lenses 505 and center lens 506 may be perpendicular to the long axis of door assembly 101.

Referring generally to FIGS. 3A-3C, troffer door assembly 101 includes components or is otherwise constructed for use in washdown rated applications in some embodiments. Troffer door assembly 101 and/or troffer door retrofit system 100 can be used in applications which require a washdown rating. For example, troffer door assembly 101 and/or troffer door retrofit system 100 can be used in applications such as lighting in food services environments, lighting in healthcare environments, lighting in industrial environments, and/or other applications for which easy cleaning of a light fixture is desirable.

In some embodiment, troffer door assembly 101 is constructed of a plurality of components which are then sealed using a sealant. Referring now to FIG. 3C, troffer door assembly 101 can be constructed of multiple components such as frame ends 317, lower side frames 307, upper side frames 309, lens 305, top portion 311, cover 313, and/or other components. Components can be fastened using one or more fasteners (e.g., screws, rivets, nuts and bolts, etc.) as previously described. Once fastened or joined, components can be sealed with the application of a sealant. The sealant can be applied to the seams or joints between components. For example, sealant can be applied along the edge formed by lower side frame 307 and upper side frame 309. Sealants can include organic elastomers, resins, polymers, inorganic elastomers, and/or other types of sealants. For example, the sealant may be silicone, rubber, epoxy, urethane, acrylic, and/or another sealant.

In further embodiments, the sealant can be applied to one or more components (e.g., on a flange used to join components) prior to the components being fastened or joined together. For example, a bead of sealant can be applied to lower side frame 307 and/or upper side frame 309 at the location where the two components will come into contact once joined. The components can then be joined using one or more fasteners and/or the sealant itself (e.g., the sealant can be an adhesive).

In some embodiments, troffer door assembly 101 includes one or more gaskets. Gaskets can be included in between components of troffer door assembly 101. For example, a gasket may be included between the flange of lower side frame 307 and the flange of upper side frame 309 where the two flanges would otherwise contact each other. In some embodiments, gaskets are held in place and/or attached to one or more component using an adhesive prior to assembly of troffer door assembly 101. In alternative embodiments, gaskets are held in place between components with fasteners. For example, a gasket may have one or more holes through which fasteners (e.g., screws, bolts, rivets, etc.) pass while connecting two or more other components. The gasket is held in place between two components which are fastened together (e.g., the gasket is "sandwiched" between two flanges).

Advantageously, the use of a sealant and/or gaskets can provide a water resistant or water proof troffer door housing 101. This allows troffer door housing 101 to be easily cleaned using a water jet, sprayed water, sprayed chemical cleaner, and/or other cleaning technique without damaging the electrical components and/or light source of troffer door assembly 101.

In still further embodiments, troffer door assembly 101 is constructed of a single component or relatively few number of components. For example, lens 305, lower side frames 307, upper side frames 309, and frame ends 317 can be manufactured as a single piece. Constructions techniques may include injection molding, deep drawing, welding, and/or other techniques. Advantageously, a single piece with high sides facing the working environment (e.g., facing the room to be lit) can allow for easy cleaning of troffer door assembly 101. Water, chemicals, and/or other cleaning agents which penetrate the ceiling can be substantially prevented from entering troffer door assembly 101 by the high sides of the single piece construction. In some embodiments, troffer door assembly includes a second or more components which join to a large single piece. For example, top portion 311 can be joined to a single piece including lens 305, lower side frames 307, upper side frames 309, and frame ends 317. Multiple techniques described herein can be used concurrently. For example, top portion 311 can be joined to a single piece including lens 305, lower side frames 307, upper side frames 309, and frame ends 317 using a gasket, sealant, and/or fasteners.

Advantageously, the use of one or more techniques described herein can be used to create a water resistant and/or water proof troffer door assembly 101. In addition to wash-down environments, troffer door assembly 101 can be used in further applications in which a sealed or nearly sealed light fixture is desired. For example, troffer door assembly 101 can be used in clean room environments and/or healthcare environments. The sealed or semi-sealed nature of troffer door assembly 101, in some embodiments, advantageously prevents dirt and/or debris from entering the light fixture. Additionally, troffer door assembly 101 is easy to clean. In additional embodiments, troffer door assembly 101 can include other features which provide an advantage in applications were cleanliness is desired. For example, troffer door assembly 101 can include germ resistant surfaces. In some embodiments, the surfaces of troffer door assembly 101 have minimized surface roughness to make cleaning easier. In still further embodiments, troffer door assembly 101 includes components and/or surfaces impregnated with anti-germ agents such as antibacterial substances.

Referring generally to FIGS. 3A-3C, the components of door assembly 101 described herein may be made of a variety of materials and using a variety of manufacturing techniques. In some embodiments, one or more components are made of a metal or a plurality of metals. For example, components may be made of aluminum, steel, tin, and/or other metals or alloys. In some embodiments, one or more components are made of plastics or polymers. For example, components may be made of or include acrylic, polycarbonate, polyvinyl chloride, or other polymers. In further embodiments, one or more components may be made of ceramic materials.

Alternative embodiments of door assembly 101 are possible. In some embodiments, troffer door assembly 101 includes a variety of sizes. For example, troffer door assembly 101 may be sized to fit 2×2, 2×4, 1×4, or other size ceiling grid openings. In further embodiments, components of troffer door assembly 101 vary. For example, lens 305 can be a flat lens, contour lens, or combination lens (e.g., segmented lens). The height, geometry (e.g., trapezoidal, rectangular, etc.), and/or configuration of troffer door assembly 101 may also vary. For example, cover 313 may be located on a side rather than the top of troffer door assembly 101.

Figure 4A:
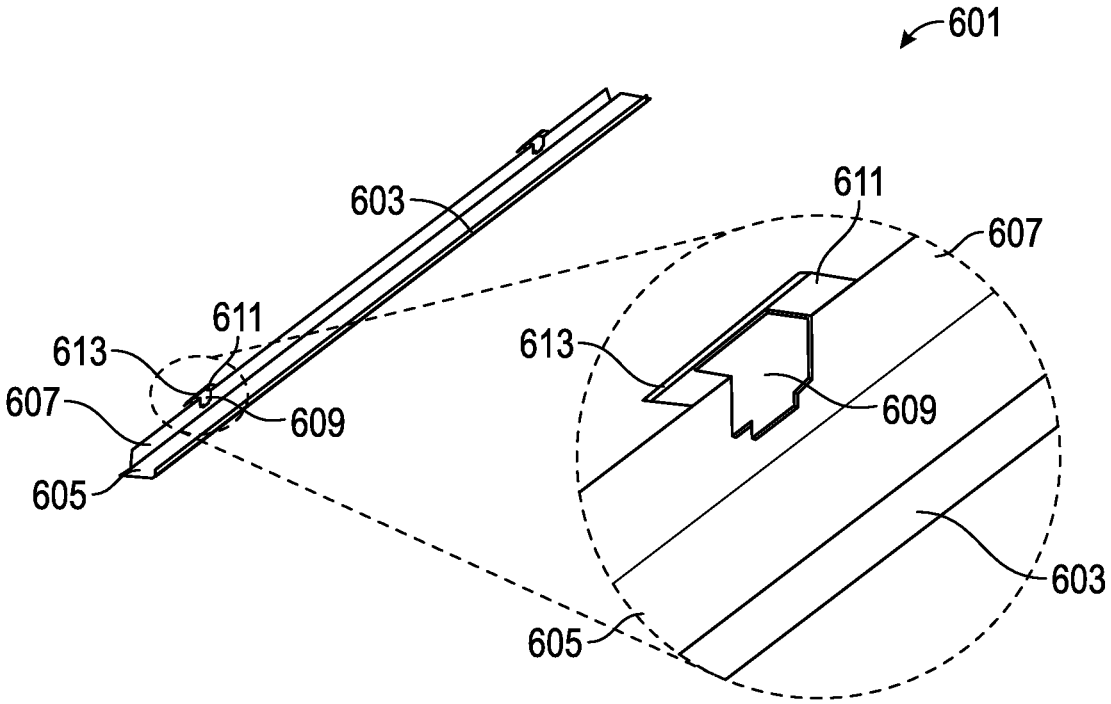
FIG. 4A is an illustration of an adaptor bracket according to an exemplary embodiment.
Figure 4B:
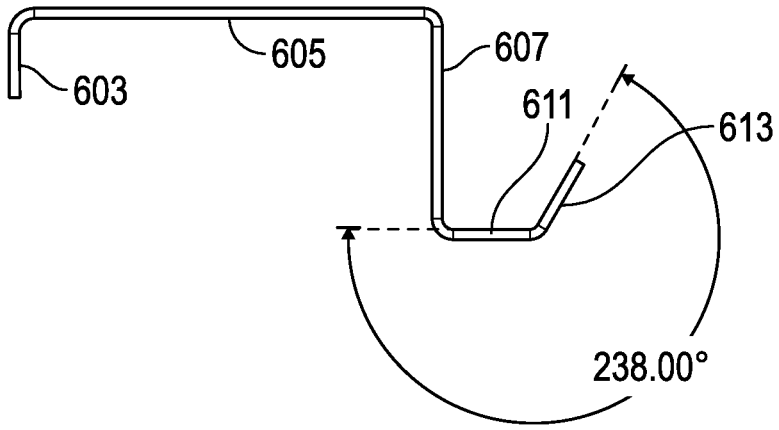
FIG. 4B is an illustration of profile of an adaptor bracket according to an exemplary embodiment.
Figure 4C:
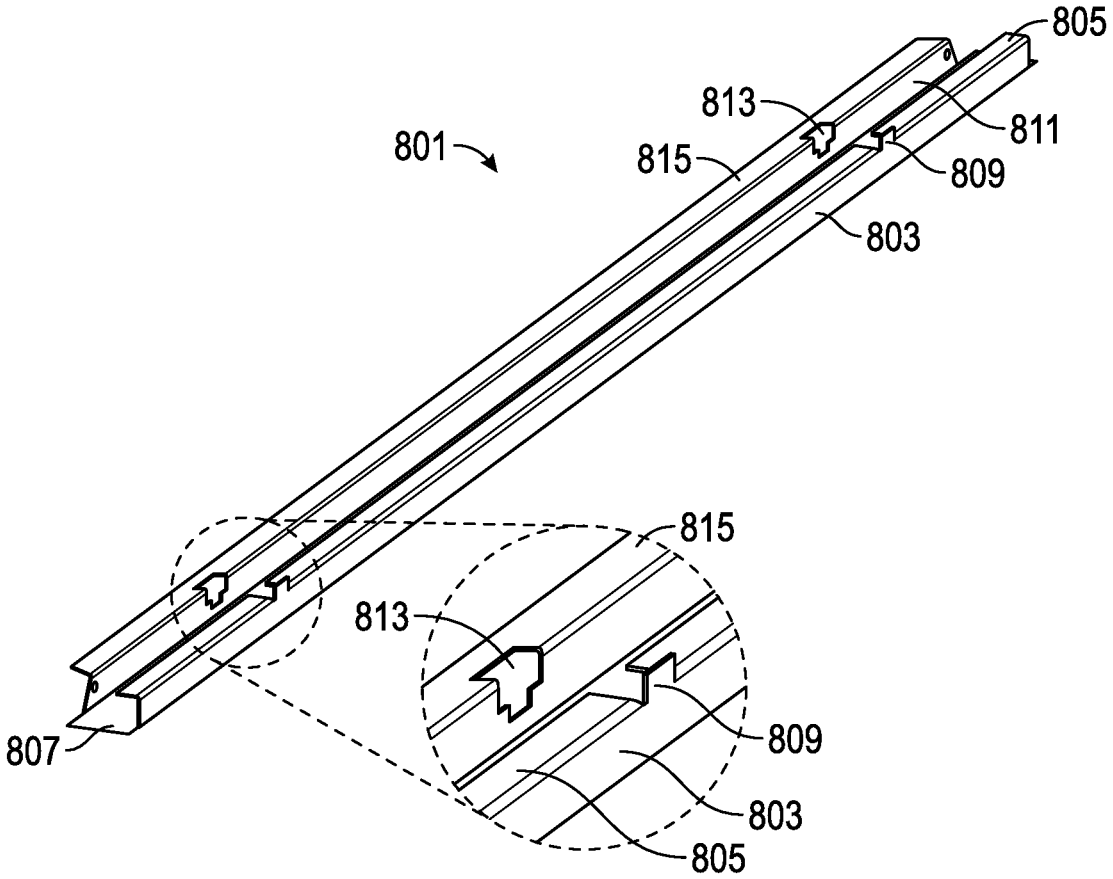
FIG. 4C is an illustration of an alternative adaptor bracket according to an exemplary embodiment.

Referring now to FIGS. 4A-4C, adaptor bracket 601, one embodiment of adaptor bracket 103 previously described herein, is illustrated according to an exemplary embodiment. As previously described herein, adaptor bracket 103, and the embodiment of adaptor bracket 601 illustrated herein, is configured for use in retrofitting an existing troffer light fixture 207. Adaptor bracket 601 can be placed between a troffer housing 209 of an existing troffer light fixture 207 and a T-bar 201 of a ceiling system. Troffer housing 209 keeps adaptor bracket 601 in place in some embodiments (e.g., the weight of troffer housing 209). Adaptor bracket 601 includes a plurality of slots 609 which accept both a hinge 303 and latch 301 depending on which is inserted into slot 601. Door assembly 101 is hung from the slots 609 on one adaptor bracket 601 using hinges 303 and is latched in a closed position by securing latches 301 through slots 609 on a second adaptor bracket. The second adaptor bracket 601 is located on the opposite side of troffer housing 209 from the first adaptor bracket 601.

Advantageously, the use of two adaptor brackets 601 allows door assembly 101 to be hung under troffer housings 209 of existing troffer light fixtures 207 which do not include slots aligning with or compatible with both the hinges 303 and latches 301 of door assembly 101. This increases the number of existing troffer light fixtures 207 which can be retrofit. Additionally, adaptor brackets 601 are configured, in some embodiments, such that slots 609 can accept either a latch 301 or hinge 303 of door assembly 101. The slots 609 on adaptor brackets 601 may also be spaced such that each slot 609 (of two slots 609) is an equal distance from the end of adaptor bracket 601 closest to that slot 609. Advantageously, these characteristics allow two adaptor brackets 601 to be installed without regard for which side of troffer housing 209 they are installed on. Door assembly 101 can be hung on either bracket, and door assembly 101 will be able to latch closed using the other adaptor bracket 601. This may provide a benefit or advantage by simplifying the instillation process. An installer does not need to keep track of two different adaptor brackets. Additionally, this may provide an advantage in that a plurality of existing troffer light fixtures 207 can be retrofit with door assemblies 101 such that all door assemblies 101 open in the same direction. This may simplify any maintenance which is required. Furthermore, this configuration of the adaptor brackets 601 may provide a benefit or advantage by simplifying the manufacturing process. For example, a single type of die or mold may be used.

Referring now to FIG. 4A, adaptor bracket 601 is illustrated along with a more detailed view of slot 609 and the surrounding portions according to one embodiment. Adaptor bracket 601 may be generally U shaped with a channel 605, lip 603, and side 607. Channel 605 is configured (e.g., sized) to accept a portion of troffer housing 209 of an existing troffer light fixture 607. For example, the end of troffer housing 209 or a flange of troffer housing 209 can rest on or in channel 605. The weight of troffer housing 209 may secure adaptor bracket 601 against a T-bar 201 of the ceiling system.

In some embodiments, adaptor bracket 601 includes lip 603. Lip 603 can engage with an end or flange of troffer housing 209. Lip 603 can prevent adaptor bracket 601 from sliding horizontally and away from T-bar 201. Troffer housing 209 may push against lip 603 in the direction of T-bar 201.

Figure 6A:
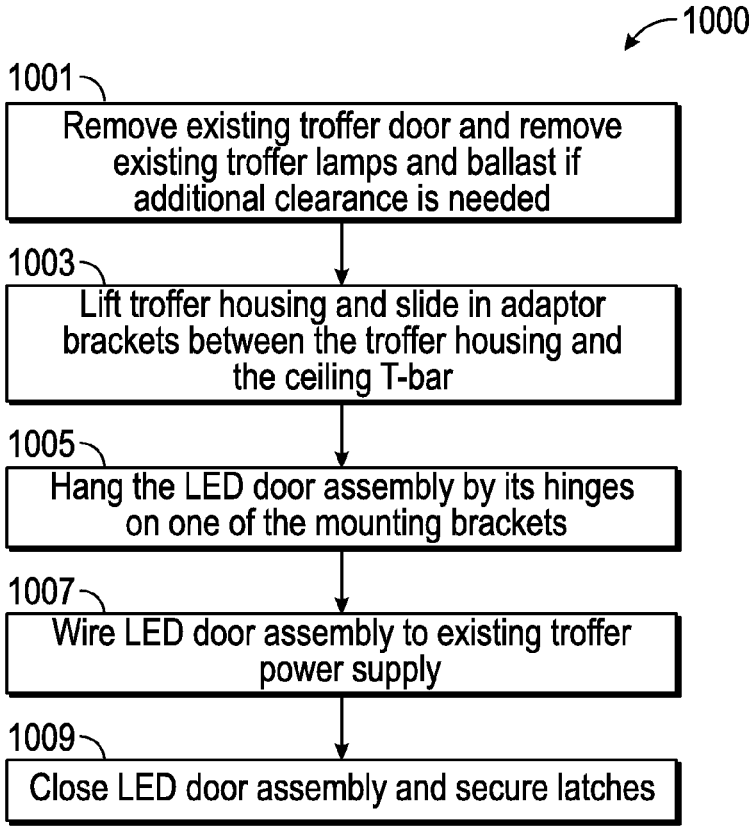
FIG. 6A is an illustration of flow chart for retrofitting an existing troffer light fixture using a door assembly and adaptor brackets according to an exemplary embodiment.
Figure 6B:
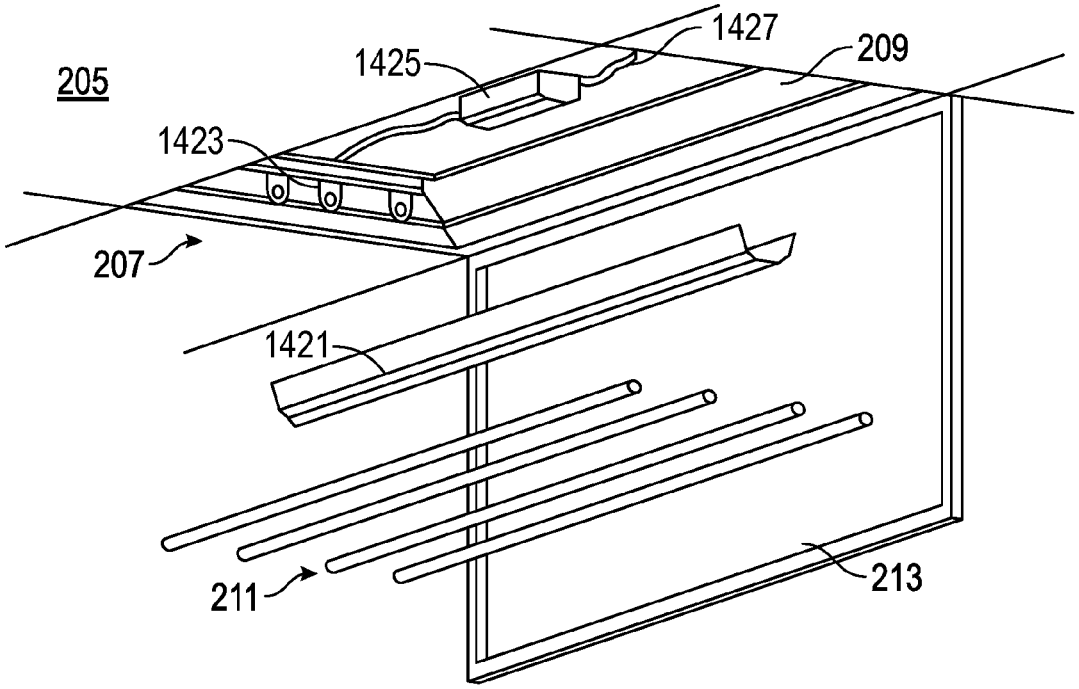
FIG. 6B is an illustration of an existing troffer light fixture and components which may be removed according to an exemplary embodiment.
Figure 6C:
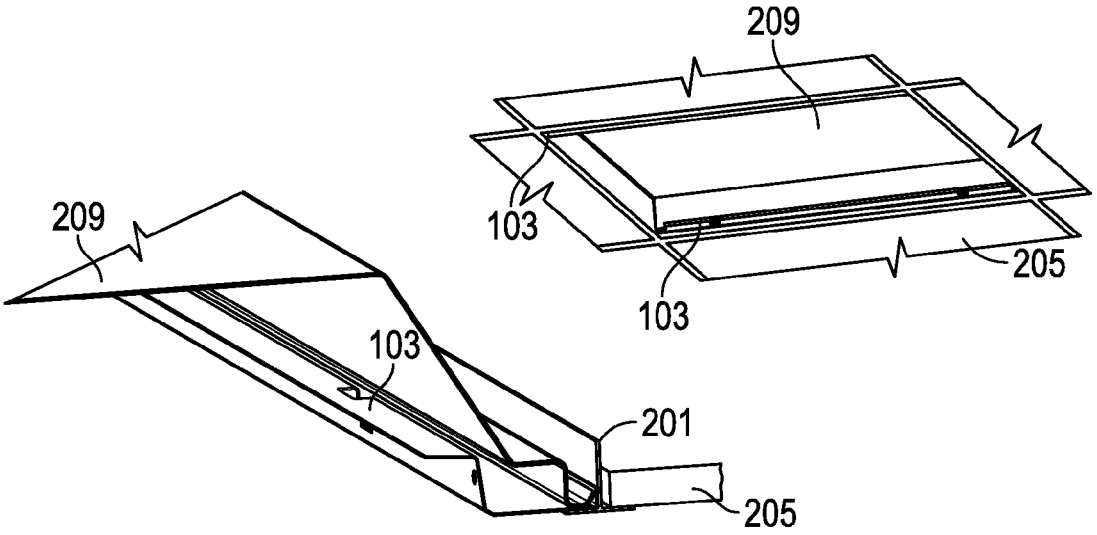
FIG. 6C is an illustration of an adaptor bracket inserted between a troffer housing and a T-bar according to an exemplary embodiment.

Referring now to FIGS. 4A and 6C, adaptor bracket 601 can include a channel 605 which extends beyond T-bar 201. Channel 605 may extend from T-bar 201 such that side 607 is positioned to extend within troffer housing 209. Advantageously, this may allow slots 609 of adaptor bracket 601 to be higher than the lowest surface of troffer housing 209. This allows door assembly 101 to be mounted using slots 609 in such a way as door assembly 101 is flush or nearly flush with troffer housing 209. This may improve the aesthetics of an existing troffer light fixture 207 retrofit using troffer door retrofit system 100.

In alternative embodiments, side 607 may be at an angle to channel 605. This may allow channel 605 to be narrower (e.g., approximately the width of the end or flange of troffer housing 209). Side 607 can extend vertically and horizontally such that slot 609 is positioned within troffer housing 209. In further alternative embodiments, side 607 may be at a downward angle relative to channel 605. This may lower slot 609 relative to troffer housing 209 of existing troffer light fixture 207. Advantageously, this may provide move clearance for door assembly 101 to fit at least partially within troffer housing 209 when hung and closed. This may make troffer door retrofit system 100 compatible with a wider variety of existing troffer light fixtures 207.

Referring again to FIG. 4A, side 607 includes slot 609. Slot 609 is configured to accept hinge 303 of door assembly 101 such that door assembly 101 can be hung from adaptor bracket 601 using slot 609. Slot 609 is configured to have a large opening and a small opening. As previously described, the large portion of the opening allows hinge 303, including extended portions 327 to be inserted through slot 609. Slot 609 also includes a smaller portion. When hinge 303 is lowered after being inserted into slot 609, the smaller portion of slot 609 prevents hinge 303 from exiting slot 609 (e.g., extended portions 327 are larger than the smaller opening of slot 609).

Slot 609 also extends to and into latch surface 611. Latch surface 611 is a horizontal surface onto which hook portion 333 of latch 301 engages. Hook portion 333 of latch 301, when engaged, cannot exit slot 609 due to interference of latch surface 611. When latch 301 is in a disengaged position, hook portion 333 is rotated vertically and can exit slot 609.

In alternative embodiments, latch surface 611 is at an angle to side 607. In further alternative embodiments, slot 609 does not extent into latch surface 611. For example, latch surface 611 may contain, be made of, or include magnetic material or a magnet. Latch 301 may include a magnet as previously described for securing door assembly 101 to adaptor bracket 601.

In some embodiments, adaptor bracket 601 further includes flange 613. Flange 613 may extend at a downward angle from latch surface 711. Flange 613 may prevent accidental removal of hinge 303 from slot 609 by partially overhanging slot 609 and limiting access thereto. In other embodiments, adaptor bracket 601 does not include flange 613.

Still referring to FIG. 4A, as illustrated, latch surface 611 and/or flange 613 may run for only a portion of the length of adaptor bracket 601. This may allow for the use of adaptor bracket 601 and troffer door retrofit system 100 with plenum rated ceilings (e.g., ceiling systems in which air returning to or being supplied by a heating ventilation and/or air condition system moves through the plenum space created by the drop ceiling and the structural ceiling). The ceiling system in which the troffer door retrofit system 100 is installed may be used to circulate air in the building containing the ceiling system.

To provide for air returns or air supply to or from the plenum space in the ceiling system, adaptor bracket 601 can be vented. Latch surface 611 and/or flange 613 may run for only a portion of the length of adaptor bracket 601 to provide for venting. When hung using hinges 303, latches 301, and the corresponding slots 609 and latch surfaces 611 of adaptor brackets 601, door assembly 101 may be separated from adaptor bracket 601 by a distance. In some embodiments, this distance is substantially the width of attachment surface 611 and/or flange 613. Therefore, in embodiments in which latch surface 611 and/or flange 613 do not run the entire length of adaptor bracket 601, a vent space is created between door assembly 101 and adaptor bracket 601. Advantageously, this vent space may be used as an air supply or air return for use in a plenum ceiling system (e.g., for return of room air and/or supply of conditioned air in a heating ventilation and/or air conditioning system). This feature of some embodiments of troffer door retrofit system 100 can be used to add additional supplies or returns when retrofitting existing troffer light fixtures 207 of a plenum ceiling system. This feature can also be used to retrofit existing troffer light fixtures 207 which include a supply or return for use in a plenum ceiling system.

In alternative embodiments, lip 603 of adaptor bracket 601 engages with T-bar 201. For example, lip 603 may be or include a hook which engages the vertical portion of T-bar 201. The hook portion of lip 601 may slip over the vertical portion of T-bar 201. Advantageously, this may prevent adaptor bracket 601 from moving horizontally relative to T-bar 201. Furthermore, adaptor bracket 601 may be held in place by the hook portion without relying on or using the weight of troffer housing 209 to secure adaptor bracket 601.

In other alternative embodiments, adaptor bracket 601 does not rest on or connect to T-bar 201. For example, adaptor bracket 201 may be mounted to troffer housing 209 of an existing troffer light fixture 207. Adaptor bracket 601 may include a hook, latch or other mechanism to attach adaptor bracket 601 to troffer housing 209 using existing slots in troffer housing 209.

Referring now to FIG. 4B, a profile view of adaptor bracket 601 is illustrated according to one embodiment. Adaptor bracket 601 may be produced by folding sheet metal in some embodiments. The result may be the profile as illustrated. Lip 603 may be at a 90 degree angle relative to channel 605. Side 607 may be at an additional 90 degree angle relative to channel 605. A further 90 degree fold from side 607 may create latch surface 611. And, a 58 degree fold can create flange 613. These angles are illustrative only. Other angles may be used to define the portions of adaptor bracket 601 described herein. The angles described herein may include radii or be chamfered in some embodiments.

In one embodiment, adaptor bracket 601 folded. A piece of sheet metal may be cut to provide the shape and dimensions of adaptor bracket 601. Slot 609 may also be cut from the sheet metal. The sheet metal may then be folded to create adaptor bracket 601 as described herein.

In some embodiments, adaptor bracket 601 is made of metal as previously described. For example, adaptor bracket 601 may be made of or include galvanized steel, aluminum, or other metals or alloys. In other embodiments, adaptor bracket 601 may be made of other materials. For example, adaptor bracket 601 may be made of polymers such as acrylic, polyvinyl chloride, or other plastics. As previously discussed, adaptor bracket 601 may be made using folding techniques. In other embodiments, adaptor bracket 601 may be made using other techniques. For example, adaptor bracket 601 may be made using techniques such as injection molding, casting, machining, and/or a combination of these and other techniques.

Figure 4D:
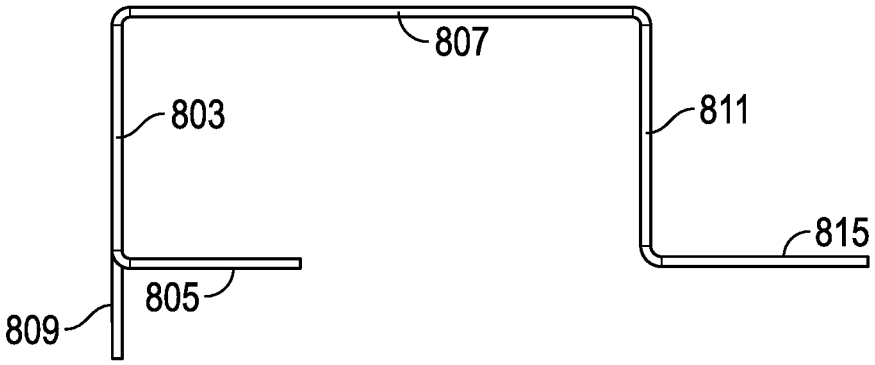
FIG. 4D is an illustration of a profile of an alternative adaptor bracket according to an exemplary embodiment.
Figure 4E:
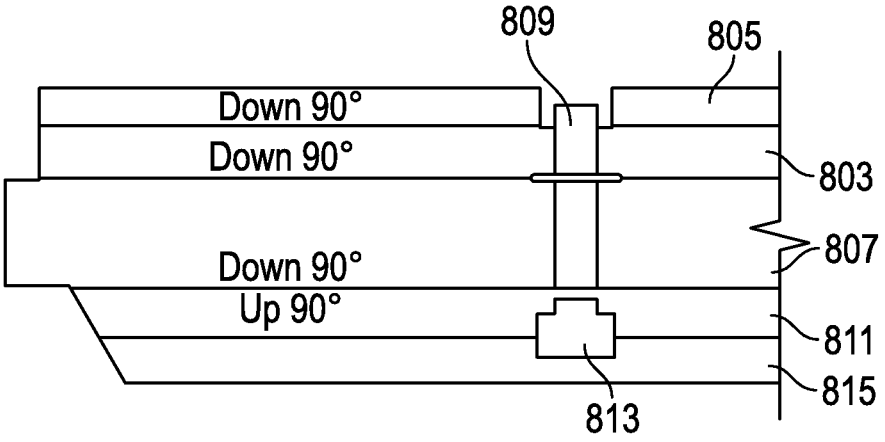
FIG. 4E is an illustration of an alternative adaptor bracket prior to folding according to an exemplary embodiment.

Referring now to FIGS. 4C-4E, adaptor bracket 801, one embodiment of adaptor bracket 103 previously described herein, is illustrated according to an exemplary embodiment. Adaptor bracket 801 is configured to rest, at least partially, on T-bar 201. Adaptor bracket 801 is further configured to engage with an end or flange of a troffer housing 209 of an existing troffer light fixture 207. As previously described, adaptor bracket 801 includes slots 813 which allows door assembly 101 to be hung from or latched to adaptor bracket 801. Generally, the description of adaptor bracket 601 with reference to FIGS. 4A-4B is applicable to adaptor bracket 801. For example, the materials and manufacturing techniques may be the same. Additionally, similar parts may perform similar functions.

Referring now to FIG. 4C, adaptor bracket 801 includes channel 807, first side 803, and second side 811. The end of or a flange of a troffer housing 209 of an existing troffer light fixture 207 can be received by these components. This may allow the weight and geometry of troffer housing 209 to keep adaptor bracket 801 in place on T-bar 201. Channel 807 can rest on T-bar 201.

In some embodiments, first side 803 prevents adaptor bracket 801 from moving horizontally and away from T-bar 201. Troffer housing 209 and first side 803 interfere with one another such that horizontal movement away from T-bar 201 is prevented. In some embodiments, first side 803 may be in contact or nearly in contact with the vertical portion of T-bar 201. This may prevent or substantially limit horizontal movement of adaptor bracket 801 towards T-bar 201 as T-bar 201 and first side 803 would interfere.

In some embodiments, adaptor bracket 801 further includes flange 805. Flange 805 can extend from first side 803 over channel 807. In some embodiments, flange 805 engages with and end of or flange of troffer housing 209. Flange 805 may assist in preventing adaptor bracket 801 from moving relative to troffer housing 209 and/or T-bar 201. Flange 805 may also prevent troffer housing 209 from inadvertently exiting channel 807.

First side 803 and flange 805 may include one or more tabs 809. Tabs 809 and flanges 805 can be used to elevate the troffer housing 209 of an existing troffer light fixture 207 which is being retrofit with troffer door retrofit system 100. The troffer housing 209 can rest on top of flange 805. This lifts the troffer housing 209 to a higher position than as installed (e.g., resting on T-bar 201). Channel 807 rests on T-bar 201 with flange 805 elevated above channel 807 and T-bar 201 by first side 803. The troffer housing 209 is elevated above T-bar 201 as it rests on flange 805. Tabs 809 advantageously prevent adaptor bracket 801 from sliding horizontally and away from T-bar 201. Tabs 809 can contact the edge of troffer housing 209 resting on flange 805 and this interference prevents adaptor bracket 801 from becoming disengage from T-bar 201 and/or troffer housing 209.

Advantageously, lifting troffer housing 209 of existing troffer light fixture 207 higher in relation to the T-bar 201 provides additional space in which to hang door assembly 101. This provides an advantage in that troffer door retrofit system 100 is compatible with existing troffer light fixtures 207 with a shallower troffer housing 209. The troffer housing 209 is lifted by adaptor bracket 801 including flange 805 providing more space to hang door assembly 101. Therefore, troffer door retrofit system 100 is compatible with a wider range of existing troffer light fixtures 207. Additionally, the additional space provided by adaptor bracket 801, may reduce, partially or completely, the number of components (e.g., ballast, ballast cover, lamps, etc.) which are removed from existing troffer light fixture 207 to make room for door assembly 101 when closed (e.g., latched and extending into troffer housing 209).

Adaptor bracket 801 can provide an additional advantage in that adaptor bracket 801 can be used for standard retrofitting and retrofitting in which additional space is needed. A single adaptor bracket 801 can be used for either case, reducing the types of adaptor brackets 103 which are manufactured or provided. In a standard installation, troffer housing 209 can be inserted into adaptor bracket 801 such that the edge of troffer housing 209 rests in channel 807 and is secured by first side 803 and/or flange 805. In an installation in which additional space is desired, troffer housing 209 can be lifted and placed on adaptor bracket 801. The edge of troffer housing 209 can rest on top of flange 805. The edge of troffer housing 209 can be secured with tabs 809.

Adaptor bracket 801 further includes second side 811, latch surface 815, and slot 813. As described with reference to corresponding components in FIGS. 4A-6C, these components allow door assembly 101 to be hung from adaptor bracket 801 or latched to adaptor bracket 801 using hinges 303 and latches 301 respectively.

Referring now to FIG. 4D, a profile view of adaptor bracket 801 is illustrated according to one embodiment. Adaptor bracket 801 may be produced by folding sheet metal in some embodiments. The result may be the profile as illustrated latch surface 815 may be at a 90 degree angle to second side 811 which in turn is at a 90 degree angle from channel 807, first side 803 may also be at a 90 degree angle from channel 807. Tab 809 may continue at the same angle as first side 803 relative to channel 807. Flange 805 may be at a 90 degree angle from first side 803. These angles are illustrative only. Other angles may be used to define the portions of adaptor bracket 801 described herein. The angles described herein may be or include radii or be chamfered in some embodiments.

Referring now to FIG. 4E, a portion of adaptor bracket 801 is illustrated prior to being folded according to one embodiment. A piece of sheet metal may be cut to provide the shape and dimensions of adaptor bracket 801. Slot 813 may also be cut from the sheet metal. The sheet metal may then be folded to create adaptor bracket 801 as described herein.

Generally, one or more of the previously described features or components of adaptor brackets 103 can be combined with features or components from alternatively described embodiments. Other combinations and embodiments are possible.

Figure 5:
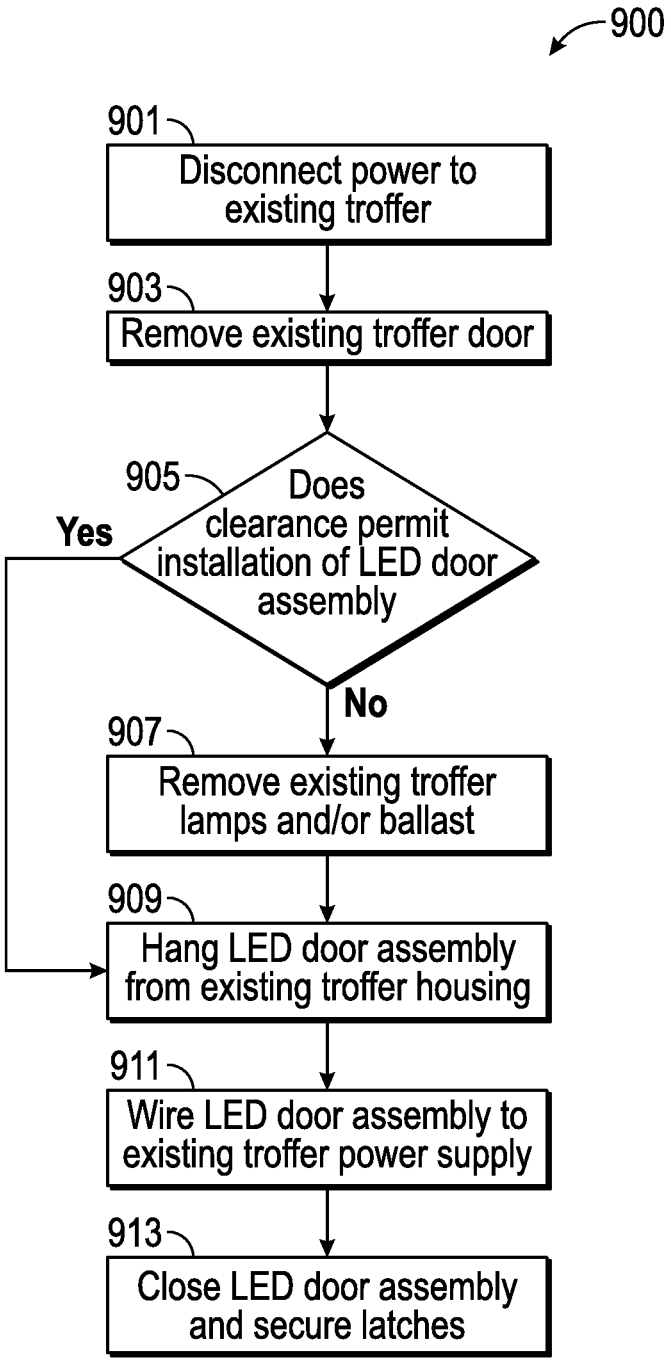
FIG. 5 is an illustration of flow chart for retrofitting an existing troffer light fixture using a door assembly according to an exemplary embodiment.

Referring now to FIG. 5, a flow chart of method 900 for retrofitting an existing troffer light fixture 207 using troffer door retrofit system 100. An installer disconnects power to the existing troffer light fixture 207 (901). For example, an installer may turn off a light switch which controls the electrical supply (e.g., interrupts the electrical supply) to existing troffer light fixture 100. As an alternative example, an installer can disconnect power to existing troffer light fixture 207 using a breaker.

The installer can remove the door of the existing troffer light fixture 207 (903). In some embodiments, the installer removes the door after disconnecting the power. In alternative embodiments, the installer removes the door prior to turning of the power. As previously described herein, the existing troffer light fixture 207 can include a door. The door may be or include the lens or a louver of the existing troffer light fixture 207. Removing the door can include unlatching the door from the troffer housing 209 of the existing troffer light fixture 207. Removing the door can also include unhinging the door from the troffer housing 209. For example, the hinges of the door may be lifted out of slots included in the troffer housing 209.

The installer may determine if clearance in the housing 209 of the existing troffer light fixture 207 is sufficient to permit installation of door assembly 101 (905). This can include taking one or measurements. This may also or alternatively include consulting an instruction manual with instructions for retrofitting a particular existing troffer light fixture 207. For example, the instruction manual may have been prepared with the knowledge of the clearances of many types of existing troffer light fixtures 207. Based on the particular make or model of the existing troffer light fixture 207 being retrofit, the instructions may instruct the installer that clearance does or does not permit installation of door assembly 101 without removing one or more components of existing troffer light fixture 207.

If clearance does not permit installation of door assembly 101, the installer can remove lamps, a ballast cover, and/or the ballast of existing troffer light fixture 207 (907). Removing these components, a subset of these components, and/or other components of existing troffer light fixture 207 can provide sufficient clearance for the installation of door assembly 101.

If clearance does permit instillation of door assembly 101, lamps, a ballast cover, ballast, and/or other components of existing troffer light fixture 207 may be left within troffer housing 209. Advantageously, this may result in a faster retrofitting process. In some embodiments, one or more components are removed but not all. In alternative embodiments, no internal components of existing troffer light fixture 207 (e.g., components other than an existing troffer door) are removed.

The installer can hang the door assembly 101 from the existing troffer housing 207 (909). As previously described herein, the hinges 303 of door assembly 101 can be configured to operate with slots of a troffer housing 209 of the existing troffer light fixture 207. Hanging door assembly 101 from the troffer housing 209 can include inserting hinges 303 of the door assembly 101 into a slot on troffer housing 209. Door assembly 101 can then be lowered such that hinges 303 do not exit the slots in troffer housing 209.

The installer can wire door assembly 101 to a power supply for the existing troffer light fixture 207 (909). This can include first removing power supply wires from the ballast or another component of the existing troffer light fixture 207. The power supply wires may then be wired (e.g., joined to, using a twist-on wire connector) a power supply wire for door assembly 101. The power supply wire for door assembly 101 may be extending from a cover 313, electronics housing 413, or other portion of door assembly 101. The installer may also complete any wiring for other components of door assembly 101. For example, the installer may wire other electronics of door assembly 101 such as controllers and sensors to existing or newly installed components related to existing troffer light fixture 207. Alternatively, door assembly 101 can be wired to already existing components such as controllers or sensors included in or related to existing troffer light fixture 207.

The installer can close door assembly 101 and secure latches 301 of door assembly 101 (913). This can include positioning latches 301 of door assembly 101 in the disengaged position. The door assembly 101 can be closed by pivoting it on hinges 303. As door assembly 101 is closed, latches 301 can enter slots included in troffer housing 209. The latches can then be positioned in a closed position such that latches 301 interact with troffer housing 209 to prevent door assembly 101 from opening.

If at any point prior to or during the performance of method 900, the installer determines that the hinges 303 and/or latches 301 of door assembly 101 do not align with or are otherwise incompatible with troffer housing 209 of existing troffer light fixture 207, the installer may use adaptor brackets 103 to perform the retrofit. Additionally, if the installer determines that there is insufficient clearance even after removing components of existing troffer light fixture 207, the installer can use adaptor brackets 103 to perform the retrofit.

As described above and elsewhere herein, an existing troffer light fixture 207 can be retrofit using only door assembly 101. In other embodiments described later and elsewhere herein, an existing troffer light fixture 100 can be retrofit using adaptor bracket 103 as well. Advantageously, either method of retrofitting can be performed without the use of tools. For example, no fasteners, drills, screwdrivers, wire cutters, or other tools are required to complete the retrofit. In some embodiments, even the twist-on wire connector may be salvaged from existing troffer light fixture 207. In one embodiment, no tools are required to attach any component (e.g., adaptor bracket 103) to troffer housing 209 of existing troffer light fixture 207. Advantageously, retrofitting without the use of tools may decrease the time taken to perform the retrofit. This may reduce costs and/or otherwise speed up the retrofitting of one or a plurality of existing troffer light fixtures 207. The retrofit methods described herein may also allow for retrofitting of an existing troffer light fixture 207 without disruption of existing ceiling tiles and/or without the removal of existing fixtures. This may reduce the complexity and/or risk of damage from the retrofit process.

Referring now to FIGS. 6A-6G, a retrofit method is described and illustrated according to an exemplary embodiment. This retrofit method includes the use of adaptor brackets 301. As previously described, this method may be a continuation of the method for retrofitting using door assembly 101 only (e.g., adaptor brackets 103 become necessary to retrofit existing troffer light fixture 207) in some embodiments.

Referring now to FIG. 6A, a flow chart for method 1000 of retrofitting an existing troffer light fixture 207 using adaptor bracket 103 is illustrated according to an exemplary embodiment. An installer may remove the door of an existing troffer light fixture 207 and may optionally remove components such as lamps, a ballast cover, ballast, and/or other components from the existing troffer light fixture 207 (1001). The installer can disconnect power to the existing troffer light fixture 207 prior to this if power has not already been disconnected. As previously described, components of existing troffer light fixture 207 may be removed if there is not sufficient clearance for door assembly 101. With additional reference to FIG. 6B, troffer door 213 may be removed by unlatching troffer door 219 from troffer housing 209. While troffer door 213 is hanging or after it has been removed (e.g., by lifting it from slots in troffer housing 209), the installer can remove components of existing troffer light fixture 207 such as lamps 211, ballast cover 1421, lamp holders 1423, and/or ballast 1425. If clearance permits, these components may be abandoned inside troffer housing 209 of the existing troffer light fixture 207.

Referring again to FIG. 6A, the installer can lift troffer housing 209 and slide in adaptor brackets 103 between troffer housing 209 and T-bar 201 (1003). With reference to FIG. 6C, One side of troffer housing 209 can be lifted. While lifted, adaptor bracket 203 can be inserted between troffer housing 209 and T-bar 201. The Troffer housing 209 can then be lowered. This process can be repeated for the second adaptor bracket 103.

Figure 6D:
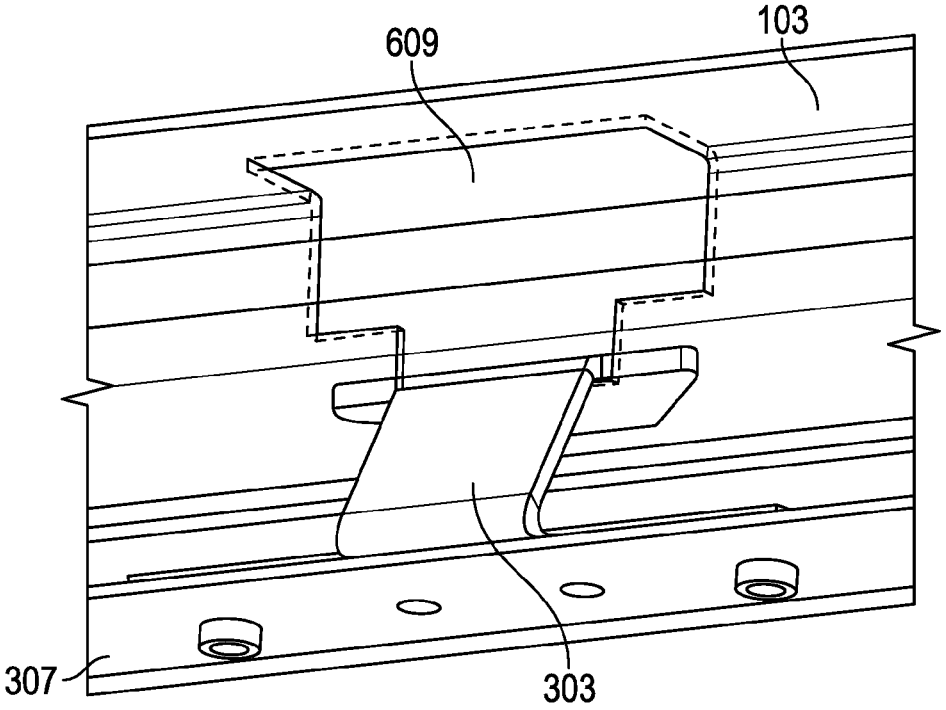
FIG. 6D is an illustration of a hinge of a door assembly inserted into a slot of an adaptor bracket according to an exemplary embodiment.
Figure 6E:
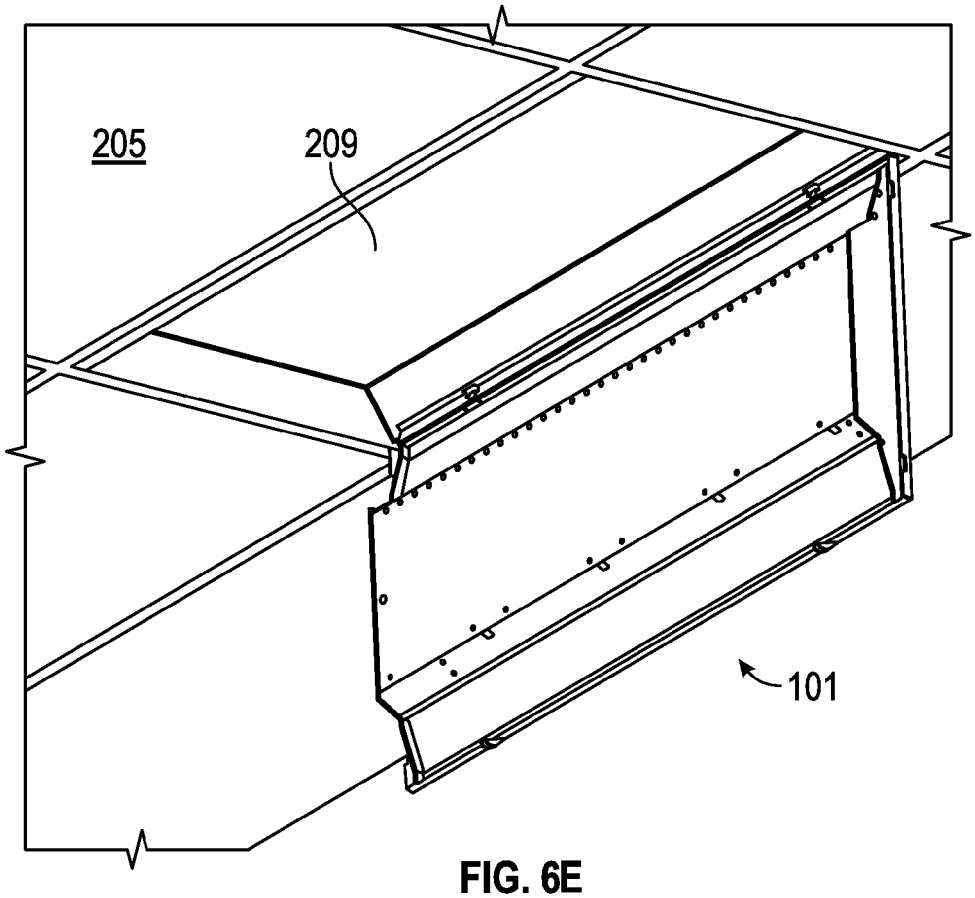
FIG. 6E is an illustration of a door assembly hung from an adaptor bracket according to an exemplary embodiment.

Referring again to FIG. 6A, the installer can hang door assembly 101 using hinges 303 from one of the adaptor brackets 103 (1005). With reference to FIGS. 6D and 6E, this can include inserting hinge 303 through slot 609 of adaptor bracket 103. Door assembly 101 can be lowered such that hinge 303 does not exit slot 609 of adaptor bracket 103.

Referring again to FIG. 6A, the installer can wire door assembly 101 to the power supply of existing troffer light fixture 207 (1007). With reference to FIG. 6B, Existing troffer light fixture 207 power supply wires 1427 may be removed from ballast 1425. Power supply wires 1427 can then be connected to supply wires extending from door assembly 101.

Figure 6F:
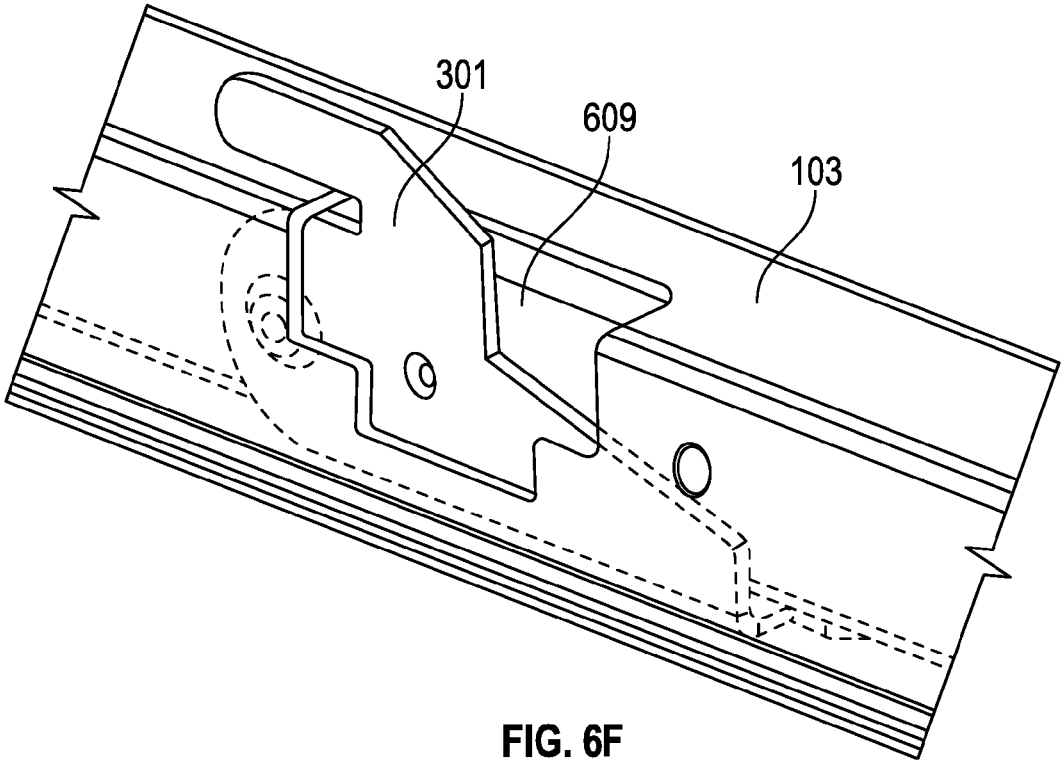
FIG. 6F is an illustration of a hinge of a door assembly engaged with an adaptor bracket according to an exemplary embodiment.
Figure 6G:
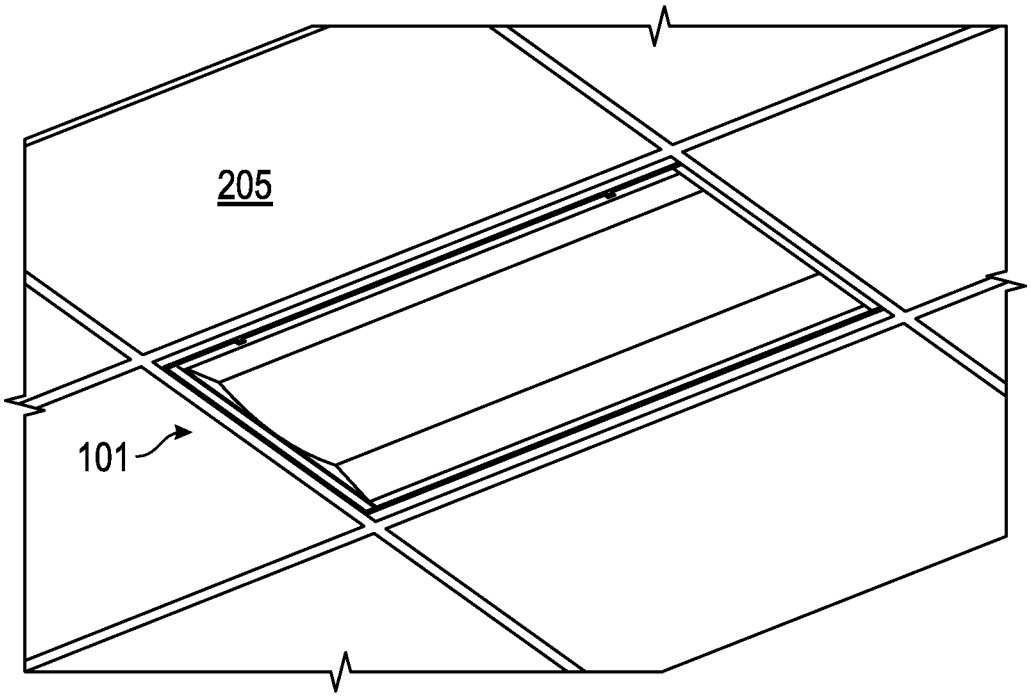
FIG. 6G is an illustration of an existing troffer light fixture which has been retrofit with a door assembly and adaptor brackets according to an exemplary embodiment.

Referring again to FIG. 6A, the installer can close door assembly 101 and secure latches 301 (1009). With reference to FIG. 6F, the installer inserts latches 301 through slot 609 of adapter bracket 103 while latches 301 are in the disengaged position and while closing door assembly 101. The installer then rotates latches 301 to the engaged position and latches 301 engage with a portion of the adaptor bracket 301. Referring now to FIG. 6G, this results in a retrofitted existing light fixture having door assembly 101.

Figure 7A:
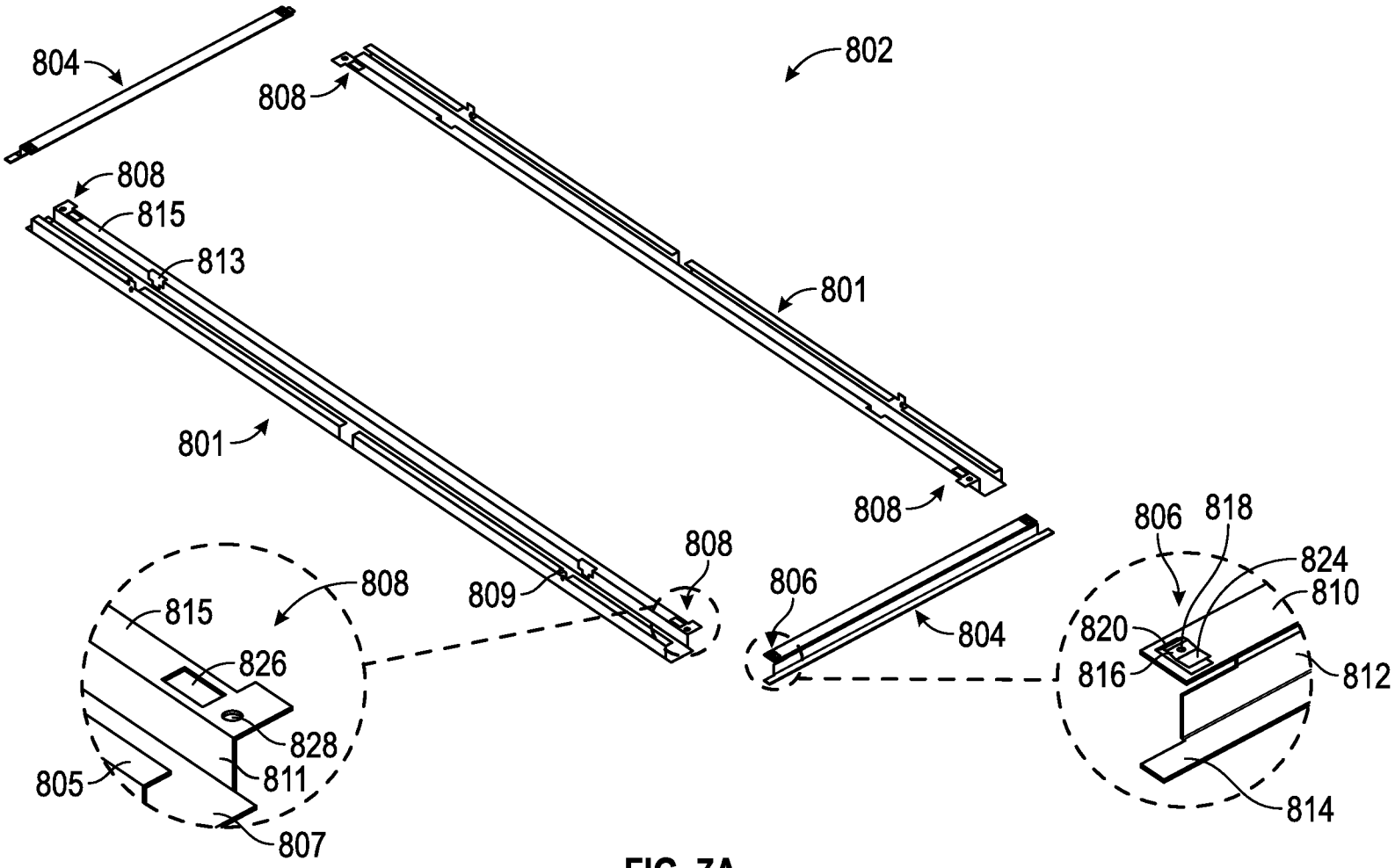
FIG. 7A is an illustration of an unassembled four part adaptor bracket according to an exemplary embodiment.
Figure 7B:
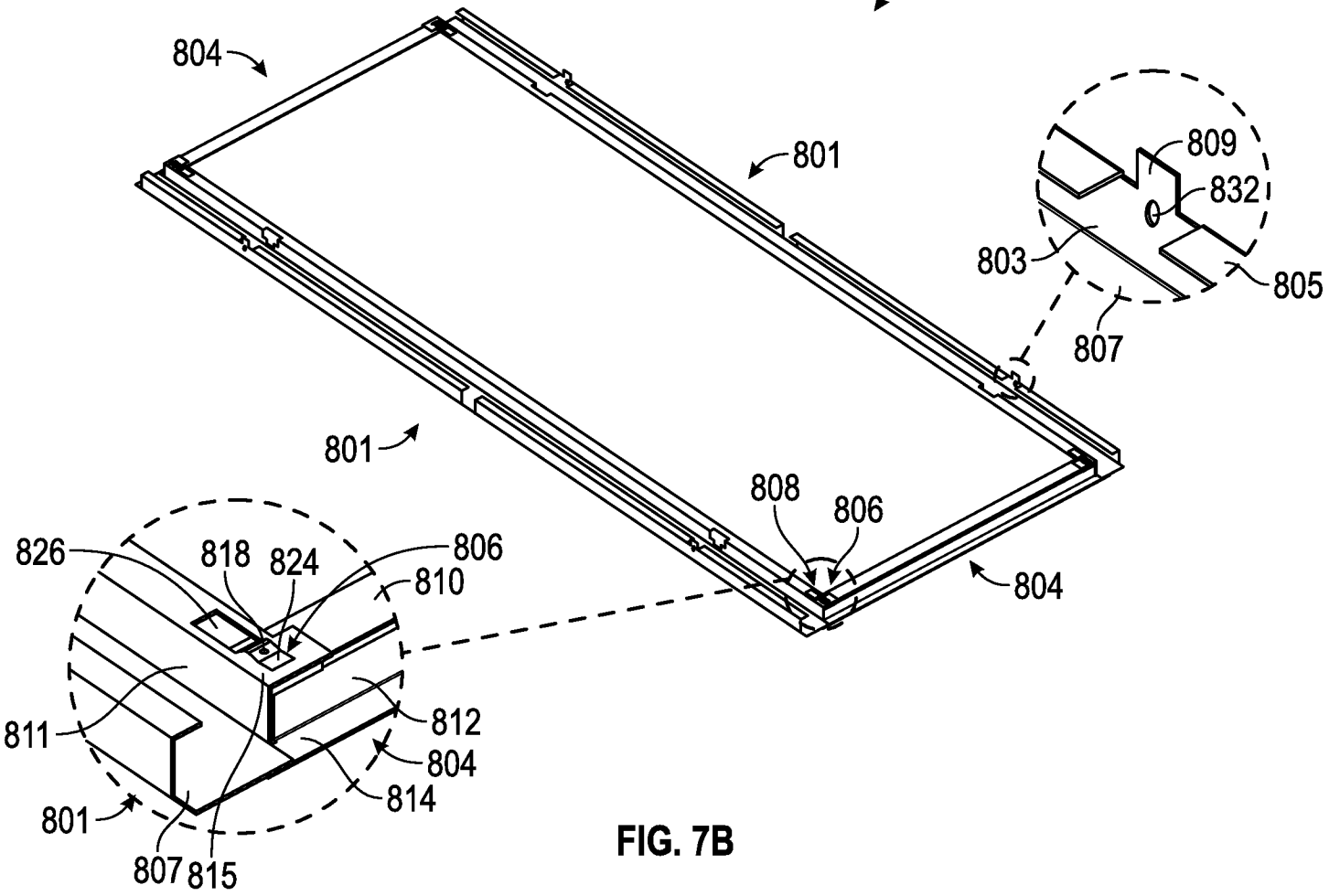
FIG. 7B is an illustration of an assembled four part adaptor bracket according to an exemplary embodiment.
Figure 7C:
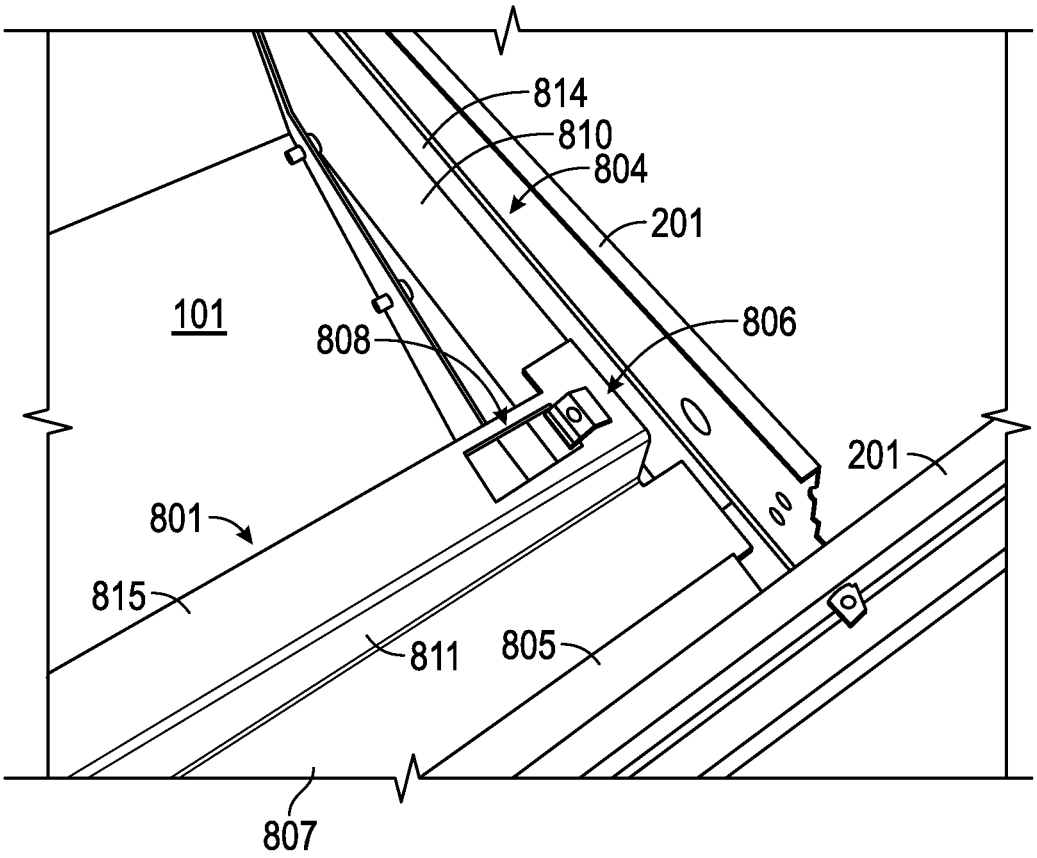
FIG. 7C is an illustration of a door assembly and four part adaptor bracket installed in a ceiling system according to an exemplary embodiment.
Figure 8:
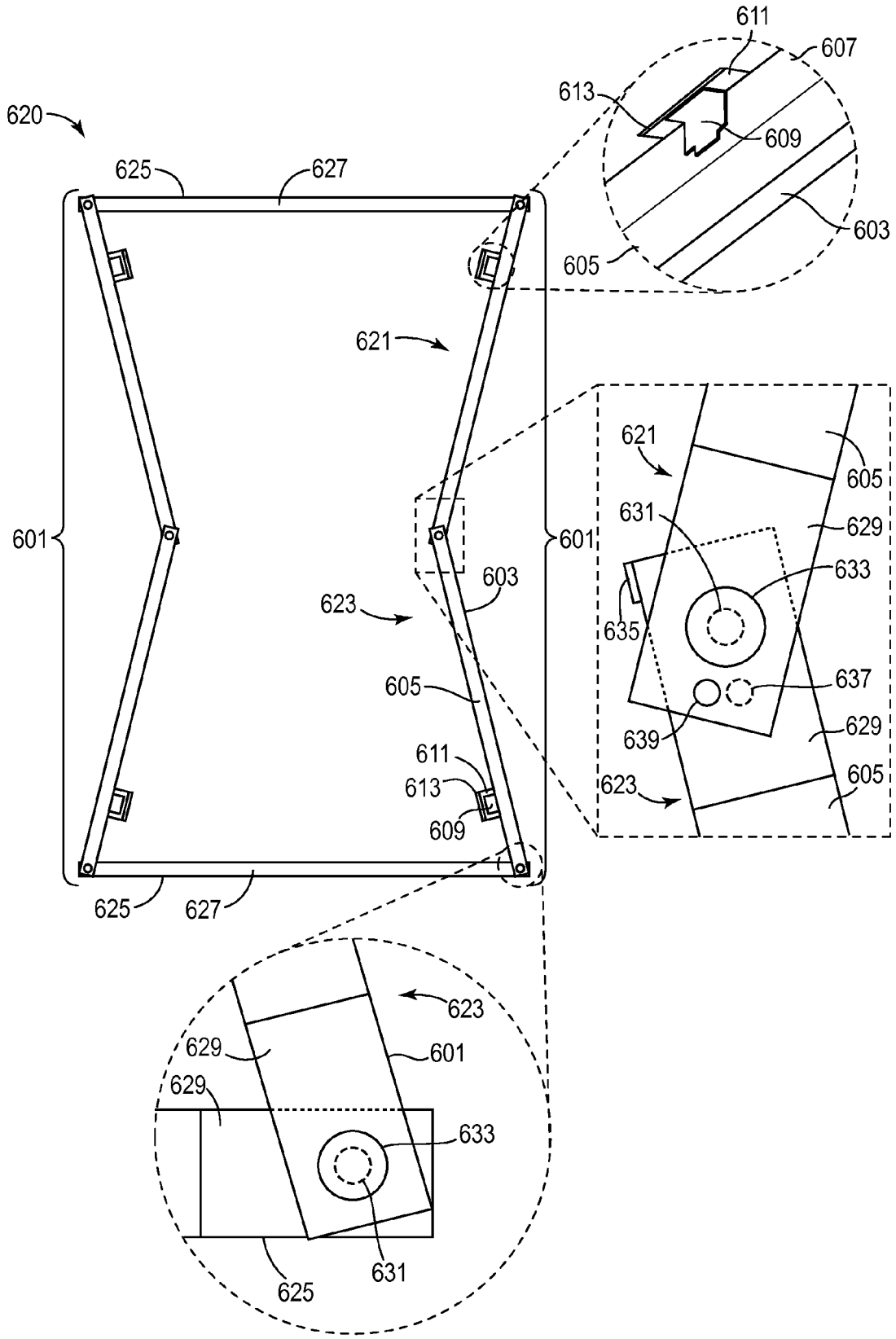
FIG. 8 is an illustration of a folding adaptor bracket system according to an exemplary embodiment.

Referring generally to FIGS. 7A-8, alternative adaptor brackets 103 are illustrated according to various embodiments. In these embodiments, adaptor bracket 103 (e.g., four part adaptor bracket 802 and folding adaptor bracket 620) is self-supporting. This allows troffer retrofit system 100 to function as a retrofit kit in retrofit applications and to function as a new light fixture in new construction applications. Adaptor bracket 103 (e.g., four part adaptor bracket 802 and folding adaptor bracket 620) supports itself and/or door assembly 101 such that troffer retrofit system 100 can be installed in a ceiling system without using a troffer housing 207 of an existing troffer light fixture 209. For retrofit applications, adaptor bracket 103 (e.g., four part adaptor bracket 802 and folding adaptor bracket 620) can be installed between T-bars 201 of a ceiling system and a troffer housing 207 of an existing troffer light fixture 209. This allows door assembly 101 to be used in conjunction with existing components of existing troffer light fixture 209 (e.g., a power supply or power source, control wiring, sensors, etc.).

Referring now to FIG. 7A, four part adaptor bracket 802 is illustrated according to one embodiment. Four part adaptor bracket 802 includes separate components which are coupled together to form a self-supporting adaptor bracket 103. Four part adaptor bracket 802 may form a rigid or substantially rigid frame when the four components are coupled together. This allows four part adaptor bracket 802 to support door assembly 101 (e.g., without the use of an existing troffer light fixture 209). Four part adaptor bracket 802 includes two adaptor bracket 801 portions. Four part adaptor bracket 802 further includes two supports 804. Adaptor bracket 801 portions and supports 804 are configured to be coupled together in order to form four part adaptor bracket 802. The geometry and/or rigid or substantially rigid configuration of four part adaptor bracket 802 allows four part adaptor bracket 802 to be self-supporting (e.g., without needing a troffer housing 207 to prevent four part adaptor bracket 802 from passing through T-bars 201) by resting on T-bars 201 of a ceiling system. The self-supporting configuration of four part adaptor bracket 802, while assembled, is discussed in greater detail with reference to FIG. 7B. Advantageously, four part adaptor bracket 802 can be passed through T-bars 201 of a ceiling system as individual parts and assembled (e.g., supports 804 coupled to adaptor bracket 801 portions) above T-bars 201. This allows for the assembled four part adaptor bracket 802 to be easily assembled and placed on T-bars 201 such that four part adaptor bracket 802 is unable to pass through a space defined by the T-bars 201.

Adaptor bracket 801 portions include receivers 808 in some embodiments. Receivers 808 are configured to accept coupling tabs 806 included in supports 804. Receivers 808 and coupling tabs 806 allow for supports 804 and adaptor bracket 801 portions to be coupled together.

The adaptor bracket 801 portions may function as described with reference to FIGS. 4C-4E. Adaptor bracket 801 portions can include one or more features of adaptor bracket 801 described with reference to FIGS. 4C-4E. For example, adaptor bracket 801 portions include slots 813 which are configured to accept hinges 303 and latches 301 of door assembly 101. Adaptor bracket 801 portion may further include latch surface 815 which is configured to accept latch 301. Adaptor bracket 801 portions may also include channel 807 to receive troffer housing 207 of an existing troffer light fixture 209 when four part adaptor bracket 802 is used in retrofit applications. Adaptor bracket 801 portion may also include flange 805 and/or tab 809 configured to raise troffer housing 207 up in relationship to door assembly 101 to provide additional space within troffer housing 207 for door assembly 101 in retrofit applications. Troffer housing 207 can rest on flange 805 and be held in place by tabs 809.

Adaptor bracket 801 portions further include receivers 808. Each adaptor bracket 801 portion includes a receiver 808 at or near each end. This allows the adaptor bracket 801 portion to be coupled to two supports 804 using the coupling tab 806 associated with each support 804. In one embodiment, receiver 808 includes opening 826. Opening 826 is configured to allow the coupling tab 806 of a support 804 to pass from the underside of latch surface 815 to the top side of latch surface 815. The coupling tab 806 may be slid towards the end of adaptor bracket 801 portion such that coupling tab 806 is in contact with the top side of latch surface 815 while upper flange 810 of support 804 is in contact with the underside of latch surface 815.

In some embodiments, receiver 808 further includes locking mechanism 828. Locking mechanism 828 is configured to receive protrusion 818 of coupling tab 806. For example, locking mechanism 828 may be a hole or divot shaped to accept protrusion 818. When support 804 and adaptor bracket 801 are coupled together by receiver 808 and coupling tab 806, protrusion 818 extends partially or completely into locking mechanism 828. This prevents inadvertent movement of support 804 and adaptor bracket 801 portion relative to one another. Coupling tab 806 is prevented from inadvertently moving and passing through receiver 808 (e.g., opening 826).

In some embodiments, sufficient force (e.g., lateral force moving coupling tab 806 towards opening 826 and/or vertical force lifting coupling tab 806 and protrusion 818 away from locking mechanism 828) allows for the decoupling of support 804 and adaptor bracket 801 portion. Coupling tab 806 can be moved from the upper side of latch surface 815 through opening 826 such that support 804 is decoupled from the adaptor bracket 801 portion.

Still referring to FIG. 7A, supports 804 are configured to be coupled to adaptor bracket 801 portions. In one embodiment, support 804 includes lower flange 814, vertical portion 812, and upper flange 810. Lower flange 814 is configured to rest on a T-bar 201. Lower flange 814 may be a plate or channel extending all or a portion of the length of support 804. When four part adaptor bracket 802 is installed in a celling system (e.g., positioned on T-bars 201), lower flange 814 may rest on T-bars 201. Advantageously, this may allow support 804 to support a portion of the weight of four part adaptor bracket 802 and/or a door assembly 101 attached or coupled to four part adaptor bracket 802. Vertical portion 812 is configured to couple upper flange 810 to lower flange 814. Vertical portion 812 may have a height which aligns or substantially aligns upper flange 810 with latch surface 815 of the adaptor bracket 801 portion such that both channel 807 of the adaptor bracket 801 portion and lower flange 814 of support 804 contact T-bars 201 when support 804 and the adaptor bracket 801 portion are coupled together (e.g., using receiver 808 and coupling tab 806). Vertical portion 812 may be flat, a channel, or a combination of vertical plates. Upper flange 810 may be a horizontal plate which runs all or a portion of the length of support 804. Upper flange 810 may be supported by or otherwise attached to vertical portion 812. Upper flange 810 may include coupling tab 806. In some embodiments, upper flange 810 is configured to be in contact with the underside of latch surface 815 of the adaptor bracket 801 portion when support 804 is coupled to the adaptor bracket 801 portion.

Supports 804 may have one or more features in common with the adaptor bracket 801 portion. For example, lower flange 814 may function similar to channel 807 and receive troffer housing 207 of an existing troffer light fixture 209 when four part adaptor bracket 802 is used in retrofit applications. In some embodiments, support 804 includes a second upper flange or upper flange 810 extends such that a troffer housing 207 is supported in an elevated position. For example, troffer housing 207 may be supported by flange 805 of the adaptor bracket 801 portion and upper flange 810 of support 804. Support 804 may include one or more tabs similar to tabs 809 of the adaptor bracket 801 portion to secure troffer housing 207 in retrofit applications. Support 804 may include holes and/or surface configured to accept latches 301 and/or hinges 303 of door assembly 101.

Support 804 further includes coupling tab 806. Coupling tab 806 is configured to engage with receiver 808 of the adaptor bracket 801 portion in order to couple support 804 to the adaptor bracket 801 portion. In one embodiment, coupling tab 806 is a plane or series of planes extending above upper flange 810. Coupling tab 806 may run parallel, substantially parallel, and/or along the plane in which upper flange 810 is located. Coupling tab 806 may extend over upper flange 810. In one embodiment, coupling tab 806 may be formed by elevating a portion of upper flange 810 (e.g., cutting three sides of coupling tab 806 free from upper flange 810 and bending coupling tab 806). Coupling tab 806 may be configured to engage with latch surface 815 of the adaptor bracket 801 portion such that latch surface 815 is located between coupling tab 806 and upper flange 810 when support 804 is coupled to the adaptor bracket 801 portion.

In one embodiment, coupling tab 806 includes a first plane 820, a second plane 816, and a third plane 824. The planes may be orientated at one or more angles relative to upper flange 810. For example, the first plane 820 of coupling tab 806 may angle coupling tab 806 up from upper flange 810. This provides space between upper flange 810 and coupling tab 806 in which a portion of latch surface 815 can be secured between upper flange 810 and coupling tab 806. Second plane 816 may include protrusion 818. Protrusion 818 may be configured (e.g., with a depth, geometry, or other characteristic) and positioned on second plane 816 such that protrusion 818 is received by locking mechanism 828 when support 804 is coupled with the adaptor bracket 801 portion. Second plane 816 may be angled downward from first plane 820 and toward upper flange 810. This may assist in positioning protrusion 818 such that protrusion 818 enters locking mechanism 828 when support 804 is coupled with the adaptor bracket 801 portion. The angle of second plane 816 may also provide force which pushes latch surface 815 onto upper flange 810. This force may prevent inadvertent uncoupling of support 804 and the adaptor bracket 801 portion. Third plane 824 may be angled upward from second plane 816 and away from upper flange 810. This provides a larger distance between the open end of coupling tab 806 and upper flange 810. Advantageously this may make coupling support 804 and the adaptor bracket 801 portion easier as there is a larger space between upper flange 810 and coupling tab 806 in which to insert latch surface 815 of the adaptor bracket 801 portion.

Referring now to FIG. 7B, four part adaptor bracket 802 is illustrated as assembled according to one embodiment. Coupling tab 806 and receiver 808 are engaged such that support 804 and the adaptor bracket 801 portion are coupled. In coupling support 804 and the adaptor bracket 801 portion, coupling tab 806 is inserted through opening 826 of receiver 808. Support 804 and/or the adaptor bracket 801 portion are then moved such that coupling tab 806 travels in the direction of the end of the adaptor bracket 801 portion. Latch surface 815 enters the space between coupling tab 806 and upper flange 810 of support 804 (e.g., third plane 824 of coupling tab 806 and upper flange 810). Support 804 and/or the adaptor bracket 801 portion continue to be moved in the same direction. This allows protrusion 818 of coupling tab 806 to engage with locking mechanism 828 of receiver 808. Once protrusion 818 and locking mechanism 828 are engaged, support 804 and the adaptor bracket 801 portion are prevented from inadvertently disengaging by the interference between protrusion 818 and locking mechanism 828. Further movement of support 804 and/or other adaptor bracket 801 portion is prevented by interference between latch surface 815 at the end of opening 826 and the portion of coupling tab 806 (e.g., first plane 820) meeting upper flange 810 of support 804.

Coupling support 804 with the adaptor bracket 801 portion may result in upper flange 810 of support 804 being in contact with the lower side of latch surface 815 of the adaptor bracket 801 portion. Additionally, coupling tab 806 may be in contact with the upper side of latch surface 815. In addition to preventing lateral movement of support 804 and the adaptor bracket 801 portion relative to one another, this configuration may prevent vertical movement of the two parts relative to one another. In further embodiments, vertical portion 812 of support 804 and second side 811 of the adaptor bracket 801 portion are in contact with one another when support 804 and the adaptor bracket 801 portion are coupled. Contact between vertical portion 812 and second side 811 may reduce or eliminate rotation between support 804 and the adaptor bracket 801 portion. In alternative embodiments, only a subset of these surfaces may be in contact with one another.

The coupling of supports 804 and the adaptor bracket 801 portions allows four part adaptor bracket 802 to be self-supporting (and therefore useful in retrofit and new construction applications). Adaptor bracket 801 portions rest on T-bars 201. In some embodiments, supports 804 also rest on T-bars 201. Supports 804 can therefore support the weight of adaptor bracket 801 portions and/or door assembly 101, in addition to the adaptor bracket 801 portions, by transferring the load to T-bars 201. In alternative embodiments, supports 804 do not rest on T-bars 201. The adaptor bracket 801 portions transfer the load of four part adaptor bracket 802 and/or door assembly 101 to T-bars 201 for support. Supports 804 work to maintain the geometry of four part adaptor bracket 802 such that adaptor bracket 801 portions remain in contact with T-bars 201 and support four part adaptor bracket 802 and/or door assembly 101 attached thereto.

Supports 804, when coupled to adaptor bracket 801 portions, prevent adaptor bracket 801 portions from moving toward one another. This prevents adaptor bracket 801 portions and/or four part adaptor bracket 802 from passing through a space defined by T-bars 201 of a ceiling system. The frame formed by four part adaptor bracket 802 (e.g., rectangular or square frame including supports 804 on two sides and adaptor bracket 801 portions on two additional side) rests on flanges of T-bars 201 such that four part adaptor bracket 802 cannot pass through the square or rectangular opening formed by T-bars 201.

In some embodiments, four part adaptor bracket 802 includes additional features for securing four part adaptor bracket 802 and an attached door assembly 101 to a ceiling system (e.g., one or more T-bars 201). In one embodiment, adaptor bracket 801 portions include tabs 809 having one or more holes 832. Holes 832 may be used to secure adaptor bracket 801 portion to T-bars 201. For example, tab 809 and the adaptor bracket 801 portion may be screwed to T-bars 201 through hole 832 (e.g., the threaded portion of the screw may pass through hole 832 and secure to T-bar 201 while the head of the screw does not pass through hole 832). Fastening adaptor bracket 801 portions to T-bars 201 may one or more of prevent adaptor bracket 801 portions from passing through an opening formed by a plurality of T-bars 201, partially support the weight of four part adaptor bracket 802 and/or door assembly 101, substantially prevent rotation between adaptor bracket 801 portions and supports 804, and/or keep the adaptor bracket 801 portion in contact with T-bars 201. In alternative embodiments, other fasteners may be used in conjunction with holes 832. For example, nuts and bolts, rivets, and/or other fasteners may be used with hole 832 to secure the adaptor bracket 801 portion to T-bar 201. In further embodiments, adhesives, magnets, clamps, welding, and/or other materials and techniques may be used to secure tabs 809 and/or other portion of adaptor bracket 801 portions and/or supports 804 to T-bars 201 and/or other portions of a ceiling system.

In some embodiments, door assembly 101 includes additional components for attaching door assembly 101 to a ceiling system or other support structure. For example, door assembly 101 may be rated for use in seismic zones. In order to comply with building codes, testing organization requirements, and/or other requirements, door assembly 101 may be attached to a ceiling system or other support structure (e.g., structural ceiling). In one embodiment, door assembly 101 includes one or more flanges extending from the body or frame of door assembly 101. The flanges may include holes which allow door assembly 101 to be attached to a support structure by wire or another support device. In some embodiments, holes 832 and tabs 809 of the adaptor bracket 801 portions are used to secure four part adaptor bracket 802 to a support structure using wire.

Referring now to FIGS. 7B and 7C, one corner of four part adaptor bracket 802 and door assembly 101 is illustrated in relationship to a rectangular opening created by a plurality of T-bars 201 according to one embodiment. In some embodiments, supports 804 and adaptor bracket 801 portions are coupled together such that four part adaptor bracket 802 is rigid or substantially rigid. The rigid nature of four part adaptor bracket 802 provides a square or rectangular geometry which cannot pass through the opening created by T-bars 201. In alternative embodiments, four part adaptor bracket 802 is not rigid when assembled. Supports 804 and adaptor bracket 801 portions can rotate relative to one another. In this case, four part adaptor bracket 802 uses interference with T-bars 201 to remain in a substantially rectangular or square configuration such that four part adaptor bracket 802 does not pass through the opening defined by T-bars 201. Adaptor bracket 801 portions and/or supports 804 rest on horizontal flanges of T-bars 201. Supports 804 and adaptor bracket 801 portions are substantially or entirely prevented from rotating relative to one another as supports 804 and/or adaptor bracket 801 portions come into contact with vertical portions of T-bars 201. Four part adaptor bracket 802, when assembled sits on T-bars 201 and partially within the vertical portions of T-bars 201 which form a fixed rectangular or square structure with vertical sides. Interference between the rectangular or square structure, including vertical sides, of T-bars 201 and the four sides of four part adaptor bracket 802 causes four part adaptor bracket 802 to substantially retain a rectangular or square shape. Four part adaptor bracket 802 therefore remains in contact with the horizontal potions of T-bars 201 and four part adaptor bracket 802 does not pass through the opening formed by T-bars 201.

Referring now generally to FIGS. 7A and 7B, four part adaptor bracket 802 has been illustrated according to one embodiment. Alternative embodiments are possible. In some alternative embodiments, adaptor bracket 801 portions have alternative configurations. For example, adaptor bracket 801 portions are largely similar to adaptor brackets 801 as described in FIGS. 4C-4E, but adaptor bracket portions 801 of four part adaptor bracket 802 may be or include one or more features of alternative adaptor brackets 103 such as those described with reference to FIGS. 4A-4B (e.g., adaptor bracket 601). Adaptor bracket 801 portions may be configured for use in plenum rated ceiling systems. For example, adaptor bracket 801 portions may include slots, vents, and/or other openings to allow for air flow from the ceiling system into the space below and/or from the space below into the ceiling system.

In some alternative embodiments, support 804 has various alternative configurations. Support 804 may be configured such that support 804 does not rest on T-bar 201 when four part adaptor bracket 802 is installed in a ceiling system. Support 804 may only provide rigidity to and/or couple the two adaptor bracket 801 portions. In some alternative embodiments, support 804 has alternative geometries. For example, support 804 may be I-beam shaped with vertical portion 812 located along the center lines of lower flange 814 and upper flange 810. In one embodiment, support 804 is box beam shaped with vertical portion 812 and a second vertical portion connecting the edges of lower flange 814 and upper flange 810. In further embodiments, support 804 includes an end plate or cap which contacts a portion of the adaptor bracket 801 portion (e.g., second side 811). The end plate or cap can be located at the end of and perpendicular to upper flange 810 and/or lower flange 814. The end plate of cap may contact the adaptor bracket 801 portion such that rotation of support 804 relative to the adaptor bracket 801 portion is substantially prevented when support 804 and the adaptor bracket 801 portion are coupled.

In further alternative embodiments, four part adaptor bracket 802 may more or fewer than four parts. For example, four part adaptor bracket 802 may have two parts with each part including an adaptor bracket 801 portion and a support 804 which have been coupled, joined, or manufactured as a single part. In other embodiments, four part adaptor bracket 802 has greater than four parts. For example, supports 804 and/or the adaptor bracket 801 portions may be formed by a plurality of sections joined or coupled using coupling tabs 806 and receivers 808 and/or other techniques described herein.

In some alternative embodiments, four part adaptor bracket 802 is assembled using parts or techniques other than receiver 808 and coupling tab 806 or in addition to receiver 808 and coupling tab 806. One or more fasteners may be used to removably or permanently couple or join support 804 and the adaptor bracket 801 portion. For example, screws, nuts and bolts, rivets, and/or other fasteners may be used to couple or join the two parts. Latch surface 815 and upper flange 810 may be joined. In one embodiment, opening 826 of the adaptor bracket 801 portion is configured to accept a quarter turn screw (e.g., opening 826 is oblong). Support 804 can include a quarter turn screw which has a head extending above upper flange 810 and a screw portion extending below upper flange 810. The screw portion enters opening 826 and when turned secures support 804 to the adaptor bracket 801 portion. In some embodiments, other materials and/or techniques are used to couple or join support 804 and the adaptor bracket 801 portion. For example, adhesives, sealants, welding, and/or other materials or techniques may be used.

Still referring generally to FIGS. 7A and 7B, supports may be manufactured using one or more various techniques and one or more various materials in a variety of embodiments. In one embodiment, support 804 is manufactured using bending techniques. Lower flange 814, vertical portion 812, and upper flange 810 may be formed by bending a sheet of material. Coupling tab 806 may be formed through a combination of cutting and bending. In alternative embodiments, tab 806 may be formed using a stamping process. In various alternative embodiments, one or more of bending, stamping, drawing, molding, welding, machining, and/or other manufacturing techniques may be used to manufacture support 804. In one embodiment, support 804 is made of aluminum or an aluminum alloy. In various alternative embodiments, support 804 is made of metals or metal alloys (e.g., aluminum, steel, and/or other metals), polymers, plastics, organic materials (e.g., wood products), and/or other materials.

Referring now to FIG. 8, in some embodiments, troffer door retrofit system 100 includes folding adaptor bracket system 620. Folding adaptor bracket system 620 can be used in place of adaptor bracket 103, adaptor bracket 601, and/or other adaptor brackets previously described herein (e.g., four part adaptor bracket 802). Folding adaptor bracket system 620 is configured to be inserted between an existing troffer housing 209 and T-bars 201. Folding adaptor bracket system 620 includes slots 609 and latch surfaces 611. Door assembly 101 can be hung from folding adaptor bracket system 620 using these features. Folding adaptor bracket system 620 can be used in place of two adaptor brackets 601. Folding adaptor bracket system 620 can include two adaptor brackets 601 which include hinge points at their midpoints or elsewhere. The two adaptor brackets 601 thus include an upper portion 621 and lower portion 623. Upper portion 621 and lower portion 623 each include a slot 609 and latch surface 611. Adaptor bracket 601 portions can be joined by support portion 625 with additional hinges.

Folding adaptor bracket system 620 may be configured for dual use (e.g., in retrofit applications or new construction applications) with door assembly 101. Folding adaptor bracket 620 may be used with troffer housing 207 of existing troffer light fixtures 209 in retrofit applications. The troffer housing 207 may rest in channel 605 of adaptor bracket 601 portions and/or channel 627 of support portions 625. Troffer housing 207 may assist in supporting folding adaptor bracket system 620 and/or door assembly 101 by keeping folding adaptor bracket system 620 in place relative to T-bars 201. Alternatively, folding adaptor bracket 620 is self-supporting but is configured to interface with troffer housing 207 as troffer housing 207 and/or related components (e.g., a power source coupled to troffer housing 207) are used in conjunction with door assembly 101 as part of retrofitting an existing troffer light fixture 209. Folding adaptor bracket 620 may be used without an existing troffer light fixture 209 and/or troffer housing 207 in new construction applications. The self-supporting nature of folding adaptor bracket system 620 (e.g., due to the geometry of folding adaptor bracket system 620 and T-bars 201) allows for the use of folding adaptor bracket system 620 and door assembly 101 in new construction.

In one embodiment, two adaptor bracket 601 portions are included in folding adaptor bracket system 620. The adaptor bracket 601 portions can make up the long sides of a rectangular folding adaptor bracket system 620 (e.g., for use in a 2×4 ceiling grid system). In alternative embodiments, the adaptor bracket 601 portions make up the short sides of a rectangular folding adaptor bracket system 620. In some embodiments, folding adaptor bracket system 620 is square (e.g., for use in a 2×2 ceiling grid system) with adaptor bracket 601 portions making up two opposing sides of the folding adaptor bracket system 620. In still further embodiments, four adaptor bracket 601 portions make up all sides of folding adaptor bracket system 620.

Advantageously, folding adaptor bracket system 620 allows the equivalent of two adaptor brackets 601 to be installed simultaneously as a single piece. As with adaptor bracket 601 as described in FIG. 4A, slots 609 and latch surfaces 611 are configured to allow folding adaptor bracket system 620 to be installed with a plurality of orientations. Door assembly 101 can be hung opening in a desired direction regardless of the orientation of folding adaptor bracket system 620 as installed.

In some embodiments, adaptor bracket 601 portions are the same or similar to adaptor bracket 601 or adaptor bracket 801 previously described with reference to FIGS. 4A and 4C respectively. The advantages described with respect to adaptor bracket 601 and/or adaptor bracket 801 inure to folding adaptor bracket system 620. In one embodiment, folding adaptor bracket system 620 includes channel 605, lip 603, side 607, slot 609, latch surface 611, and/or flange 613. These components perform the same functions as described with reference to adaptor bracket 601 and FIG. 4C. Channel 605 receives a portion of troffer housing 209 which secures folding adaptor bracket system 620 between troffer housing 209 and T-bar 201. Lip 603 assists in securing folding adaptor bracket system 620 relative to troffer housing 209. Slot 609 is configured to receive either latch 301 or hinge flange 303. Side 607 positions slot 609, latch surface 611, and flange 613.

Latch surface 611 provides a surface for latch 301 to engage with in order to secure door assembly 101 in a closed position.

Still referring to FIG. 8, adaptor bracket portion 601 is hinged to allow folding. In some embodiments, upper portion 621 and/or lower portion 623 terminate with a flat section 629. Flat section 629 does not include features such as lip 603 and/or side 607. Advantageously, this prevents features such as lip 603 and/or side 607 from interfering as upper portion 621 and lower portion 623 rotate relative to each other. Upper portion 621 and lower portion 623 are joined by a hinge mechanism which allows rotation. In one embodiment, the hinge mechanism includes holes 631 and fastener 633. Upper portion 621 and lower portion 623 include holes 631. Holes 631 share the same center point. Upper portion 621 rests on top of lower portion 623. Upper portion 621 and lower portion 623 are secured by fastener 633. Fastener 633 extends through holes 631 and joins upper portion 621 and lower portion 623 while allowing the portion to rotate relative to each other. In one embodiment, fastener 633 is a nut and bolt pair, rivet, or other fastener.

In some embodiments, upper portion 621 and/or lower portion 623 include locking features. Locking features releasably lock upper portion 621 and lower portion 623 into place when unfolded (e.g., upper portion 621 and lower portion 623 are aligned). In one embodiment, lower portion 623 includes flange 635. Flange 635 prevents upper portion 621 from rotating inward beyond parallel with lower portion 623. In some embodiments, upper portion 623 includes receiver 639. Receiver 639 is an indentation extending upward from upper portion 621. Receiver 639 is configured to receive protrusion 637 included on lower portion 623 in some embodiments. In one embodiment, receiver 639 is a hemispherical indentation. In other embodiments, receiver 639 has a different shape or configuration. Lower portion 623 can include protrusion 637. Protrusion 637 is configured to extend upward into receiver 639 when upper portion 621 and lower portion 623 are aligned (e.g., parallel). In one embodiment, protrusion is a raised hemispherical structure. In other embodiments, protrusion 637 has different shapes or configurations.

Receiver 639 and protrusion 637 are configured such that a predetermined amount of rotational force is required to rotate upper portion 621 and lower portion 623 such that protrusion 637 enters receiver 639. Receiver 639 and protrusion 637 are further configured such that a predetermined amount of rotational force is required to rotate upper portion 621 and lower portion 623 such that protrusion 637 exits receiver 639. For example, the force required may be determined by the force imparted on upper portion 621 and lower portion 623 by fastener 633 and/or the fit between upper portion 621 and lower portion 623. Adjusting fastener 633 (e.g., loosening a nut and bolt pair or tightening a nut and bolt pair) can adjust the amount of force needed to align and/or separate upper portion 621 and lower portion 623. Advantageously, locking features such as protrusion 637 and receiver 639 can prevent or reduce the likelihood of unintentional misalignment of upper portion 621 and lower portion 623. This can assist in the retrofitting process.

In alternative embodiments, folding adaptor bracket system 620 does not include locking features. Once installed between troffer housing 209 and T-bars 201, folding adaptor bracket system 620 can be kept aligned (e.g., upper portions 621 parallel with lower portions 623) by the fit with troffer housing 209. For example, troffer housing 209 can engage with lips 603 such that upper portions 621 and lower portions 623 cannot rotate or substantially cannot rotate relative to one another.

Still referring to FIG. 8, support portions 625 are coupled to adaptor bracket 601 portions such that support portions 625 and adaptor bracket portions 601 can rotate relative to one another. Adaptor bracket 601 portion and support portion 625 are joined by a hinge mechanism which allows rotation. In one embodiment, the hinge mechanism includes holes 631 and fastener 633. Support portion 625 and adaptor bracket 601 portion both include holes 631 which share a center point. Fastener 633 extends through holes 631 and secures the two portions such that they are able to rotate relative to one another. In one embodiment, fastener 633 is a nut and bolt pair.

In some embodiments, support portion 625 is substantially flat. In alternative embodiments, support portion 625 includes one or more of channel 627, lip 603, and/or side 607. Support portion 625 can assist in securing folding adaptor bracket system 620 between troffer housing 209 and T-bars 201. In some embodiments, support portion 625 terminates with a flat section 629. Flat section 629 does not include features such as lip 603 and/or side 607. Advantageously, this prevents features such as lip 603 and/or side 607 from interfering as adaptor bracket 601 portion and support portion 625 rotate relative to each other.

In one embodiment, support portion 627 does not include locking features. In alternative embodiments, support portions 625 including locking features such as flange 635 and/or protrusion 637. The adaptor bracket 601 portion can include a corresponding locking feature such as receiver 639. Locking features of support portion 625 and/or the adaptor bracket 601 portion function as described with reference to the hinge point of the adaptor bracket 601 portion formed by upper portion 621 and lower portion 623 of adaptor bracket 601. The locking features are configured such that support portion 625 and the adaptor bracket 601 portion are locked when perpendicular rather than when parallel. In alternative embodiments, support portion 625 and the corresponding area of the adaptor bracket 601 portion do not include locking features.

Referring generally to FIG. 8, folding adaptor bracket system 620 can be folded an unfolded in order to install folding adaptor bracket system 620 during a retrofit process using troffer door retrofit system 100 or new construction using troffer door retrofit system 100. Troffer door retrofit system 100 including folding adaptor bracket system 620 rather than two separate adaptor brackets 601 can be used to retrofit existing troffer light fixture 207 as described in FIGS. 5-6G. Folding adaptor bracket system 620 replaces the individual adaptor brackets 601 in retrofit applications. Folding adaptor bracket 620 can be collapsed such that folding adaptor bracket 620 may pass through T-bars 201. Existing troffer housing 207 can be lifted and adaptor bracket 620 passed through T-bars 201 while collapsed. Folding adaptor bracket 620 can then be expanded and/or locked into an open position. Folding adaptor bracket 620 can be placed on T-bars 201 and existing troffer housing 207 can be lowered into position on top of folding adaptor bracket 620 or in a channel of folding adaptor bracket 620 (e.g., channel 605). Door assembly 101 can then be hung from folding adaptor bracket 620 using hinges and/or latches. All or apportion of these steps may be performed in place of or in addition to those steps for retrofitting an existing troffer light fixture 209 described with reference to FIGS. 5-6G.

Existing troffer housing 207 can support folding adaptor bracket 620 and/or door assembly 101 by keeping folding adaptor bracket 620 in place in relation to T-bars 201. Alternatively or additionally, folding adaptor bracket 620 and/or door assembly 101 is supported by folding adaptor bracket 620 which is self-supporting. When expanded, folding adaptor bracket 620 may form a rectangular frame which rests on T-bars 201 and does not pass through T-bars 201. Therefore, folding adaptor bracket 620 may be self-supporting and may support the weight of door assembly 101 without the need for existing troffer housing 207. Existing troffer housing 207 may be left in place or positioned to interface with folding adaptor bracket 620 in retrofit applications in order to retain the electronics (e.g., power supply) associated with (e.g., coupled to) existing troffer housing 207. These electronics can be used to supply electrical power to door assembly 101 and/or otherwise support door assembly 101 (e.g., tie door assembly 101 into a central control system, tie door assembly 101 to switches, provide door assembly 101 with sensor data, etc.).

Still referring generally to FIG. 8, Troffer door retrofit system 100 can alternatively be used for new construction applications. Troffer door retrofit system 100 including folding adaptor bracket system 620 can be used in new construction applications as folding adaptor bracket system 620 is self-supporting. Troffer door retrofit system 100, including folding adaptor bracket system 620 and door assembly 101, can be used to provide a light fixture in new construction applications without using an existing troffer light fixture 209 or existing troffer housing 207. Folding adaptor bracket system 620 may be collapsed or folded. Folding adaptor bracket system 620 may then be passed through T-bars 201 of a ceiling system from below. Folding adaptor bracket 620 may then be expanded and placed on T-bars 201 such that folding adaptor bracket system 620 cannot pass through T-bars 201 (e.g., support portions 625 and adaptor bracket 601 portions rest on T-bars 201). Alternatively, folding adaptor bracket system 620 can be placed on T-bars 201 from above with or without being folded or collapsed prior to being placed on T-bars 201. The rectangular geometry of folding adaptor bracket 620 prevents folding bracket system 620 from passing through T-bars 201 due to interference between portions of folding bracket system 620 and T-bars 201. Door assembly 101 can be hung from folding bracket system 620. Door assembly 101 can be wired to a power supply, control system, sensors, and/or other systems or components. Door assembly 101 may then be closed and latched to folding bracket system 620.

Figure 9A:
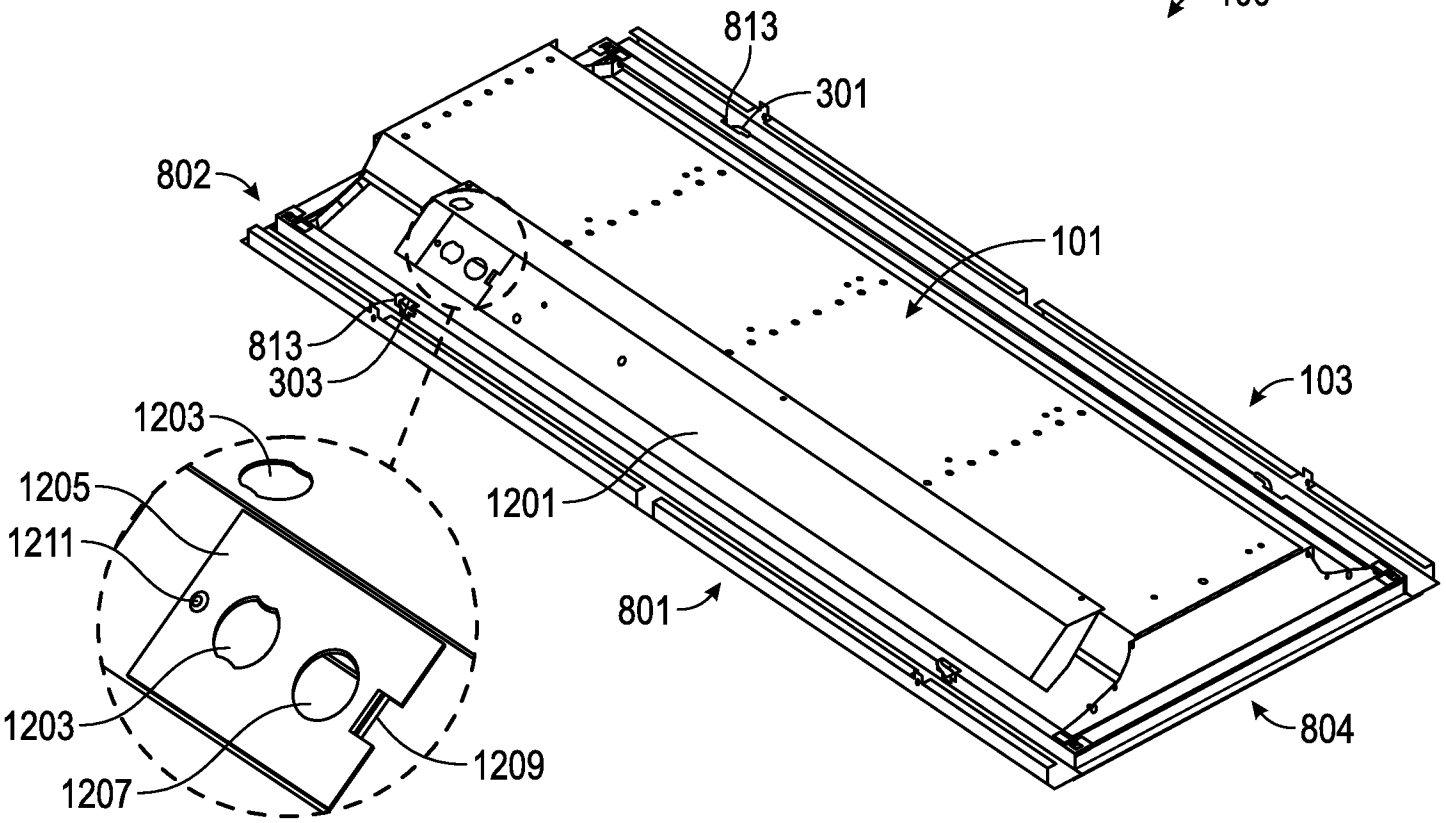
FIG. 9A is an illustration of a door assembly having an access plate for wiring electronic components of the door assembly according to an exemplary embodiment.
Figure 9B:
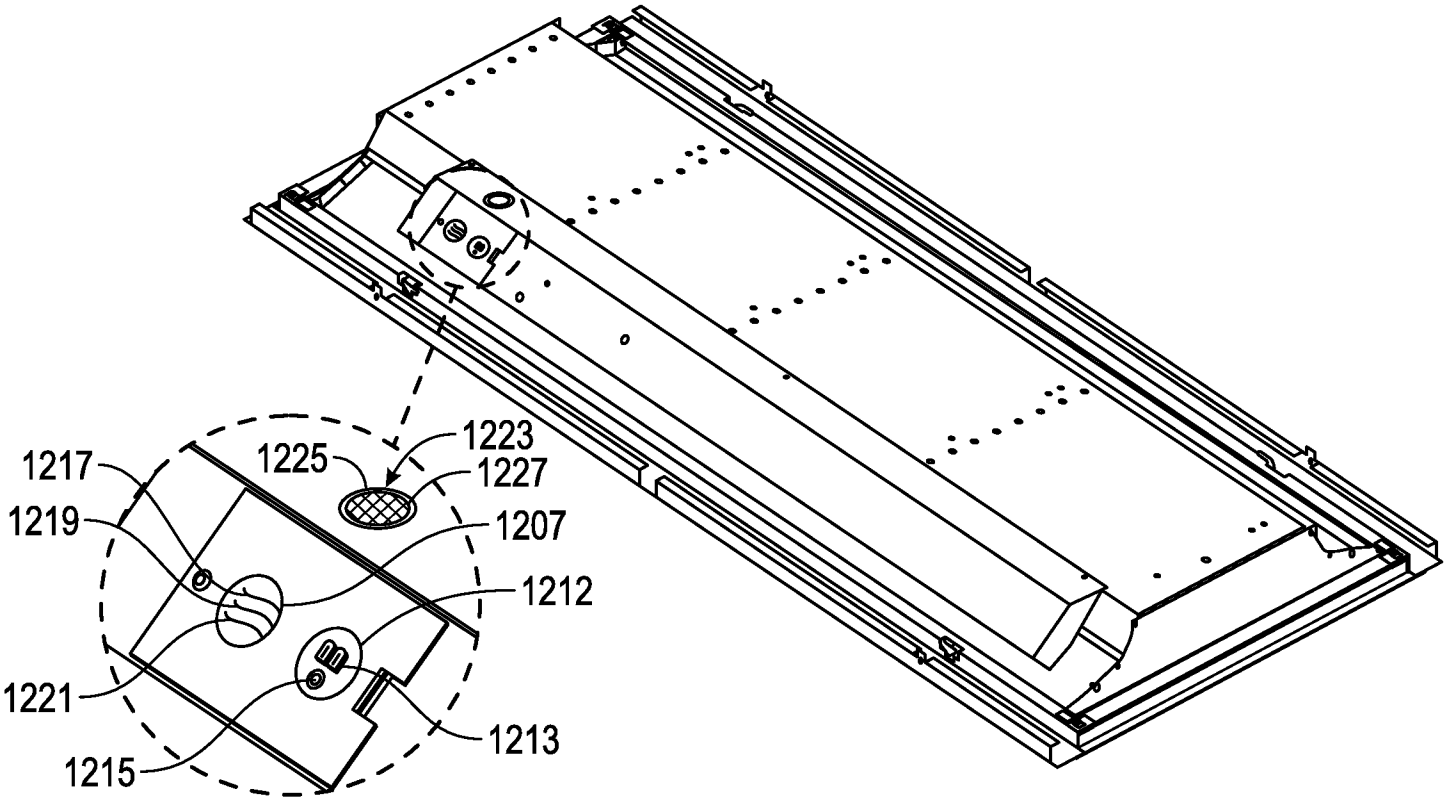
FIG. 9B is an illustration of a door assembly having two connectors for wiring electronic components of the door assembly according to an exemplary embodiment.
Figure 9C:
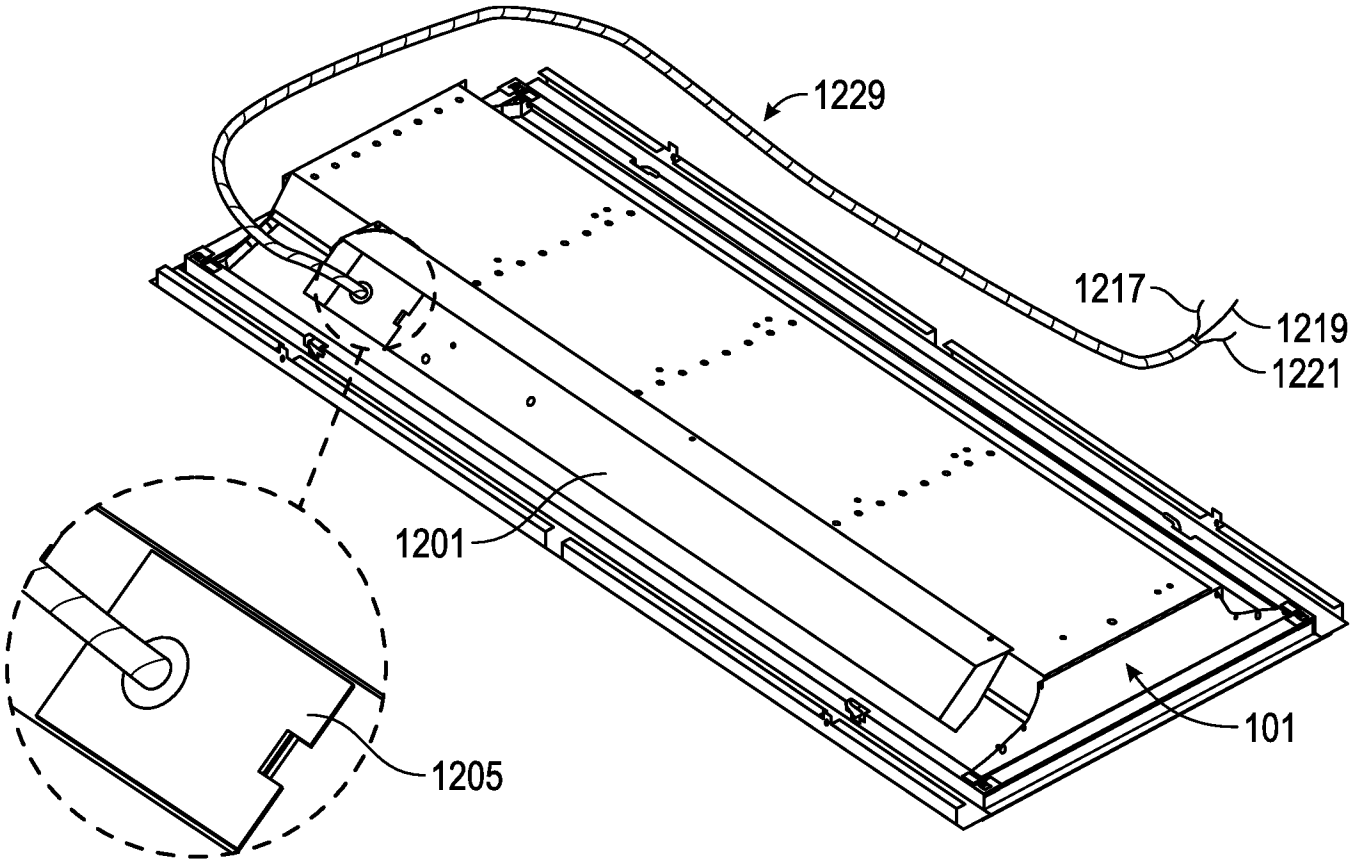
FIG. 9C is an illustration of a door assembly having a whip for wiring electronic components of the door assembly according to an exemplary embodiment.

Referring now to FIGS. 9A-9C generally, troffer retrofit system 100, including a self-supporting adaptor bracket 103 (e.g., four part adaptor bracket 802) and door assembly 101, is illustrated according to various embodiments. Troffer retrofit system 100, specifically door assembly 101, includes various components in a variety of embodiments which facilitate the electrical connections of door assembly 101 to existing troffer light fixtures 209 (e.g., in retrofit applications) and/or components installed as part of new construction (e.g., in new construction applications). In retrofit applications, the use of wire leads, whips (e.g., a series of wire leads encased in flexible plastic or metal) extending from door assembly 101, connectors, and/or other components facilitates the connection of door assembly 101 to existing electrical components (e.g., a power source disconnected from existing troffer light fixture 209). In new construction applications, connectors, whips, and/or other features of door assembly 101 may be used to connect door assembly 101 to a power source (e.g., electrical circuit), sensors, control circuits, and/or other components. In some cases, door assembly 101 may be sealed and/or contain substantially few openings in order to comply with building codes, testing organization requirements, and/or other requirements. Advantageously, the connection options discussed herein may allow for door assembly 101 to be used in new construction applications by allowing door assembly 101 to remain sealed or have substantially few openings. In some cases, building codes, testing organization requirements, and/or other requirements may require that connections between door assembly 101 and power sources, control circuit, and/or other components in new construction applications be made inside door assembly 101 (e.g., the physical connection between wires of door assembly 101 and a power source are housed within door assembly 101). Advantageously, the connection options discussed herein may allow for door assembly 101 to be used in new construction applications by providing for electrical connections to be made within door assembly 101.

Referring now to FIG. 9A, troffer retrofit system 100 is illustrated according to one embodiment. Door assembly 101 is shown attached to four part adaptor bracket 802 (e.g., using hinges 303 and latches 301 of door assembly 101). In one embodiment, door assembly 101 includes access plate 1205. Access plate 1205 may provide an installer access to the interior of electronics enclosure 1201. Electronics enclosure 1201 may house electronic components of door assembly 101 such as a driver, power supply, control circuit, senor logic circuit, sensors, and/or other electronic components. Advantageously, access plate 1205 allows access to electronics enclosure 1201 such that connections to electronic components of door assembly 101 may be made within door assembly 101 (e.g., within electronics enclosure 1201). This may allow door assembly 101 to comply with building codes, testing organization requirements, and/or other requirements related to new construction and/or retrofitting existing troffer light fixtures 209. Electronics enclosure may contain wire leads and/or connectors which may be used to connect one or more electronic components (e.g., power supply) of door assembly 101 to exterior components (e.g., wires of a power source). For example, a power supply or driver of door assembly 101 may have wires which extend therefrom for connection to an exterior power source (e.g., wires for supplying electricity in new construction applications or wires disconnected from an existing troffer light fixture 209 in retrofit applications). These wires may be contained with electronics enclosure 1201 until they are used for wiring door assembly 101.

An installer may access the wire and/or connectors of door assembly 101 through access plate 1205. Access plate 1205 may have latch 1209. Latch 1209 may be used to secure access plate 1205 to electronic enclosure 1201. A user or installer may unlatch latch 1209 (e.g., by pushing latch 1209 away from electronics enclosure 1201). Once unlatched, access plate 1205 may be pivoted about pivot point 1211. Pivot point 1211 may be a rivet, screw, or other fastener coupling access plate 1205 to electronics enclosure 1201 which allows access plate 1205 to rotate relative to electronic enclosure 1201.

With access plate 1205 opened, a user or installer can gain access to wires within electronics enclosure 1201 for connecting door assembly 101 to exterior power sources, power supplies, control circuit, and/or other components. The wires within electronics enclosure 1201 may have a length sufficient to allow them to extend beyond electronics enclosure 1201 when removed by a user or installer through open access plate 1205.

In some embodiments, access plate 1205 includes knockouts 1203. Knockouts 1203 are segments which may be removed by applying sufficient force leaving an opening (e.g., hole 1207). Knockouts 1203 may be the same or similar as to knockouts found in junction boxes. The hole 1207 left by a removed knockout 1203 provides an opening through access plate 1205 which will allow the wires from an exterior source to enter electronics enclosure 1201 when access plate 1205 is closed. An installer or user may pass wires from an exterior source (e.g., power source) through hole 1207 or pass wires from a component (e.g., power supply) of door assembly 101 through hole 1207. The wire from the external component and the wire of the component of door assembly 101 may be joined such that the result wire passes through hole 1207 and enters into electronics enclosure 1201. The connection between the wire from the external component and the component door assembly 101 may be pushed within electronics enclosure 1201. Advantageously, this may allow door assembly 101 to comply with one or more requirements for new construction and/or retrofit applications Hole 1207 may be configured to accept the end of a metal clade whip, other wiring whip, or conduit through which the wire from the exterior component is threaded. The conduit or whip can be secured to access plate 1205 using a securing nut applied through the opening provided by access plate 1205. When access plate 1205 is closed, this results in door assembly 101 remaining sealed. Advantageously, this may allow door assembly 101 to comply with one or more requirements for new construction and/or retrofit applications. The connection between the wires may be made using one or more connectors attached to the wires from components of door assembly 101. The connectors may make the connection process easier, faster, comply with building code requirements, by uniquely shaped to ensure proper connections, and/or otherwise facilitate the process of wiring door assembly 101.

When door assembly 101 is wired, access plate 1205 may be closed. Latch 1209 may prevent inadvertent opening of access plate 1205. In some embodiments access plate 1205 may be secured with additional components. For example, a quarter turn screw may be used to secure the free end of access plate 1205 (e.g., the end opposite pivot point 1211) to electronics enclosure 1201.

Still referring to FIG. 9A, in some embodiments, electronics enclosure 1201 may include one or more knockouts 1203. Knockouts 1203 may be located directly on electronics enclosure 1201 rather than on an access plate 1205. In some embodiments, electronics enclosure 1201 does not include an access plate 1205. Knockouts 1203 may provide an installer or user access to one or more electronic components of door assembly 101 and/or wires associated with those components for use in wiring door assembly 101. In further embodiments, knockouts 1203 directly on electronics enclosure 1201 allow for the wiring of additional and/or optional exterior components to electronic components of door assembly 101. For example, one or more sensors may be wired to components of door assembly 101 (e.g., a control circuit and/or sensor logic circuitry) through the knockout 1203. The additional knockout 1203 directly on electronics enclosure 1201 may provide the additional space needed for wiring associated with the sensors to enter electronics enclosure 1201. In some embodiments, the interior of knockout 1203 can be accessed via access plate 1205. Advantageously, this may allow for a user or installer to attach a metal clad whip or conduit to electronics enclosure 1201 through knockout 1203 (e.g., hole 1207 left when knockout 1203 is removed). For example, a metal clad whip or conduit may be extended through the hole 1207 left by knockout 1203 and a securing nut may be attached to the whip or conduit on the inside of electronics enclosure 1201 through the opening provided by access plate 1205. The securing nut may be larger than hole 1207 and prevent the whip or conduit from exiting electronics enclosure 1201. Advantageously, this may result in a sealed door assembly which complies with one or more requirements for new construction and/or retrofit applications. Alternatively, knockout 1203 may be removed and door assembly 101 wired without conduit or a metal clad whip. The hole 1207 left by the removal of knockout 1203 may remain unsealed (e.g., in retrofit applications).

Referring now to FIG. 9B, door assembly 101 is illustrated according to one embodiment in which electronics enclosure 1201 includes two connections, one for use in retrofit applications and one for use in new constructions applications. Troffer retrofit system 100 can include one or more caps 1223 which are used to cover the unused connection. For example, in retrofit applications connector 1212 may be used to wire door assembly 101 and cap 1223 may be used to cover hole 1207 and the connections for new construction applications which are not used. This prevents exposed connections or connectors and/or seals electronics enclosure 1201. The two connections may be wired in a loop such that either connection wires door assembly 101. For example, in the case that the connectors are used to wire door assembly 101 to a power source or power supply, the positive terminal or wire of one connector may be wired in parallel with the positive terminal or wire of the second connector. The connector terminals or wires in parallel may be wired to a positive wire of a power supply of door assembly 101. Similarly, the grounds and negatives of the two connectors may be wired in parallel such that the ground and negative connections of the power supply may be wired to external ground wires and negative wires through either connector.

In some embodiments, electronics enclosure 1201 includes one or more exposed connectors 1212. Exposed connector 1212 is located on access plate 1205 in one embodiment and provided with sufficient length of wiring inside electronics enclosure 1201 (e.g., wiring connecting exposed connector 1212 to one or more electronic components of door assembly 101) to allow for access plate 1205 to pivot open and closed. In an alternative embodiment, exposed connector 1212 is located directly on electronics enclosure 1201 rather than on access plate 1205.

In one embodiment, exposed connector 1212 is used for retrofit applications. As exposed connector 1212 creates a connection between components of door assembly 101 and exterior components which is located outside of electronics enclosure 1201, exposed connector may not satisfy requirements for new construction applications in some cases. As a result, exposed connector 1212 may be used only for retrofit applications in some embodiments. In alternative embodiments, exposed connector 1212 may be used for either retrofit applications or new construction applications.

Exposed connector 1212 may be used to wire door assembly 101 to one or more exterior components (e.g., power sources, power supplies, sensors, controls, etc.). In some embodiments, exposed connector includes one or more plug and socket type connectors 1213. Plug and socket type connector 1213 may include a contact and surround which accepts a plug having a contact coupled to a wire from an exterior component (e.g., a power source). For example, plug and socket type connector 1213 may include two contacts and two surrounds which accept a plug from coupled to wires from an exterior power source. Each contact may couple electronics of door assembly 101 (e.g., a power supply) to a positive and negative wire from a power source. In some embodiments, exposed connector 1212 and/or an additional exposed connector 1212 may be used to wire additional components of door assembly 101. For example, exposed connector 1212 may include a plug-in or crimp connector 1215 for grounding door assembly 101. A ground wire from door assembly 101 may be attached to plug-in or crimp connector 1215. Coupling a ground wire from an external source to plug-in or crimp connector 1215 may ground door assembly 101. Exposed connector(s) 1212 may be or include connectors of one or more type such as crimp connectors, plug-in connectors, plug and socket connectors, and/or other type of connectors. In some embodiments, the connector type may be a proprietary type of connector (e.g., having a specific geometry). A plurality of components of door assembly 101 may be wired to external components, power sources, power supplies, sensors, controls, and/or other components included in new construction and/or an existing troffer light fixture 209.

In one embodiment, the second connector is hole 1207 with access to wires (e.g., a positive wire 1217, negative wire 1219, and ground wire 1221) from an electronic component of door assembly 101 (e.g., a power supply). The wires may terminate in a connector such as a crimp connector, plug in connector, or other type of connector. This connection may be used for new construction applications in which conduit or a whip is connected to electronics enclosure 1201 as explained with reference to FIG. 9A. In further embodiments, both connections are this type. In still further embodiments, more than two connectors having holes 1207 may be included in electronics enclosure 1201. Hole 1207 may be located on access plate 1205 or may alternatively be located directly on electronics housing 1207. Hole 1207 may be used for wiring door assembly 101 in new construction applications and/or in retrofit applications.

In one embodiment, hole 1207 and wires 1217, 1219, and 1221 are used to wire door assembly 101 to a power source and/or other exterior components in new construction applications. Exposed connector 1212 is capped with cap 1223. Access plate 1205 provides access such that positive wire 1217, negative wire 1219, and ground wire 1221, may be connected to exterior counterparts. For example, positive wire 1217 may connect a power supply of door assembly 101 to a positive wire of a power source and negative wire 1219 may connect a power supply of door assembly 101 to a negative wire of a power source. A conduit or whip can be secured to access plate 1205 and access plate 1205 can be latched closed. This may result in a sealed or substantially sealed electronics enclosure 1201 for use in new construction applications.

Still referring to FIG. 9B, cap 1223 may be configured to cap off exposed connector 1212 and hole 1207 depending on whether door assembly 101 is used in a retrofit or new construction application. Cap 1223 may include a main portion 1225 and lip 1227. Lip 1227 may provide an interference fit with whole 1207 and the periphery of exposed connector 1212. This allows cap 1223 to cap either connector which remains unused depending on the application.

Referring now to FIG. 9C, door assembly 101 is illustrated according to one embodiment including whip 1229 for wiring door assembly 101 to exterior components (e.g., a power source). Whip 1229 may be used to wire door assembly 101 in retrofit applications and new construction applications. Advantageously, whip 1229 may be sealed with electronics enclosure 1201 such that door assembly 101 complies with new construction application requirements. The connection between door assembly 101 and other components (e.g., a power circuit, sensors, controls, etc.) may be made within a junction box remote from door assembly 101 and at the terminus of whip 1229. In retrofit applications, excess length of whip 1229 may be wrapped around door assembly 101 and/or otherwise poisoned with a troffer housing 207 of an existing troffer light fixture 209. Wires included within whip 1229 may be used to wire door assembly 101 to existing equipment (e.g., a power source disconnected from an existing troffer light fixture 209) or to new components.

In one embodiment, whip 1229 is a metal clad whip including positive wire 1217, negative wire 1219, and ground wire 1221. Positive wire 1217 and negative wire 1219 may connect to a power supply or driver within electronics enclosure 1201. These wires may be used to connect the power supply or driver of door assembly 101 to a power source (e.g., an electrical circuit). Ground wire 1221 may be used to ground door assembly 101. In alternative embodiments, whip 1229 may be clad in plastic, polymer, rubber, and/or other materials. In further embodiments, whip 1229 includes additional wiring for connecting other components of door assembly 101 to external components. For example, wiring may be provided to couple electronics of door assembly 101 to control circuits, sensors, and/or other external components.

In one embodiment, whip 1229 exits electronics enclosure 1201 through access plate 1205. This may allow for whip 1229 to be stored within electronics enclosure 1201 until it is used during a retrofit application or new construction application. Access plate 1205 may be opened and whip 1229 may be removed from electronics enclosure 1201. Whip 1229 may be secured to a hole 1207 (e.g., as a result of removing a knockout 1203) in electronics enclosure 1201 using a securing nut. This may result in a sealed electronics enclosure. In one embodiment, whip 1229 is pre-wired to electronic components of door assembly 101. In alternative embodiments, whip 1229 is wired to electronic components of door assembly 101 after being removed from electronics enclosure 1201. The connections may be placed within electronics enclosure when whip 1229 is secured to access plate 1205. In alternative embodiments, whip 1229 exits directly from electronics enclosure 1201. Electronics enclosure 1201 may not include an access plate 1205 in some embodiments.

Figure 10A:
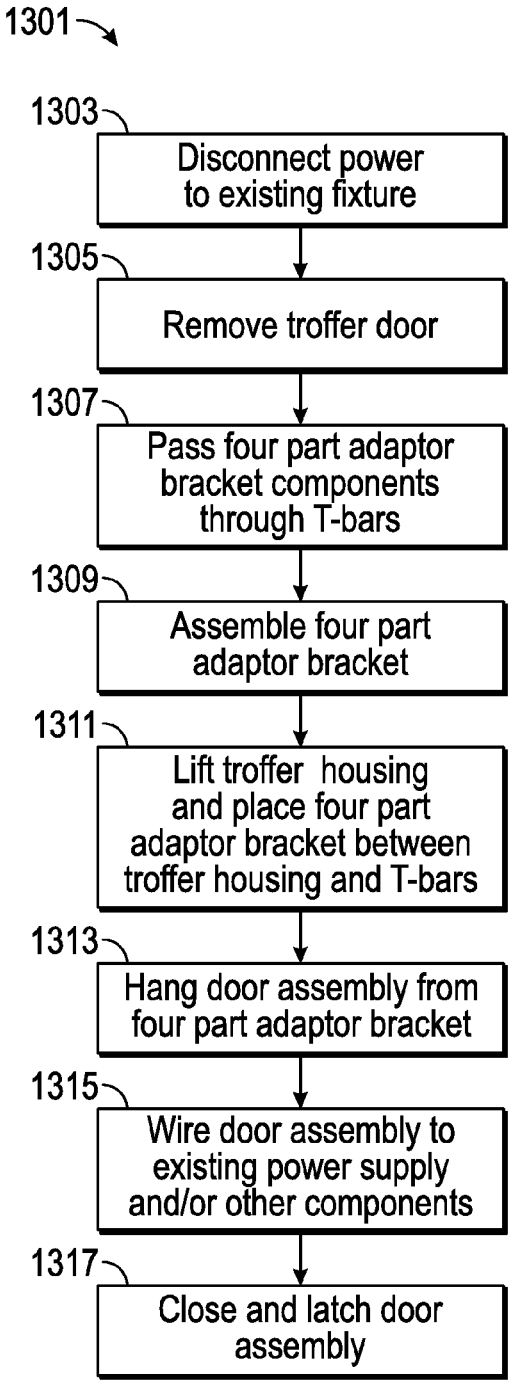
FIG. 10A illustrates a flow chart of a method for installing a door assembly and four part adaptor bracket in a retrofit application according to an exemplary embodiment.

Referring now to FIG. 10A, method 1301 for using troffer retrofit system 100 including four part adaptor bracket 802 in a retrofit application is illustrated according to one embodiment. When retrofitting an existing troffer light fixture 209, an installer may disconnect power to the existing troffer light fixture 209 (1303). The installer can remove the troffer door of the existing troffer light fixture 209 (1305). This may include removing other components of the existing troffer light fixture 209. For example, lamps, ballast covers, ballast, drivers, and/or other components may be removed to provide space for door assembly 101 of troffer retrofit system 100. A power source (e.g., wiring from a power circuit) may be disconnected from the existing troffer light fixture 209 for later use. Alternatively, a power supply or driver of existing troffer light fixture 209 may be disconnected from a lamp or other component such the power supply or driver may be later used.

The unassembled (e.g., uncoupled) parts of four part adaptor bracket 802 may be passed through the T-bars 201 of a ceiling system used to support the existing troffer light fixture 209 (1307). Individual parts of adaptor bracket 802 may be easy to move through a ceiling system. The individual parts of four part adaptor bracket 802 may be assembled above T-bars 201 (1309). The four parts of four part adaptor bracket 802 may be assembled using coupling tabs 806 and receivers 808 and/or other components or techniques. Once four part adaptor bracket 802 is assembles, troffer housing 207 of existing troffer light fixture 209 may be lifted and four part adaptor bracket 802 may be placed between troffer housing 207 and T-bars 201 (1311). Four part adaptor bracket 802 may rest on T-bars 201. Troffer housing 207 may rest in or on four part adaptor bracket 802 (e.g., in channels 807 or on flange 805).

Door assembly 101 may be hung from four part adaptor bracket 802 (1313). Hinges 303 of door assembly 101 may be placed in slots 813 in order for four part adaptor bracket 802 and/or troffer housing 207 to support door assembly 101. Door assembly 101 may be wired to an existing power supply, power source, and/or additional components (1315). In one embodiment, door assembly 101 may be wired to a power source such as supply wires disconnected from existing troffer housing 209. The power source may be wired to a power supply, driver, control circuit, and/or other components of door assembly 101. In an alternative embodiment, a power supply of existing troffer light fixture 209 may be wired to a power supply, driver, control circuit, and/or other components of door assembly 101. In some embodiments, door assembly 101 includes lead wires and/or connectors (e.g., quick connect/disconnect hardware) to receive the wires of the power source or power supply. In further embodiments, other existing components such as control circuitry, sensors, etc. may be wired to door assembly 101. These components may be wired to a power supply, driver, control circuit, and/or other components of door assembly 101. Wiring may be facilitated by connectors, lead wires, and/or other components included in door assembly 101 in some embodiments. Door assembly 101 may be closed and latched to four part adaptor bracket 802 (e.g., using latches 301 and slots 813) (1317).

In alternative embodiments, of method 1301 for retrofitting an existing troffer light fixture, alternative steps and/or sequences of steps are used. In one embodiment, step 1309 may be skipped and adaptor bracket 801 portions may be used without supports 804. The adaptor bracket 801 portions of four part adaptor bracket 802 may be supported by T-bars 201 and/or troffer housing 207 without the use of supports 804. In an alternative embodiment, folding bracket system 620 is used in place of four part adaptor bracket 802. Folding bracket system 620 may be collapsed and passed through T-bars 201 and then unfolded in place of steps 1307 and/or 1309.

Figure 10B:
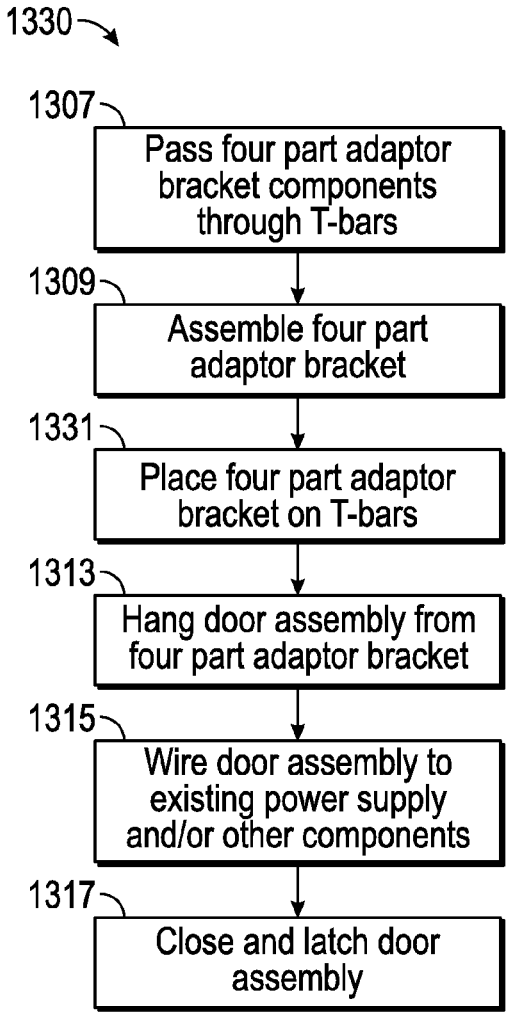
FIG. 10B illustrates a flow chart of a method for installing a door assembly and four part adaptor bracket in a new construction application according to an exemplary embodiment.

Referring now to FIG. 10B, method 1301 for using troffer retrofit system 100 including four part adaptor bracket 802 in a new construction application is illustrated according to one embodiment. Four part adaptor bracket 802 can be passed through T-bars 201 of a ceiling system while unassembled (e.g., as individual parts) (1307). Four part adaptor bracket 802 can be assembled (1309). Once assembled, four part adaptor bracket 802 can be placed on T-bars 201 (1331). In new construction applications there may not be an existing troffer light fixture 209 with troffer housing 207. Four part adaptor bracket 802 is self-supporting on T-bars 201. Door assembly 101 may be hung from four part adaptor bracket 802 (1313). Door assembly 101 may be wired to a power source and/or other components (1315). In new construction applications, door assembly 101 may be wired to power sources such as wiring from a power circuit being installed along with troffer retrofit system 100. For example, wiring may be run from a circuit for the purpose of powering new light fixtures. The wiring may be contained within conduit and/or metal cable. In some embodiments, control devices, sensors, and/or other components may be installed with troffer retrofit system 100. These components may be wired to door assembly 101 (e.g., using wire leads, connectors, and/or other components of door assembly 101). Components (e.g., control circuits, power sources, sensors, etc.) may be wired to a power supply, sensor logic circuitry, control circuit, driver, and/or other electronic components included in door assembly 101. Door assembly 101 may then be closed and latched shut (1317).

In an alternative embodiment, folding bracket system 620 is used in place of four part adaptor bracket 802. A folding bracket system 620 may be collapsed, passed through T-bars 201, expanded, and placed on T-bars 201. Folding bracket system 620 may be self-supporting. Door assembly 101 may be hung from folding bracket system 620. In further alternative embodiments, adaptor bracket 103 (e.g., four part adaptor bracket 802 or folding bracket system 620) may be placed from above rather than passed through T-bars 201.

Referring now to FIGS. 10A and 10B, troffer retrofit system 100 may be used for either retrofit applications or new construction applications. Advantageously, the same adaptor bracket 103 (e.g., four part adaptor bracket 802 or folding bracket system 620) may be used for either application. This allows troffer retrofit system 100 to be sold, purchased, used, etc. for both retrofit applications and new construction applications.

Figure 11:
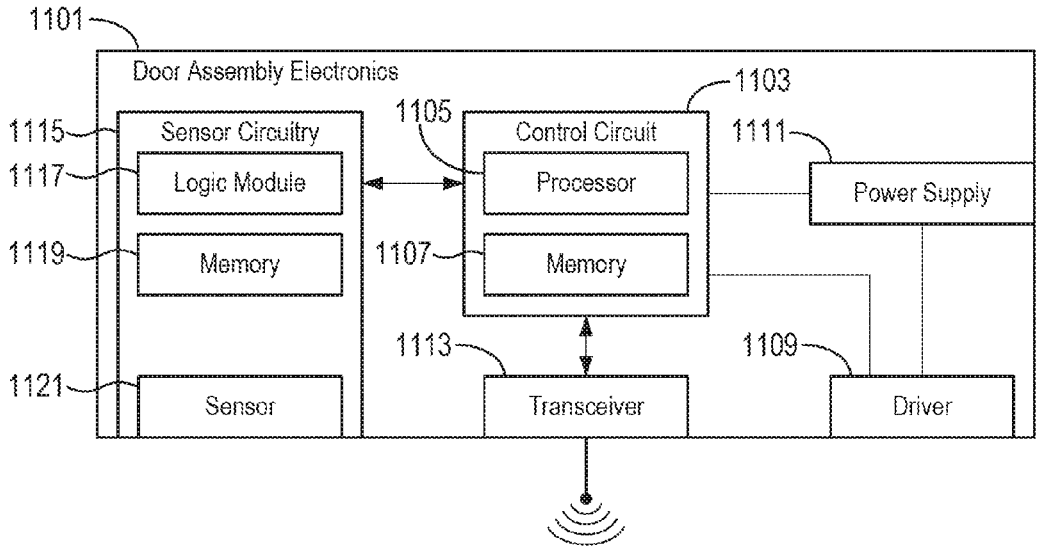
FIG. 11 illustrates the electrical components of a door assembly according to an exemplary embodiment.

Referring now to FIG. 11, components of door assembly electronics 1101 are illustrated according to one embodiment. Door assembly 101 can include a various door assembly electronics 1101 in various embodiments. In various embodiments, door assembly electronics 1101 are located within cover 313, electronics housing 413 and electronics cover 415, or electronics enclosure 1201. In further embodiments, one or more components or portions thereof can be located partially or completely outside of a cover or housing. Door assembly electronics 1101 can control light output of LEDs included in door assembly 101, provide power to LEDs in door assembly 101, and/or perform other functions.

In some embodiments, door assembly electronics 1101 include a power supply 1111. Power supply 1111 can be one or more electrical supply wires which enter cover 313, electronics housing 413 and electronics cover 415, or electronics enclosure 1201. Power supply 1111 can include further components such as capacitors, modulators, transformers, batteries, and/or other components to regulate, alter, modify, or otherwise provide electrical power to door assembly electronics 1101 and/or LEDs in door assembly 101. In some embodiments, electronics enclose 1201 can include one or more third party electronic components. For example, electronics enclosure 1201 may include a transceiver from a third party manufacturer. The transceiver may be configured to wirelessly control light fixtures and/or elements of light fixtures (e.g., LED drivers). The transceiver or other third party electronics may be wired to a driver, power supply and/or other components in electronics enclosure 1201. In one embodiments, the third party electronic device includes an integrated transceiver, control circuit, and driver. It may be located within electronics enclosure 1201 and wired to LEDs within door assembly 101.

In some embodiments, door assembly electronics 1101 include driver 1109. Driver 1109 can be a driver for driving or otherwise providing power to LEDs within door assembly 101. Driver 1109 may be electrically coupled to one or more LEDs, LED strips, and/or other LEDs through wiring. The wiring may exit cover 313, electronics housing 413 and electronics cover 415, or electronics enclosure 1201. Driver 1109 can control electrical power supplied to the LEDs using techniques such as pulse width modulation and/or other techniques. Driver 1109, by controlling the supply of electrical power to the LEDs, can control the light output of the LEDs. Driver 1109 can control the intensity of the light output from the LEDs, control the color temperature of light output by the LEDs, dim the LEDs, turn on or off the LEDs, and/or otherwise alter or control the light output from the LEDs. Driver 1109 can be coupled to control circuit 1103. Driver 1109 can be controlled by control circuit 1103.

In some embodiments, door assembly electronics 1101 include control circuit 1103. Control circuit 1103 may contain circuitry, hardware, and/or software for facilitating and/or performing the functions described herein. The control circuit 1103 may handle inputs, process inputs, run programs, handle instructions, route information, control memory 1107, control a processor 1105, process data, generate outputs, communicate with other devices or hardware, and/or otherwise perform general or specific computing tasks. In some embodiments, the control circuit 233 includes a processor 1105 and/or memory 1107. Control circuit 1103 can perform functions such as controlling driver 1109 in response to inputs, receive inputs from transceiver 113, receive inputs locally (e.g., through a user interface, buttons, switches, etc.), receive inputs from sensor circuitry 1115, control sensor circuitry 1115, control transceiver 1113 (e.g., send or receive communications using transceiver 1113), and/or perform other functions related to door assembly 101 and/or other light fixtures or devices.

Processor 1105 may be implemented as a general-purpose processor, an application specific integrated circuit (ASIC), one or more field programmable gate arrays (FPGAs), a digital-signal-processor (DSP), a group of processing components, or other suitable electronic processing components. Memory 1107 is one or more devices (e.g. RAM, ROM, Flash Memory, hard disk storage, etc.) for storing data and/or computer code for facilitating the various processes described herein. Memory 1107 may be or include non-transient volatile memory or non-volatile memory. Memory 1107 may include database components, object code components, script components, or any other type of information structure for supporting various activities and information structures described herein. Memory 1107 may be communicably connected to processor 1105 and provide computer code or instructions to processor 1105 for executing the processes described herein. Memory 1107 and/or the control circuit 1103 may facilitate the functions described herein using one or more programming techniques, data manipulation techniques, and/or processing techniques such as using algorithms, routines, lookup tables, arrays, searching, databases, comparisons, instructions, etc.

In some embodiments, door assembly electronics 1101 include transceiver 1113. Transceiver 1113 may be a wireless transceiver used to send and/or receive wireless communications. For example, transceiver 1113 may be a transceiver which sends and/or receives radio frequency transmissions using protocols and/or hardware related to WiFi, Zigbee, Bluetooth, or other types of communication. In other embodiments, transceiver 1113 uses communication techniques other than the use of radio frequency transmissions. For example, transceiver 1113 may use ultrasound, optical, infrared, and/or other communications techniques. Transceiver 1113 can provide control signals to control circuit 1103. In response to control signals (e.g., sent from a control device such as a mobile phone, computer, remote, or other device), control circuit 1103 can control the light output of door assembly 101 using driver 1109. For example, control circuit 1103 can adjust the light intensity, color temperature, turn on or off LEDs, or otherwise change the light output of door assembly 101 using driver 1109.

In some embodiments, control circuit 1103 can control transceiver 1113 in order to transmit communication signals. Control circuit 1103 can transmit information, using transceiver 1113, related to the functions of door assembly 101, the light output of door assembly 101, and/or sensor information received by sensor circuitry 1115. For example, control circuit 1103 can cause the transition of information, using transceiver 1113, including diagnostic information, whether door assembly 101 is currently on or off, the light intensity being produced by door assembly 101, whether motion has been detected by sensor circuitry 1115, and/or other information. In some embodiments, transceiver 1113 transmits this and/or other information to mobile phones, computers, remotes, and/or other devices. In further embodiments, transceiver 1113 transmits this information to one or more other door assemblies 101.

In some embodiments, door assembly 1101 includes sensor circuitry 1115. Sensor circuitry 1115 can be controlled by control circuit 1103. Sensor circuitry 1115 can also provide sensor information and/or control signals to control circuit 1103. Sensor circuitry may include one or more logic modules 1117, memory 1119, and/or sensors 1121. Sensor circuitry can use these and/or other components to provide door assembly electronics 1101 information regarding the environment in which door assembly 101 operates. For example, sensor circuitry 1115 can detect motion with a motion sensor. In response to detecting motion (e.g., using a motion sensor 1121 and processing the data using memory 1119 and/or logic module 1117), sensor circuitry 1115 can provide the information and/or a control signal to control circuit 1103 which causes control circuit 1103 to take action (e.g., turning on one or more LEDs, adjusting the intensity and/or color temperature of the light output, etc.). As an additional example, sensor circuitry 1115 can determine the intensity or amount of light surrounding door assembly 101. In response to determining the amount or intensity of light (e.g., using a light sensors 1121, memory 1119, a threshold value and/or logic module 1117), sensor circuitry 1115 can provide the information and/or a control signal to control circuit 1103 which causes control circuit 1103 to take action (e.g., adjust the light output using driver 1109 to compensate for low light by increasing the light output, decrease the light output in response to high levels of ambient light, etc.).

Sensor circuitry 1115 may contain circuitry, hardware, and/or software for facilitating and/or performing the functions described herein. Sensor circuitry 1115 may handle inputs, process inputs, run programs, handle instructions, route information, control memory 1119, control or use a logic module 1117, process data, generate outputs, communicate with other devices or hardware, and/or otherwise perform general or specific computing tasks. Sensor circuitry 1115 can be or include an application specific integrated circuit (ASIC), one or more field programmable gate arrays (FPGAs), a digital-signal-processor (DSP), a group of processing components, or other suitable electronic processing components. Memory 1119 is one or more devices (e.g. RAM, ROM, Flash Memory, hard disk storage, etc.) for storing data and/or computer code for facilitating the various processes described herein. Memory 1119 may be or include non-transient volatile memory or non-volatile memory. Memory 1119 may include database components, object code components, script components, or any other type of information structure for supporting various activities and information structures described herein. Memory 1119 may provide computer code or instructions for executing the processes described herein. Memory 1119 and/or the sensor circuitry 1115 may facilitate the functions described herein using one or more programming techniques, data manipulation techniques, and/or processing techniques such as using algorithms, routines, lookup tables, arrays, searching, databases, comparisons, instructions, etc.

Logic module 1117 may be implemented as hardware and/or software. Logic module 1117 may be stored in or use memory 1119. Logic module 1117 can provide code or instructions for carrying out or facilitating the functions of sensor circuitry 1115 described herein. Alternatively, logic module can carry out these functions directly. Logic module 1117 can be used to perform tasks such as comparing sensor data to threshold values, determining if movement has occurred using a variety of techniques, measuring ambient light, comparing ambient light measurements to threshold values, formatting control signals for control circuit 1103, and/or perform other tasks or functions to facilitate the operation of door assembly 101 as described herein.

In some embodiments, sensor circuitry 1115 includes one or more sensors 1121. Sensors 1121 can be any type of sensor. In one embodiment, sensor 1121 is or includes a motion sensor. For example, sensor 1121 may be or include an infrared motion sensor, ultrasound motion sensor, projected capacitance motion sensor, microwave motion sensor, and/or other type of motion sensor. In other embodiments, sensor 1121 can be or include a light sensor. For example, sensor 1121 may be or include a photodetector, bolometer, photoresister, or other light sensor. In still further embodiments, sensor 1121 can be or include other types of sensors such as temperature sensors, humidity sensors, and/or other sensors. Sensor 1121 may be located partially or wholly outside of cover 313, electronics housing 413 and electronics cover 415, or electronics enclosure 1201.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A light fixture for use in either retrofitting an existing troffer light fixture or for use in new construction, comprising:

a self-supporting adaptor bracket configured to rest on a plurality of T-bars that form an opening of a ceiling system and further configured to optionally receive a housing of the existing troffer light fixture, the self-supporting adapter bracket including a pair of sections each having a first portion collapsibly connected to a second portion, wherein the first portion is selectively repositionable relative to the second portion such that the self-supporting bracket is collapsible from at least one of an assembled orientation and an open orientation to facilitate installation thereof through the opening and into the ceiling system, and a door assembly including:

a latch configured to engage a latch surface of the adaptor bracket;

a hinge configured to interface with a slot of the adaptor bracket;

a housing including the latch and the hinge;

a light source within the housing; and a connection system configured to be used to wire the door assembly to one or more external components.

2. The light fixture of claim 1, wherein the connection system includes an access plate which allows for connection of the door assembly to an external power source, and wherein the connection is contained within the housing.

3. The light fixture of claim 2, wherein the access plate include one or more knockouts configured to allow for a conduit to be attached to the access plate.

4. The light fixture of claim 1, wherein the connection system includes an external connector and access to lead wires contained within the housing.

5. The light fixture of claim 4, wherein the connection system further includes a cap configured to cap off either the external connector or the access to lead wires.

6. The light fixture of claim 4, wherein the external connector is a proprietary connector.

7. The light fixture of claim 4, wherein the lead wires include a connector.

8. The light fixture of claim 1, wherein the connection system includes a wiring whip configured to extend from the housing.

9. The light fixture of claim 8, wherein the housing includes an access plate and wherein the housing is configured to contain the wiring whip prior to its use by an installer to wire the door assembly to the external component.

10. The light fixture of claim 1, wherein the one or more external components include at least one of a power source, a power supply, a sensor, a control system, or a control circuit.

11. The light fixture of claim 1, wherein the first portions of the self-supporting adapter bracket are connected to the second portions of the self-supporting adapter bracket with hinges such that the self-supporting adapter bracket is foldable to facilitate installation thereof.

12. The light fixture of claim 1, wherein the first portions of the self-supporting adapter bracket are connected to the second portions of the self-supporting adapter bracket with snap-fit connections such that the self-supporting adapter bracket is assemblable above the T-bar of the ceiling system to facilitate installation of the light fixture.

13. The light fixture of claim 11, wherein the first portions of the self-supporting adapter bracket are selectively lockable with the second portions of the self-supporting adapter bracket to thereby hold the self-supporting adapter bracket in the open orientation.

14. The light fixture of claim 13, wherein the first portions and the second portions of the self-supporting adapter bracket comprise a protrusion and a mating receiver, the mating receiver cooperating with the protrusion to hold the self-supporting adapter bracket in the open orientation.

15. The light fixture of claim 12, wherein the first portions and the second portions of the self-supporting adapter bracket comprise a coupling tab and a receiver, the coupling tab interfacing with the receiver to hold the self-supporting adapter bracket in the assembled orientation.

* * * * *